US007673976B2

(12) United States Patent
Piatt et al.

(10) Patent No.: US 7,673,976 B2
(45) Date of Patent: Mar. 9, 2010

(54) CONTINUOUS INK JET APPARATUS AND METHOD USING A PLURALITY OF BREAK-OFF TIMES

(75) Inventors: Michael J. Piatt, Dayton, OH (US); Stephen F. Pond, Williamsburg, VA (US); James A. Katerberg, Kettering, OH (US); Randy D. Vandagriff, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 97 days.

(21) Appl. No.: 11/229,261

(22) Filed: Sep. 16, 2005

(65) Prior Publication Data

US 2007/0064066 A1 Mar. 22, 2007

(51) Int. Cl.
*B41J 2/07* (2006.01)

(52) U.S. Cl. ..... 347/74

(58) Field of Classification Search ..... 347/73–83
See application file for complete search history.

(56) References Cited

U.S. PATENT DOCUMENTS 3,373,437 A 3/1968 Sweet ..... 347/74

(Continued)

FOREIGN PATENT DOCUMENTS

WO WO 86/03457 6/1986

(Continued)

OTHER PUBLICATIONS

Katerberg, James A.; Stimulation for High Quality, High Speed Ink-Jet Printers; 1996, Recent Progress in Ink Jet Technologies, pp. 80-81.*

*Primary Examiner*—Stephen D Meier
*Assistant Examiner*—Alexander C Witkowski
(74) *Attorney, Agent, or Firm*—Stephen Pond Consulting

(57) ABSTRACT

A continuous liquid drop emission apparatus is disclosed comprising a liquid drop emitter containing a positively pressurized liquid in flow communication with a plurality of nozzles formed in a common nozzle member for emitting a plurality of continuous streams of liquid. A jet stimulation apparatus is provided comprising a plurality of transducers corresponding to the plurality of nozzles and adapted to transfer energy to the liquid in corresponding flow communication with the plurality of nozzles sufficient to cause the break-off of the plurality of continuous streams of liquid at a plurality of predetermined break-off times into a plurality of streams of drops of predetermined volumes. Sensing apparatus is provided adapted to measure a characteristic value for each of the plurality of streams of drops of predetermined volumes; and control apparatus is adapted to provide a plurality of break-off time setting signals to the jet stimulation apparatus to cause the plurality of predetermined break-off times determined, at least, by the characteristic value of each of the plurality of streams of drops of predetermined volumes. Alternately, a sensing apparatus is used in an off-line calibration set-up and characteristic values are measured for the plurality of streams and stored in a stream memory that is included in the continuous liquid drop apparatus. The present inventions are also configured to provide a plurality of the break-off times for a plurality of liquid streams in a continuous liquid drop emission apparatus that is further adapted to inductively charge at least one drop in a each of a plurality of streams and having electric field deflection apparatus adapted to generate a Coulomb force on an inductively charged drop. Methods of operating a continuous liquid drop emission apparatus utilizing a plurality of predetermined break-off times are disclosed.

9 Claims, 33 Drawing Sheets

U.S. PATENT DOCUMENTS 3,560,641 A 2/1971 Taylor et al. ..... 358/296
3,596,275 A 7/1971 Sweet ..... 347/74
3,739,393 A 6/1973 Lyon et al. ..... 347/75
3,836,912 A * 9/1974 Ghougasian et al. ..... 347/81
3,877,036 A 4/1975 Loeffler et al. ..... 347/77
3,878,519 A 4/1975 Eaton ..... 347/75
3,886,564 A 5/1975 Naylor et al. ..... 347/81
4,067,019 A 1/1978 Fleischer et al. ..... 347/81
4,136,345 A 1/1979 Neville et al. ..... 347/81
4,220,958 A 9/1980 Crowley ..... 347/75
4,249,188 A * 2/1981 Graf ..... 347/77
4,255,754 A 3/1981 Crean et al. ..... 347/81
4,277,790 A * 7/1981 Heibein et al. ..... 347/49
4,323,905 A 4/1982 Reitberger et al. ..... 347/6
4,417,256 A * 11/1983 Fillmore et al. ..... 347/78
4,631,550 A 12/1986 Piatt et al. ..... 346/1.1
4,638,328 A * 1/1987 Drake et al. ..... 347/75
4,644,369 A * 2/1987 Gamblin et al. ..... 347/75
4,650,694 A * 3/1987 Dressler et al. ..... 427/469
4,698,642 A * 10/1987 Gamblin ..... 347/42
4,754,289 A * 6/1988 Kudo ..... 347/81
4,990,932 A * 2/1991 Houston ..... 347/81
5,394,177 A 2/1995 McCann et al. ..... 347/7
5,430,306 A * 7/1995 Ix ..... 250/573
5,455,611 A 10/1995 Simon et al.. ..... 347/49
5,455,614 A * 10/1995 Rhodes ..... 347/74
5,517,216 A * 5/1996 Stamer et al. ..... 347/6
6,003,980 A * 12/1999 Sheinman et al. ..... 347/78
6,086,190 A * 7/2000 Schantz et al. ..... 347/81
6,161,914 A * 12/2000 Haselby ..... 347/19
6,273,559 B1 * 8/2001 Vago et al. ..... 347/74
6,387,225 B1 5/2002 Shimada et al. ..... 204/192.18
6,435,645 B1 * 8/2002 Falinski ..... 347/19
6,447,108 B1 * 9/2002 Kassner ..... 347/80
6,450,619 B1 9/2002 Anagnostopoulos et al. .. 347/59
6,450,628 B1 * 9/2002 Jeanmaire et al. ..... 347/75
6,464,322 B2 * 10/2002 Dunand ..... 347/19
6,474,784 B1 11/2002 Fujii et al. ..... 347/54
6,474,794 B1 11/2002 Anagnostopoulos et al. .. 347/74
6,491,385 B2 12/2002 Anagnostopoulos et al. .. 347/73
6,508,542 B2 1/2003 Sharma et al. ..... 347/77
6,508,543 B2 * 1/2003 Hawkins et al. ..... 347/77
6,511,161 B2 1/2003 Sumi et al. ..... 347/68
6,517,197 B2 * 2/2003 Hawkins et al. ..... 347/74
6,536,883 B2 * 3/2003 Hawkins et al. ..... 347/77
6,543,107 B1 4/2003 Miyashita et al. ..... 29/25.35
6,561,614 B1 5/2003 Therien et al. ..... 347/19
6,561,627 B2 5/2003 Jarrold et al. ..... 347/54
6,578,946 B1 * 6/2003 Schantz ..... 347/22
6,588,888 B2 7/2003 Jeanmaire et al. ..... 347/77
6,663,221 B2 * 12/2003 Anagnostopoulos et al. .. 347/40
6,676,249 B2 * 1/2004 Lebens ..... 347/75
6,739,705 B2 * 5/2004 Jeanmaire et al. ..... 347/77
6,764,168 B1 * 7/2004 Meinhold et al. ..... 347/81
6,769,756 B2 * 8/2004 Su et al. ..... 347/19
6,793,328 B2 * 9/2004 Jeanmaire ..... 347/74
6,945,638 B2 * 9/2005 Teung et al. ..... 347/74
7,121,642 B2 * 10/2006 Stoessel et al. ..... 347/19
7,152,964 B2 * 12/2006 Jeanmaire ..... 347/74
2002/0113849 A1 * 8/2002 Hawkins et al. ..... 347/77
2002/0171717 A1 * 11/2002 Satou et al. ..... 347/77
2003/0016277 A1 * 1/2003 Hawkins et al. ..... 347/77
2003/0081040 A1 * 5/2003 Therien et al. ..... 347/19
2003/0137566 A1 * 7/2003 Jeanmaire et al. ..... 347/77
2003/0156169 A1 * 8/2003 Martin et al. ..... 347/77
2003/0174190 A1 * 9/2003 Jeanmaire ..... 347/74
2003/0193551 A1 * 10/2003 Jeanmaire et al. ..... 347/74
2003/0202054 A1 * 10/2003 Jeanmaire et al. ..... 347/77
2003/0202055 A1 * 10/2003 Jeanmaire et al. ..... 347/82
2003/0222950 A1 * 12/2003 Jeanmaire ..... 347/77
2003/0231232 A1 * 12/2003 Eguchi et al.
2004/0095441 A1 * 5/2004 Jeanmaire ..... 347/82
2005/0046680 A1 * 3/2005 Cheng et al. ..... 347/74
2005/0122381 A1 * 6/2005 Golombat et al. ..... 347/77
2005/0179743 A1 * 8/2005 Hirota et al. ..... 347/65
2005/0206688 A1 * 9/2005 Gelbart et al. ..... 347/74
2005/0212845 A1 * 9/2005 Shinkawa ..... 347/19
2005/0243144 A1 * 11/2005 Dean et al. ..... 347/74
2005/0253905 A1 * 11/2005 Orme-Marmerelis et al. . 347/75
2006/0023035 A1 * 2/2006 Sugahara ..... 347/74
2006/0262168 A1 * 11/2006 Hawkins et al. ..... 347/74

FOREIGN PATENT DOCUMENTS

WO WO 01/87616 11/2001

* cited by examiner

CONTINUOUS INK JET APPARATUS AND METHOD USING A PLURALITY OF BREAK-OFF TIMES

CROSS REFERENCE TO RELATED APPLICATIONS

Reference is made to commonly assigned, U.S. patent application Ser. No. 11/229,467 filed concurrently herewith, entitled "INK JET BREAK-OFF LENGTH CONTROLLED DYNAMICALLY BY INDIVIDUAL JET STIMULATION." in the name of Gilbert A. Hawkins et al.; U.S. patent application Ser. No. 11/229,454 filed concurrently herewith, entitled "INK JET BREAK-OFF LENGTH MEASUREMENT APPARATUS AND METHOD," in the name of Gilbert A. Hawkins et al.; U.S. patent application Ser. No. 11/229,263 filed concurrently herewith, entitled "CONTINUOUS INK JET APPARATUS WITH INTEGRATED DROP ACTION DEVICES AND CONTROL CIRCUITRY," in the name of Michael J. Piatt, et al.; U.S. patent application Ser. No. 11/229,459 filed concurrently herewith, entitled "METHOD FOR DROP BREAKOFF LENGTH CONTROL IN A HIGH RESOLUTION INK JET PRINTER", in the name of Michael J. Piatt et al.; and U.S. patent application Ser. No. 11/229,456 filed concurrently herewith, entitled "IMPROVED INK JET PRINTING DEVICE WITH IMPROVED DROP SELECTION CONTROL", in the name of James A. Katerberg, the disclosures all of which are incorporated herein by reference.

FIELD OF THE INVENTION

This invention relates generally to continuous stream type ink jet printing systems and more particularly to printheads which stimulate the ink in the continuous stream type ink jet printers by individual jet stimulation apparatus, especially using thermal energy pulses.

BACKGROUND OF THE INVENTION

Ink jet printing has become recognized as a prominent contender in the digitally controlled, electronic printing arena because, e.g. of its non-impact, low-noise characteristics, its use of plain paper and its avoidance of toner transfer and fixing. Ink jet printing mechanisms can be categorized by technology as either drop on demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. This form of ink jet is commonly termed "thermal ink jet (TIJ)." Other known drop-on-demand droplet ejection mechanisms include piezoelectric actuators, such as that disclosed in U.S. Pat. No. 5,224,843, issued to van Lintel, on Jul. 6, 1993; thermo-mechanical actuators, such as those disclosed by Jarrold et al., U.S. Pat. No. 6,561,627, issued May 13, 2003; and electrostatic actuators, as described by Fujii et al., U.S. Pat. No. 6,474,784, issued Nov. 5, 2002.

The second technology, commonly referred to as "continuous" ink jet printing, uses a pressurized ink source that produces a continuous stream of ink droplets from a nozzle. The stream is perturbed in some fashion causing it to break up into uniformly sized drops at a nominally constant distance, the break-off length, from the nozzle. A charging electrode structure is positioned at the nominally constant break-off point so as to induce a data-dependent amount of electrical charge on the drop at the moment of break-off. The charged droplets are directed through a fixed electrostatic field region causing each droplet to deflect proportionately to its charge. The charge levels established at the break-off point thereby cause drops to travel to a specific location on a recording medium or to a gutter for collection and recirculation.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a jet of diameter, $d_j$, moving at a velocity, $v_j$. The jet diameter, $d_j$, is approximately equal to the effective nozzle diameter, $d_n$, and the jet velocity is proportional to the square root of the reservoir pressure, P. Rayleigh's analysis showed that the jet will naturally break up into drops of varying sizes based on surface waves that have wavelengths, $\lambda$, longer than $\pi d_j$, i.e. $\lambda \geqq \pi d_j$. Rayleigh's analysis also showed that particular surface wavelengths would become dominate if initiated at a large enough magnitude, thereby "synchronizing" the jet to produce mono-sized drops. Continuous ink jet (CIJ) drop generators employ some periodic physical process, a so-called "perturbation" or "stimulation", that has the effect of establishing a particular, dominate surface wave on the jet. This results in the break-off of the jet into mono-sized drops synchronized to the frequency of the perturbation.

The drop stream that results from applying a Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal may be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present inventions and is not considered to obviate the fact that the drop sizes have been predetermined by the synchronizing energy signals used in the present inventions. Thus the phrase "predetermined volume" as used to describe the present inventions should be understood to comprehend that some small variation in drop volume about a planned target value may occur due to unpredictable satellite drop formation.

Commercially practiced CIJ printheads use a piezoelectric device, acoustically coupled to the printhead, to initiate a dominant surface wave on the jet. The coupled piezoelectric device superimposes periodic pressure variations on the base reservoir pressure, causing velocity or flow perturbations that in turn launch synchronizing surface waves. A pioneering disclosure of a piezoelectrically-stimulated CIJ apparatus was made by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure.

Sweet '275 disclosed several approaches to providing the needed periodic perturbation to the jet to synchronize drop break-off to the perturbation frequency. Sweet '275 discloses a magnetostrictive material affixed to a capillary nozzle enclosed by an electrical coil that is electrically driven at the desired drop generation frequency, vibrating the nozzle, thereby introducing a dominant surface wave perturbation to the jet via the jet velocity. Sweet '275 also discloses a thin ring-electrode positioned to surround but not touch the unbroken fluid jet, just downstream of the nozzle. If the jetted fluid is conductive, and a periodic electric field is applied between the fluid filament and the ring-electrode, the fluid jet may be caused to expand periodically, thereby directly introducing a surface wave perturbation that can synchronize the jet break-off. This CIJ technique is commonly called electrohydrodynamic (EHD) stimulation.

Sweet '275 further disclosed several techniques for applying a synchronizing perturbation by superimposing a pressure variation on the base liquid reservoir pressure that forms the jet. Sweet '275 disclosed a pressurized fluid chamber, the drop generator chamber, having a wall that can be vibrated mechanically at the desired stimulation frequency. Mechanical vibration means disclosed included use of magnetostrictive or piezoelectric transducer drivers or an electromagnetic moving coil. Such mechanical vibration methods are often termed "acoustic stimulation" in the CIJ literature.

The several CIJ stimulation approaches disclosed by Sweet '275 may all be practical in the context of a single jet system However, the selection of a practical stimulation mechanism for a CIJ system having many jets is far more complex. A pioneering disclosure of a multi-jet CIJ printhead has been made by Sweet et al. in U.S. Pat. No. 3,373,437, issued Mar. 12, 1968, Sweet '437 hereinafter. Sweet '437 discloses a CIJ printhead having a common drop generator chamber that communicates with a row (an array) of drop emitting nozzles. A rear wall of the common drop generator chamber is vibrated by means of a magnetostrictive device, thereby modulating the chamber pressure and causing a jet velocity perturbation on every jet of the array of jets.

Since the pioneering CIJ disclosures of Sweet '275 and Sweet '437, most disclosed multi-jet CIJ printheads have employed some variation of the jet break-off perturbation means described therein. For example, U.S. Pat. No. 3,560,641 issued Feb. 2, 1971 to Taylor et al. discloses a CIJ printing apparatus having multiple, multi-jet arrays wherein the drop break-off stimulation is introduced by means of a vibration device affixed to a high pressure ink supply line that supplies the multiple CIJ printheads. U.S. Pat. No. 3,739,393 issued Jun. 12, 1973 to Lyon et al. discloses a multi-jet CIJ array wherein the multiple nozzles are formed as orifices in a single thin nozzle plate and the drop break-off perturbation is provided by vibrating the nozzle plate, an approach akin to the single nozzle vibrator disclosed by Sweet '275. U.S. Pat. No. 3,877,036 issued Apr. 8, 1975 to Loeffler et al. discloses a multi-jet CIJ printhead wherein a piezoelectric transducer is bonded to an internal wall of a common drop generator chamber, a combination of the stimulation concepts disclosed by Sweet '437 and '275

Unfortunately, all of the stimulation methods employing a vibration some component of the printhead structure or a modulation of the common supply pressure result is some amount of non-uniformity of the magnitude of the perturbation applied to each individual jet of a multi-jet CIJ array. Non-uniform stimulation leads to a variability in the break-off length and timing among the jets of the array. This variability in break-off characteristics, in turn, leads to an inability to position a common drop charging assembly or to use a data timing scheme that can serve all of the jets of the array. As the array becomes physically larger, for example long enough to span one dimension of a typical paper size (herein termed a "page wide array"), the problem of non-uniformity of jet stimulation becomes more severe.

The construction of large arrays of CIJ jets also involves some form of drop selection and deflection apparatus that acts to differentiate among drops used for printing or patterning and drops discarded (guttered) to a liquid fluid supply recirculation system. The difficulty of creating drop selection and deflection apparatus that perfectly operates on all drops of all liquid streams in a consistent and equal fashion adds additional sources of drop placement error to those caused by non-uniform jet stimulation. Drop stimulation apparatus that has the capability of adjustment in the parameters of jet break-off on an individual jet basis may be able to provide some compensation for non-uniformities in the drop selection and deflection apparatus in addition to providing for predictable drop break-off characteristics.

Many attempts to achieve uniform CIJ stimulation using vibrating devices may be found in the U.S. patent literature. However, it appears that the structures that are strong and durable enough to be operated at high ink reservoir pressures contribute confounding acoustic responses that cannot be totally eliminated in the range of frequencies of interest. Commercial CIJ systems employ designs that carefully manage the acoustic behavior of the printhead structure and also limit the magnitude of the applied acoustic energy to the least necessary to achieve acceptable drop break-off across the array. A means of CIJ stimulation that does not significantly couple to the printhead structure itself would be an advantage, especially for the construction of page wide arrays (PWA's) and for reliable operation in the face of drifting ink and environmental parameters.

The electrohydrodynamic (EHD) jet stimulation concept disclosed by Sweet '275 operates on the emitted liquid jet filament directly, causing minimal acoustic excitation of the printhead structure itself, thereby avoiding the above noted confounding contributions of printhead and mounting structure resonances. U.S. Pat. No. 4,220,958 issued Sep. 2, 1980 to Crowley discloses a CIJ printer wherein the perturbation is accomplished an EHD exciter composed of pump electrodes of a length equal to about one-half the droplet spacing. The multiple pump electrodes are spaced at intervals of multiples of about one-half the droplet spacing or wavelength downstream from the nozzles. This arrangement greatly reduces the voltage needed to achieve drop break-off over the configuration disclosed by Sweet '275.

While EHD stimulation has been pursued as an alternative to acoustic stimulation, it has not been applied commercially because of the difficulty in fabricating printhead structures having the very close jet-to-electrode spacing and alignment required and, then, operating reliably without electrostatic breakdown occurring. Also, due to the relatively long range of electric field effects, EHD is not amenable to providing individual stimulation signals to individual jets in an array of closely spaced jets.

An alternate jet perturbation concept that overcomes all of the drawbacks of acoustic or EHD stimulation was disclosed for a single jet CIJ system in U.S. Pat. No. 3,878,519 issued Apr. 15, 1975 to J. Eaton (Eaton hereinafter). Eaton discloses the thermal stimulation of a jet fluid filament by means of localized light energy or by means of a resistive heater located at the nozzle, the point of formation of the fluid jet. Eaton explains that the fluid properties, especially the surface tension, of a heated portion of a jet may be sufficiently changed with respect to an unheated portion to cause a localized change in the diameter of the jet, thereby launching a dominant surface wave if applied at an appropriate frequency.

Eaton mentions that thermal stimulation is beneficial for use in a printhead having a plurality of closely spaced ink streams because the thermal stimulation of one stream does not affect any adjacent nozzle. However, Eaton does not teach or disclose any multi-jet printhead configurations, nor any practical methods of implementing a thermally-stimulated multi-jet CIJ device, especially one amenable to page wide array construction. Eaton teaches his invention using calculational examples and parameters relevant to a state-of-the-art ink jet printing application circa the early 1970's, i.e. a drop frequency of 100 KHz and a nozzle diameter of ~25 microns leading to drop volumes of ~60 picoLiters (pL). Eaton does not teach or disclose how to configure or operate a thermally-stimulated CIJ printhead that would be needed to print drops an order of magnitude smaller and at substantially higher drop frequencies.

U.S. Pat. No. 4,638,328 issued Jan. 20, 1987 to Drake, et al. (Drake hereinafter) discloses a thermally-stimulated multi-jet CIJ drop generator fabricated in an analogous fashion to a thermal ink jet device. That is, Drake discloses the operation of a traditional thermal ink jet (TIJ) edgeshooter or roof-shooter device in CIJ mode by supplying high pressure ink and applying energy pulses to the heaters sufficient to cause synchronized break-off but not so as to generate vapor bubbles. Drake mentions that the power applied to each individual stimulation resistor may be tailored to eliminate non-uniformities due to cross talk. However, the inventions claimed and taught by Drake are specific to CIJ devices fabricated using two substrates that are bonded together, one substrate being planar and having heater electrodes and the other having topographical features that form individual ink channels and a common ink supply manifold.

Also recently, microelectromechanical systems (MEMS), have been disclosed that utilize electromechanical and thermomechanical transducers to generate mechanical energy for performing work. For example, thin film piezoelectric, ferroelectric or electrostrictive materials such as lead zirconate titanate (PZT), lead lanthanum zirconate titanate (PLZT), or lead magnesium niobate titanate (PMNT) may be deposited by sputtering or sol gel techniques to serve as a layer that will expand or contract in response to an applied electric field. See, for example Shimada, et al. in U.S. Pat. No. 6,387,225, issued May 14, 2002; Sumi, et al., in U.S. Pat. No. 6,511,161, issued Jan. 28, 2003; and Miyashita, et al., in U.S. Pat. No. 6,543,107, issued Apr. 8, 2003. Thermomechanical devices utilizing electroresistive materials that have large coefficients of thermal expansion, such as titanium aluminide, have been disclosed as thermal actuators constructed on semiconductor substrates. See, for example, Jarrold et al., U.S. Pat. No. 6,561,627, issued May 13, 2003. Therefore electromechanical devices may also be configured and fabricated using microelectronic processes to provide stimulation energy on a jet-by-jet basis.

Consequently there is a need for a liquid stream break-off control system that is generally applicable to a liquid drop emission system having jet stimulation apparatus capable of individually adjusting stimulation, hence break-off, parameters on an individual jet basis. There is an opportunity to effectively employ the extraordinary capability of thermal or other microelectromechanical stimulation to change the break-up process jets individually, without causing undesirable jet-to-jet crosstalk, and to change the break-up process within an individual jet in ways that compensate for anomalies in the drop selection, deflection and guttering subsystem hardware, thereby achieving higher drop placement precision, i.e. higher liquid pattern quality, and overall system reliability. Further there is a need for an approach that may be economically applied to a liquid drop emitter having a very large number of jets.

SUMMARY OF THE INVENTION

It is therefore an object of the present invention to provide a continuous liquid drop emission apparatus that utilizes the characteristics of thermal stimulation of individual streams for a traditional charged-drop CIJ system.

It is an object of the present invention to provide a continuous liquid drop emission apparatus that utilizes the characteristics of electromechanical and thermomechanical stimulation of individual streams for a traditional charged-drop CIJ system.

It is also an object of the present invention to provide a jet break-off control apparatus that operates a plurality of steams with a plurality of predetermined break-off parameters.

It is also an object of the present invention to provide a jet break-off control apparatus that operates to compensate for non-uniformities in associated drop charging, deflection and guttering apparatus.

Further it is an object of the present invention to provide methods for operating a continuous liquid drop emission system having individual jet stimulation capability using a plurality of liquid stream break-off parameters.

It is further an object of the present inventions that the liquid drop emission apparatus and methods of operating are utilized wherein the liquid is an ink and the apparatus is an ink jet printing system.

The foregoing and numerous other features, objects and advantages of the present invention will become readily apparent upon a review of the detailed description, claims and drawings set forth herein. These features, objects and advantages are accomplished by constructing a continuous liquid drop emission apparatus comprising a liquid drop emitter containing a positively pressurized liquid in flow communication with a plurality of nozzles formed in a common nozzle member for emitting a plurality of continuous streams of liquid. A jet stimulation apparatus is provided comprising a plurality of transducers corresponding to the plurality of nozzles and adapted to transfer energy to the liquid in corresponding flow communication with the plurality of nozzles sufficient to cause the break-off of the plurality of continuous streams of liquid at a plurality of predetermined break-off times into a plurality of streams of drops of predetermined volumes. Control apparatus is adapted to provide a plurality of break-off time setting signals to the jet stimulation apparatus to cause the plurality of predetermined break-off times determined, at least, by the characteristic value of each of the plurality of streams of drops of predetermined volumes.

The present inventions are configured to measure a characteristic value for each of the plurality of streams of drops of predetermined volumes by drop sensing apparatus provided within the liquid drop emission system or provided with an off-line calibration test set-up that stores measured characteristic values in a stream characteristic memory apparatus within the continuous liquid drop emission system.

The present inventions are also configured to provide a plurality of the break-off times for a plurality of liquid streams in a continuous liquid drop emission apparatus that is further adapted to inductively charge at least one drop in a each of a plurality of streams and having electric field deflection apparatus adapted to generate a Coulomb force on an inductively charged drop.

The present inventions further include methods of operating a continuous liquid drop emission apparatus utilizing a plurality of predetermined break-off times by applying a break-off test sequence of electrical pulses to the jet stimulation apparatus; inductively charging at least one drop of each stream of drops; sensing the inductive charging amount on the inductively charged drops; calculating a characteristic value of the plurality of streams of drops; determining a plurality of break-off time setting signals that are then provided to the jet stimulation apparatus to cause the plurality of continuous streams of fluid to break-off at a plurality of break-off times that are predetermined by the break-off time setting signals.

These and other objects, features, and advantages of the present inventions will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. Functional elements and features have been given the same numerical labels in the figures if they are the same element or perform the same function for purposes of understanding the present inventions. It is to be understood that elements not specifically shown or described may take various forms well known to those skilled in the art.

Figure 1A:
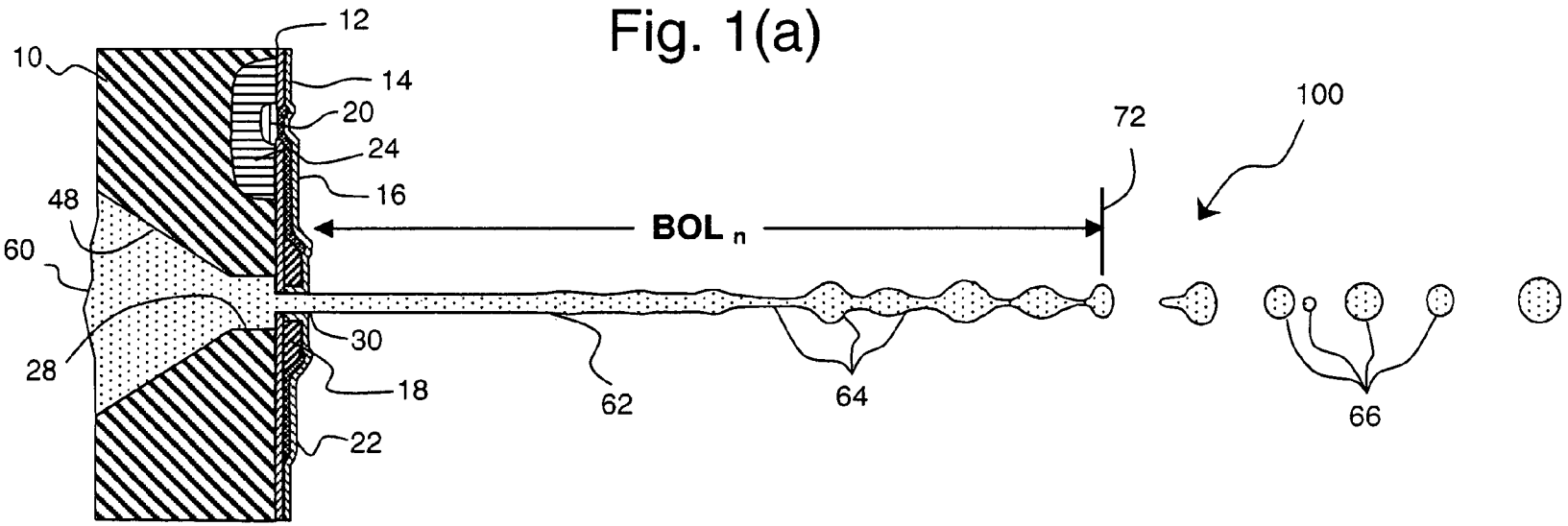
FIGS. 1(*a*) and 1(*b*) are side view illustrations of a continuous liquid stream undergoing natural break up into drops and thermally stimulated break up into drops of predetermined volumes respectively.
Figure 1B:
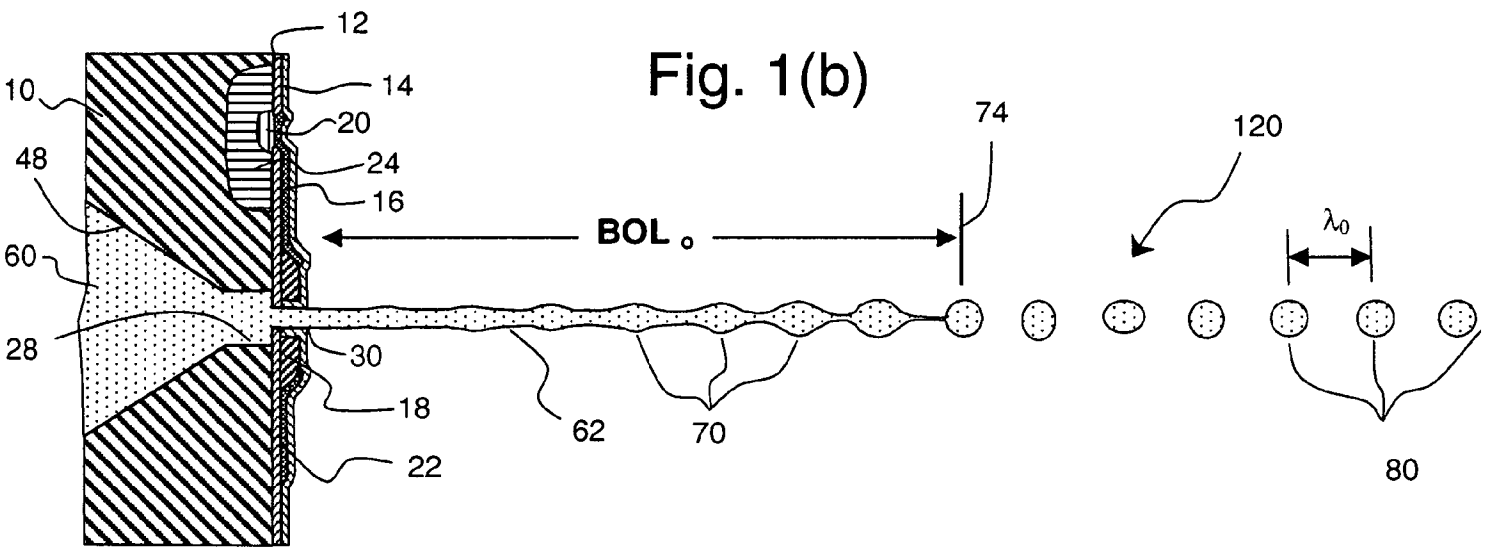

Referring to FIGS. 1(*a*) and 1(*b*), there is shown a portion of a liquid emission apparatus wherein a continuous stream of liquid 62, a liquid jet, is emitted from a nozzle 30 supplied by a liquid 60 held under high pressure in a liquid emitter chamber 48. The liquid stream 62 in FIG. 1(*a*) is illustrated as breaking up into droplets 66 after some distance 77 of travel from the nozzle 30. The liquid stream illustrated will be termed a natural liquid jet or stream of drops of undetermined volumes 100. The travel distance 77 is commonly referred to as the break-off length (BOL). The liquid stream 62 in FIG. 1(*a*) is breaking up naturally into drops of varying volumes. As noted above, the physics of natural liquid jet break-up was analyzed in the late nineteenth century by Lord Rayleigh and other scientists. Lord Rayleigh explained that surface waves form on the liquid jet having spatial wavelengths, $\lambda$, that are related to the diameter of the jet, $d_j$, that is nearly equal to the nozzle 30 diameter, $d_n$. These naturally occurring surface waves, $\lambda_n$, have lengths that are distributed over a range of approximately, $\pi d_j \leqq \lambda_n \leqq 10 d_j$.

Natural surface waves 64 having different wavelengths grow in magnitude until the continuous stream is broken up in to droplets 66 having varying volumes that are indeterminate within a range that corresponds to the above remarked wavelength range. That is, the naturally occurring drops 66 have volumes $V_n \approx \lambda_n(\pi d_j^2/4)$, or a volume range: $(\pi^2 d_j^3/4) \leqq V_n \leqq (10\pi d_j^3/4)$. In addition there are extraneous small ligaments of fluid that form small drops termed "satellite" drops among main drop leading to yet more dispersion in the drop volumes produced by natural fluid streams or jets. FIG. 1(*a*) illustrates natural stream break-up at one instant in time. In practice the break-up is chaotic as different surfaces waves form and grow at different instants. A break-off length for the natural liquid jet 100, $BOL_n$, is indicated; however, this length is also highly time-dependent and indeterminate within a wide range of lengths.

FIG. 1(*b*) illustrates a liquid stream 62 that is being controlled to break up into drops of predetermined volumes 80 at predetermined intervals, $\lambda_0$. The break-up control or synchronization of liquid stream 62 is achieved by a resistive heater apparatus adapted to apply thermal energy pulses to the flow of pressurized liquid 60 immediately prior to the nozzle 30. One embodiment of a suitable resistive heater apparatus according to the present inventions is illustrated by heater resistor 18 that surrounds the fluid 60 flow emitted from nozzle 30. Resistive heater apparatus according to the present inventions will be discussed in more detail herein below. The synchronized liquid stream 62 is caused to break up into a stream of drops of predetermined volume, $V_0 \approx \lambda_0(\pi d_j^2/4)$ by the application of thermal pulses that cause the launching of a dominant surface wave 70 on the jet. To launch a synchronizing surface wave of wavelength $\lambda_0$ the thermal pulses are introduced at a frequency $f_0 = v_{j0}/\lambda_0$, where $v_{j0}$ is the desired operating value of the liquid stream velocity. The synchronizing stimulation period is $\tau_0 = 1/f_0$.

FIG. 1(*b*) also illustrates a stream of drops of predetermined volumes 120 that is breaking off at 76, a predetermined, preferred operating break-off length distance, $BOL_0$. The break-off length is related to an operating break-off time, $BOL_0 = (v_{j0})\ (BOT_0)$. While the stream break-up period is determined by the stimulation wavelength, the break-off length and time is determined by the intensity of the stimulation. The dominant surface wave initiated by the stimulation thermal pulses grows exponentially until it exceeds the stream diameter. If it is initiated at higher amplitude the exponential growth to break-off can occur within only a few wavelengths of the stimulation wavelength. Typically, for a weakly synchronized jet, one for which the stimulation is just barely able to become dominate before break-off occurs, break-off lengths of ~12 $\lambda_0$ will be observed. The operating break-off length illustrated in FIG. 1(*b*) is $8\lambda_0$. Shorter break-off lengths may be chosen and even BOL ~$1\lambda_0$ is feasible.

Achieving very short break-off lengths may require very high stimulation energies, especially when jetting viscous liquids. The stimulation structures, for example, heater resistor 18, may exhibit more rapid failure rates if thermally cycled to very high temperatures, thereby imposing a practical reliability consideration on the break-off length choice. For prior art CIJ acoustic stimulation, it is exceedingly difficult to achieve highly uniform acoustic pressure over distances greater than a few centimeters.

The known factors that are influential in determining the break-off length of a liquid jet include the jet velocity, nozzle shape, liquid surface tension, viscosity and density, and stimulation magnitude and harmonic content. Other factors such as surface chemical and mechanical features of the final fluid passageway and nozzle exit may also be influential. When trying to construct a liquid drop emitter comprised of a large array of continuous fluid streams of drops of predetermined volumes, these many factors affecting the break-off length lead to a serious problem of non-uniform break-off length (or time) among the fluid streams. Non-uniform break-off time, in turn, contributes to an indefiniteness in the timing of when a drop becomes ballistic. i.e. no longer propelled by the reservoir and in the timing of when a given drop may be selected for deposition or not in an image or other layer pattern at a receiver.

Figure 2:
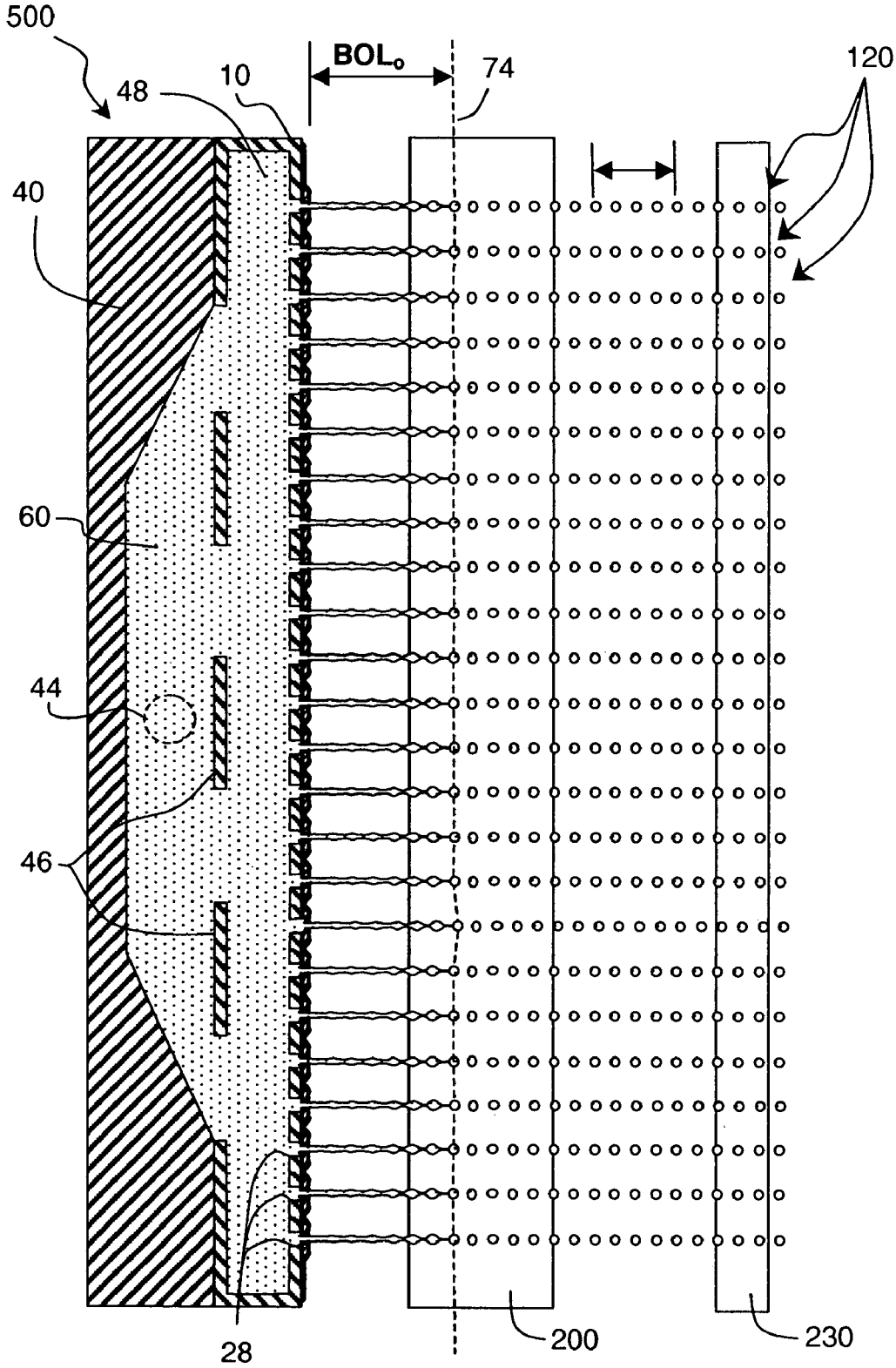
FIG. 2 is a top side view illustration of a liquid drop emitter system having a plurality of liquid streams breaking up into drops of predetermined volumes wherein the break-off lengths are controlled to a single operating length according to the present inventions.

FIG. 2 illustrates a top view of a multi-jet liquid drop emitter 500 employing thermal stimulation to synchronize all of the streams to break up into streams of drops of predetermined volumes 110. A BOL control apparatus according to co-pending U.S. patent application Ser. No. 11/229,467 filed concurrently herewith, entitled "INK JET BREAK-OFF LENGTH CONTROLLED DYNAMICALLY BY INDIVIDUAL JET STIMULATION." in the name of Gilbert A.

Hawkins et al. has brought each jet to a chosen operating break-off length $BOL_0$ as shown in FIG. 2. In contrast to this single operating $BOL_0$ or $BOT_0$ value, the present inventions are directed to apparatus and methods wherein a plurality of break-off time values are used to operate a plurality of jets in order to compensate for various drop emission system non-uniformities to be described hereinbelow.

Liquid drop emitter 500 is illustrated in partial sectional view as being constructed of a substrate 10 that is formed with thermal stimulation elements surrounding nozzle structures as illustrated in FIGS. 1(*a*) and 1(*b*). Substrate 10 is also configured to have flow separation regions 28 that separate the liquid 60 flow from the pressurized liquid supply chamber 48 into streams of pressurized liquid to individual nozzles. Pressurized liquid supply chamber 48 is formed by the combination of substrate 10 and pressurized liquid supply manifold 40 and receives a supply of pressurized liquid via inlet 44 shown in phantom line. In many preferred embodiments of the present inventions substrate 10 is a single crystal semiconductor material having MOS circuitry formed therein to support various transducer elements of the liquid drop emission system. Strength members 46 are formed in the substrate 10 material to assist the structure in withstanding hydrostatic liquid supply pressures that may reach 100 psi or more.

A drop charging apparatus 200 is schematically indicated in FIG. 2 as being located adjacent the break-off point for the plurality of streams 110. Drops are charged by inducing charge on each stream by the application of a voltage to an induction electrode near to each stream. When a drop breaks off the induced charge is "trapped" on the drop. Variation of break-off length causes the local induction electric field to be different stream-to-stream, causing a variation in drop charging for a given applied voltage. This charge variation, in turn, results in different amounts of deflection in a subsequent electrostatic deflection zone used to differentiate between deposited and guttered drops. Even in the case wherein no drop charging is used or no electrostatic deflection is used, the varying break-off points lead to differing amounts of drop-to-drop aerodynamic and Coulomb interaction forces that lead to varying flight trajectories and hence, to drop placement errors at the deposition target.

The variations in drop trajectory caused by varying break-off times are highly undesirable for traditional continuous drop emitter systems wherein the stimulation energy cannot be controlled on a jet-by-jet basis. However, the inventors of the present inventions have realized that, with individual jet stimulation control, these heretofore undesirable drop interaction and charging anomalies may be used to advantage to compensate or counteract other sources of drop trajectory and charging errors. Jet break-off time adjustments may be used especially to compensate for charging apparatus set-up and fabrication difficulties as well as to reduce image or pattern dependent inter-drop charge coupling.

Figure 3A:
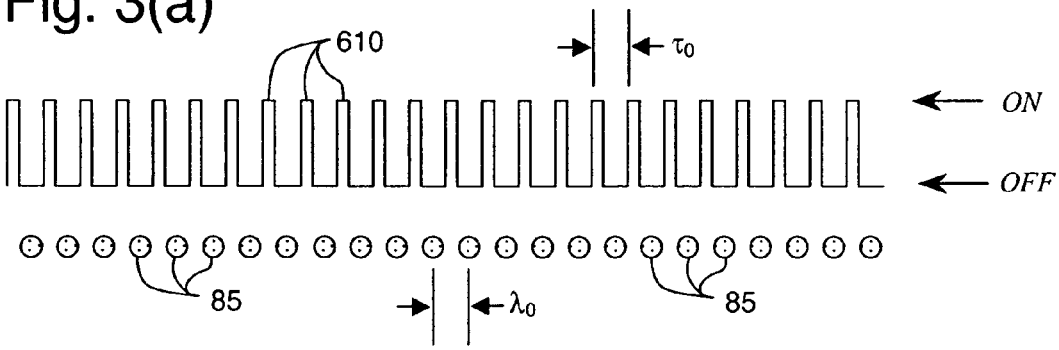
FIGS. 3(*a*), 3(*b*) and 3(*c*) illustrate electrical and thermal pulse sequences and the resulting stream break-up into drops of predetermined volumes according to the present inventions.
Figure 3B:
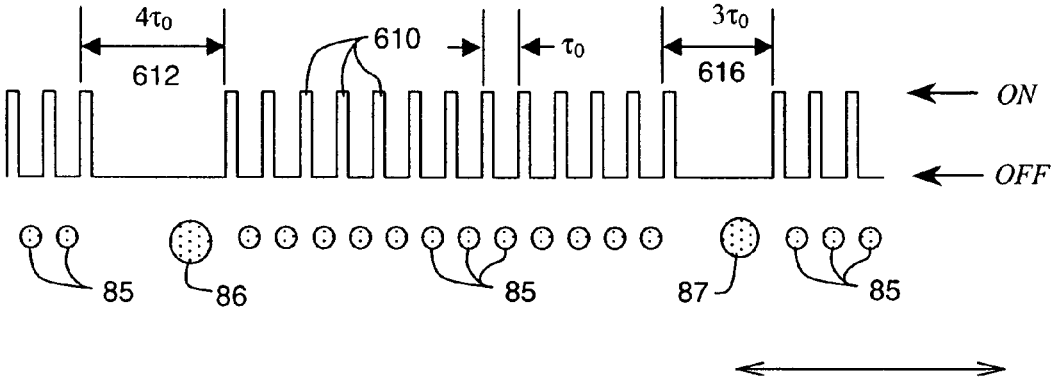
Figure 3C:
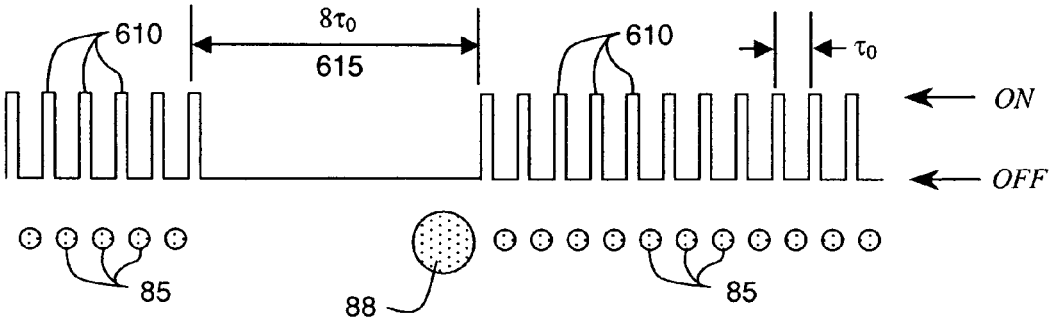

The above discussion of jet break-up into stream of drops of predetermined volume has used the illustration in FIG. 1(*b*) and FIG. 2 of mono-sized drops of volume, $V_0$, that result from the application of synchronizing sequence of pulses of uniform energy and repetition period, $\tau_0$. However, thermal pulse synchronization of the break-up of continuous liquid jets is known to provide the capability of generating streams of drops of predetermined volumes wherein some drops may be formed having integer, m, multiple volumes, $mV_0$, of a unit volume, $V_0$. See for example U.S. Pat. No. 6,588,888 to Jeanmaire, et al. and assigned to the assignee of the present inventions. FIGS. 3(*a*)-3(*c*) illustrate thermal stimulation of a continuous stream by several different sequences of electrical energy pulses. The energy pulse sequences are represented schematically as turning a heater resistor "on" and "off" at during unit periods, $\tau_0$.

In FIG. 3(*a*) the stimulation pulse sequence consists of a train of unit period pulses 610. A continuous jet stream stimulated by this pulse train is caused to break up into drops 85 all of volume $V_0$, spaced in time by $\tau_0$ and spaced along their flight path by $\lambda_0$. The energy pulse train illustrated in FIG. 3(*b*) consists of unit period pulses 610 plus the deletion of some pulses creating a $4\tau_0$ time period for sub-sequence 612 and a $3\tau_0$ time period for sub-sequence 616. The deletion of stimulation pulses causes the fluid in the jet to collect into drops of volumes consistent with these longer that unit time periods. That is, sub-sequence 612 results in the break-off of a drop 86 having volume $4V_0$ and sub-sequence 616 results in a drop 87 of volume $3V_0$. FIG. 3(*c*) illustrates a pulse train having a sub-sequence of period $8\tau_0$ generating a drop 88 of volume $8V_0$.

The capability of producing drops in multiple units of the unit volume $V_0$ may be used to advantage in a break-off control apparatus and method according to the present inventions by providing a means of "tagging" the break-off event with a differently-sized drop or a predetermined pattern of drops of different volumes. That is, drop volume may be used in analogous fashion to patterns of charged and uncharged drops to assist in the measurement of drop stream characteristics. Drop sensing apparatus may be provided capable of distinguishing between unit volume and integer multiple volume drops. The thermal stimulation pulse sequences applied to each jet of a plurality of jets can have thermal pulse sub-sequences that create predetermined patterns of drop volumes for a specific jet that is being measured whereby other jets receive a sequence of only unit period pulses.

The phrase "streams of drops of predetermined volumes" will be used herein to encompass this broader utilization of jet stimulation to create drops of both unit volume and integer multiples of the unit volume.

Figure 4A:
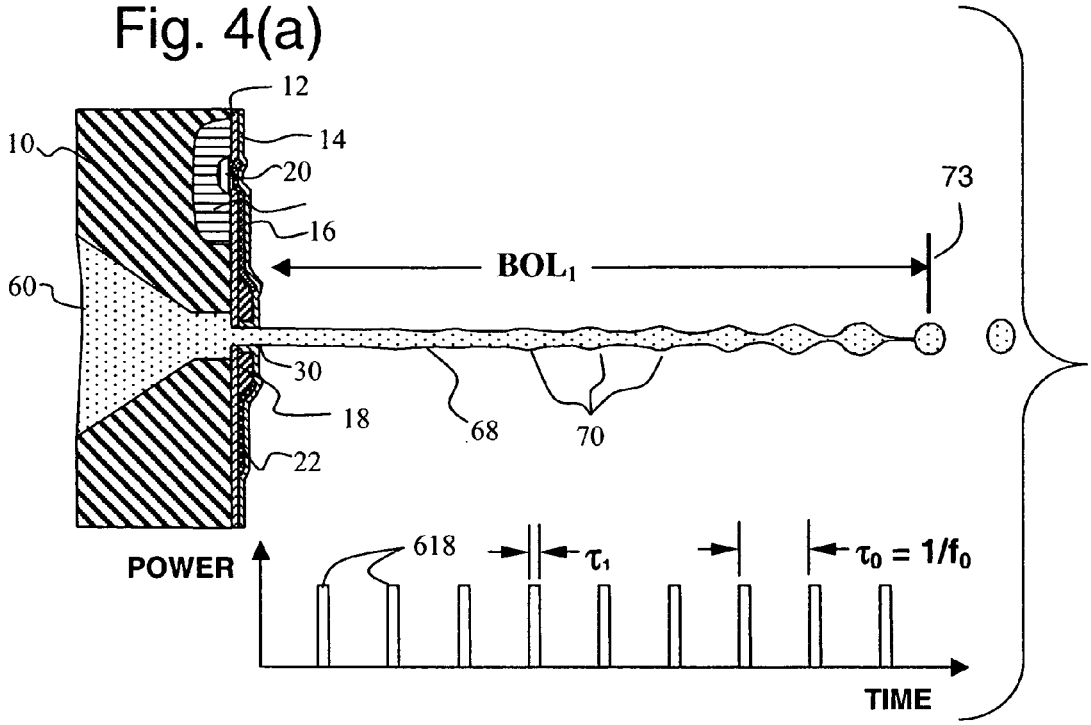
FIGS. 4(*a*) and 4(*b*) are side view illustrations of a continuous liquid stream undergoing thermally stimulated break up into drops of predetermined volumes and further illustrating sequences of electrical and thermal pulses that cause the stimulated break-up according to the present inventions.
Figure 4B:
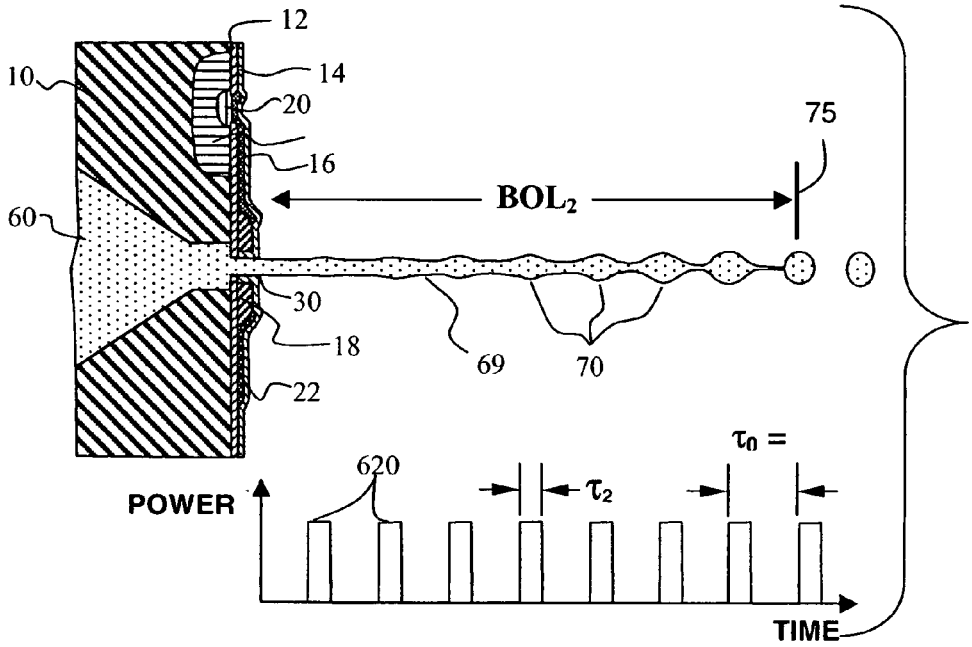

An illustration of the operation of the break-off time control apparatus and methods of the present inventions is shown in FIGS. 4(*a*) and 4(*b*). FIG. 4(*a*) illustrates a first jet 68 among a plurality of jets in a multi-jet liquid drop emitter having a first break-off length $BOL_1$ 73 due to the application by a jet stimulation apparatus of a thermal pulse sequence having energy pulses 618 of a pulse width, $\tau_1$.

In FIG. 4(*b*) the break-off time control apparatus and methods of the present inventions apply to a second continuous fluid stream 69 a second sequence of thermal stimulation pulses 620 of wider pulse width, $\tau_2$, raising the stimulation energy and causing the shorter break-off length $BOL_2$ 75. As will be explained further below, the BOT or BOL value for a given jet will be determined by measuring the behavior of each of the stream of drops of predetermined volumes in order to detect certain undesirable conditions and then calculate a break-off time setting signal that instructs the jet stimulation apparatus to apply a stimulation energy pulse sequence tailored to optimize the performance of each jet. The break-off length control apparatus and methods of the present inventions will result in applying a plurality of different and predetermined values of stimulation pulse energies for the plurality of jets in a liquid drop emission system unless the jet-by-jet behavior is identical for the characteristic performance values tested and calculated.

Figure 5:
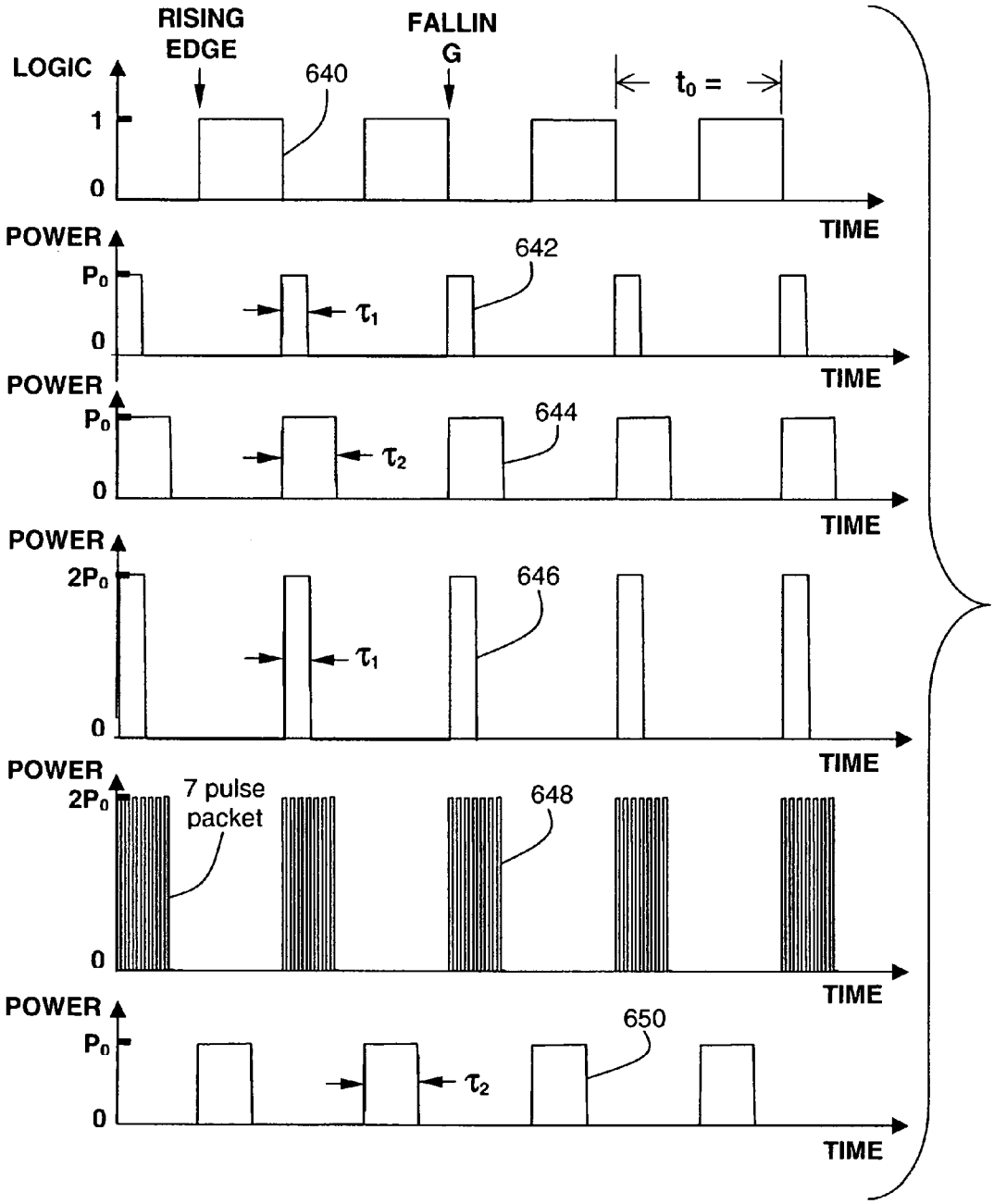
FIG. 5 illustrates a drop emission system clock signal and several energy pulse sequences that result in break-off times and lengths according to the present inventions.

The present inventions operate to cause a plurality of break-off times by providing for the capability of providing different stimulation pulse sequences to different jets, each of which is configured with an individual stimulation transducer, for example, a fluid heater. FIG. 5 illustrates several alternatives for how the control electronics of the present inventions may be operated to this end. An overall drop emission system clock 640 provides a common timing signal having drop generation period, $\tau_0$, for all jets. The stimulation transducers of individual jets may then be supplied with different amounts of energy per drop generation period by varying the power, the pulse period, both power and pulse period, or forming pulse packets of different numbers of energy pulses. For example by changing pulse width at constant power, energy pulse sequence 642 in FIG. 5 applies approximately half of the energy as compared to energy pulse sequence 644, resulting in the BOL difference illustrated in FIG. 4, i.e. $\tau_2=2\tau_1$. Alternatively, energy pulse sequence 646 supplies twice the energy of energy pulse sequence 642 by doubling the power while keeping a same pulse width, $\tau_1$.

Example energy pulse sequence 648 composes the stimulation energy as packets of different numbers of energy sub-pulses, 7 in the FIG. 5 example. Using this approach some jets might be stimulated, for example, with energy pulses composed of 5 sub-pulses, another jet by 6 sub-pulses and vet another jet by 8 sub-pulses.

There are many ways that will be known to those skilled in the art to implement the application of a plurality of energy pulse sequences to a plurality of individual stimulation transducers. The several approaches illustrated in FIG. 5 may be combined or supplemented by yet other techniques including time delay circuitry, opening and closing gating circuitry, look-up tables, counters and the like. For the purposes of the present inventions it is only necessary that apparatus be provided wherein the energy applied to the stimulation transducers of different jets may be predetermined by response to a signal, digital value, address, count, level, latched datum or the like that is representative of the break-off time that produces the desired optimization of the performance of each of the plurality of streams of drops of predetermined volumes.

Energy pulse sequence 650 in FIG. 5 illustrates another intended embodiment of the present inventions in that break-off time may be finely adjusted to vary in phase relative to the overall drop emission system clock 640. The break-off phase (BOP) of a jet stimulated by energy pulse sequence 644 will be approximately one-half drop period ($\frac{1}{2}\tau_0$) time-shifted relative to a jet stimulated by energy pulse sequence 650. That is, energy pulse sequence 644 is triggered by the falling logic edge of drop emission clock 640 and energy pulse sequence 650, having the same energy per pulse, is triggered by the rising logic edge of drop emission clock 640. Multiple phase choices may be generated from the drop emission clock signal by well known clock division techniques. For the purposes of the present inventions, operating at a plurality of break-off phase values (BOP's) relative to the drop emission system clock is also comprehended under the term "plurality of break-off times".

The break-off lengths (BOL's) of jets having identical physical characteristics, and stimulated with the same amount of pulse energy, will be equal for phase shifted pulse sequences, however the moment of break-off will be shifted relative to a reference time provided by a drop emission system clock.

Application of stimulation energy in the form of a sequence of energy pulses, as illustrated in FIG. 5 is advantageous for a digital implementation of the present inventions. However, it is also feasible and within the scope of the present inventions to transfer energy in the form of an analog waveform, such as a pure sine wave or a waveform having several harmonic components. Waveforms that transfer different amounts of energy to different jets in order to achieve a plurality of break-off times may be created, for example, by having gain-adjustable amplifier circuits for each jet, controllable shunting circuits per jet, and the like. Break-off time phasing may be adjusted using energy waveforms, for example, by implementing a controllable time delay circuit for each jet.

Figure 6:
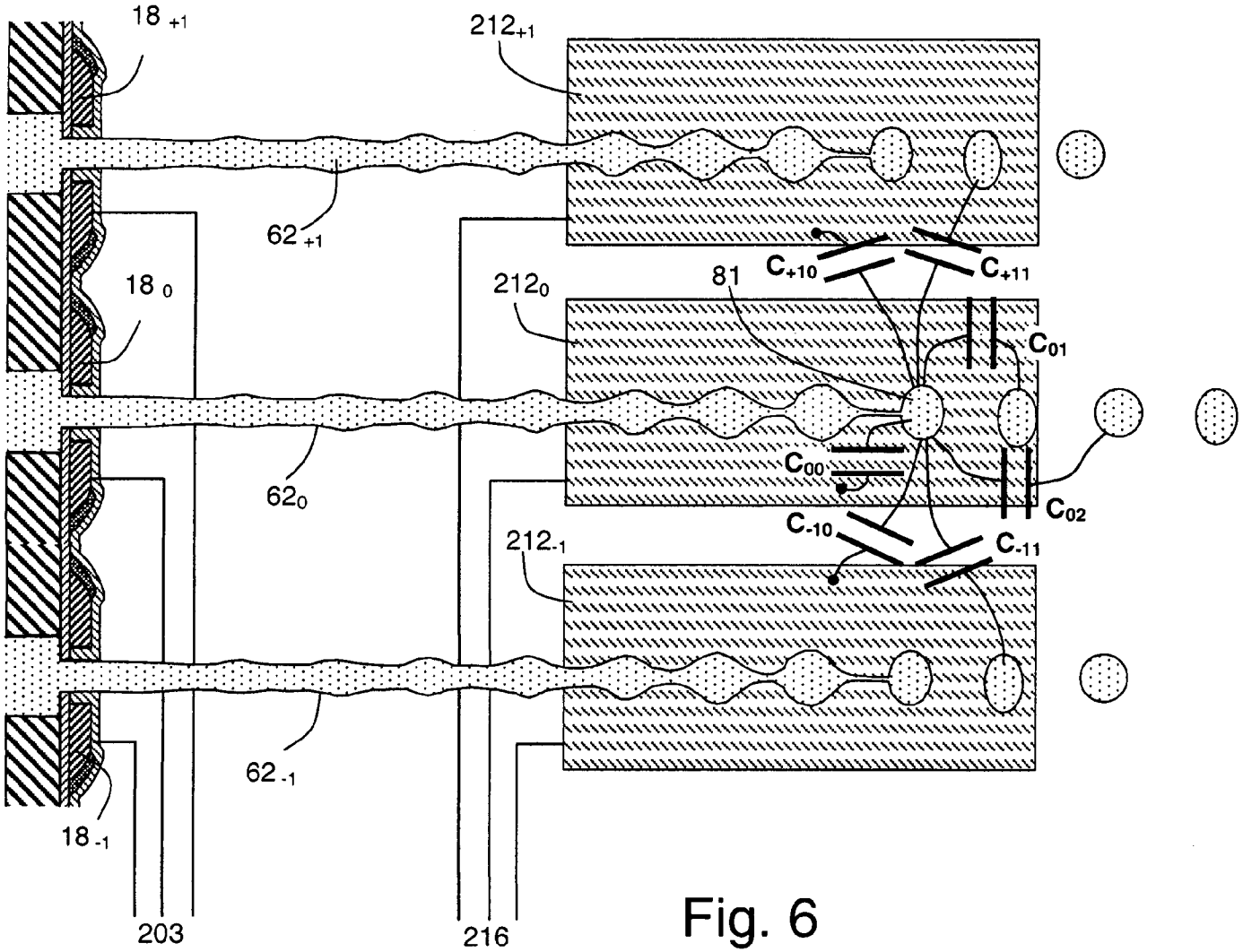
FIG. 6 illustrates the capacitive coupling fields that influence inductive drop charging for one situation of fluid stream break-off times.

FIG. 6 illustrates schematically in top plan view drop charging electrode 212 geometry that is common for high resolution, high throughput continuous ink jet printing or liquid patterning drop emission systems. Three liquid streams 62 are illustrated breaking up into drops of predetermined volumes over respective rectangular electrodes. Drops are charged by applying a charging voltage to each charge electrode via charging leads 216. The jetted fluid must be sufficiently conductive that induced charge may flow to the tip of the breaking fluid column well within the time frame of an individual drop formation, $\tau_0$. The charging voltage is held steady during the final stream necking down and drop separation process, thereby trapping induced charge on the flying drop.

Ideally, the induced charge would be established only by the voltage applied to the charging electrode and the subsequent primary charging electric field thereby linked with each fluid stream. However, because of the very close spacing that is desirable and necessary for high resolution ink jet printing and liquid patterning and the close spacing, $\lambda_0$, of drops in each stream of detached drops, many other secondary electric-fields may be of sufficient magnitude to affect the charge induced on each detaching drop. Several drop charging field effects are illustrated in FIG. 6 with respect to the center drop stream labeled $\mathbf{62}_0$, by use of a capacitance symbol linking the drop being formed 81 on stream $\mathbf{62}_0$ with other drops of this stream, the associated charge electrodes $\mathbf{212}_j$ and the closest detached drops from nearest neighboring streams.

The labeling convention of the capacitances in FIG. 6 is $C_{sd}$ where "s" labels which stream the linking element is associated with and "d" labels which drop of that stream, wherein the label "0" denotes a charging electrode. Thus the capacitances $C_{00}$, $C_{+10}$, and $C_{-10}$, indicate the primary charging electrode field and the two secondary electric fields linking to the center breaking off drop 81 from the adjacent charging electrodes. Capacitances $C_{01}$, $C_{02}$, $C_{+11}$, and $C_{-11}$ indicate secondary electric field coupling from previously charged nearby drops to the center breaking off drop 81.

The many linking secondary electric fields, other than the primary one denoted as $C_{00}$, are problematic for continuous drop emission systems because they introduce "extraneous" data-dependent charging effects to the induced charge on every drop. Drop charge is the principal determiner of the amount of deflection a drop will experience in a subsequent Coulomb force deflection apparatus. The extraneous charge effects cause anomalies both for drops being deflected and collected in a gutter, as well as for drops flying to the print media or pattern receiving surface. Many complex schemes have been attempted to compensate for the charging effects of secondary electric fields, primarily by algorithms that calculate an expected induced charge amount from these sources and then modifying the primary charge electrode voltage accordingly. These compensation approaches involve high speed numerical calculations that add significant cost and complexity to the data path of a high speed, high resolution continuous liquid drop emission system.

Figure 7:
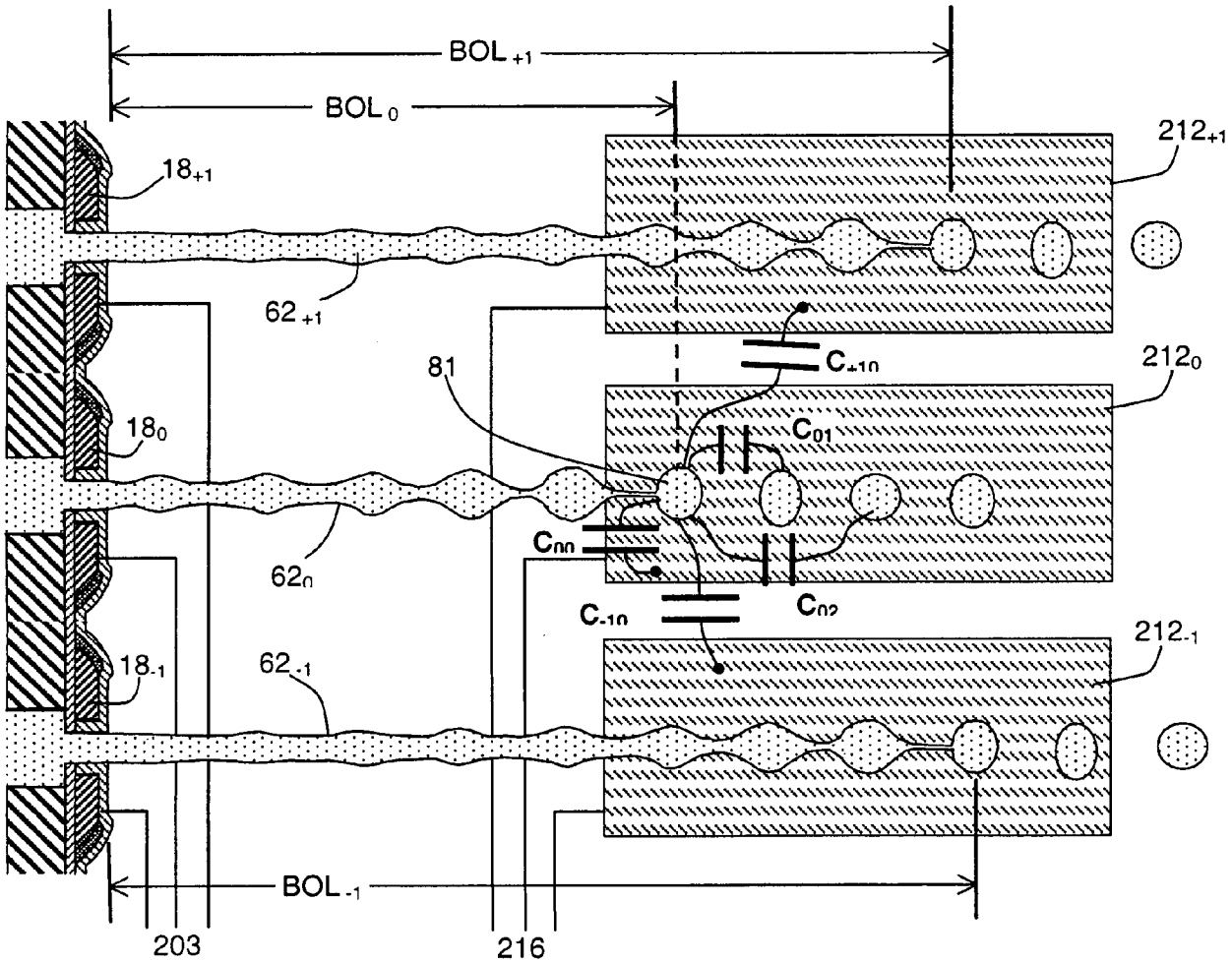
FIG. 7 illustrates the capacitive coupling fields that influence inductive drop charging for a plurality of fluid stream break-off times according to the present inventions.

The present inventions provide an alternative approach to reducing or eliminating the secondary charging field effects by operating adjacent jet at different predetermined break-off times, thereby introducing spatial and temporal separation between the charging of a given drop and nearby electrodes and charged drops. FIG. 7 illustrates an embodiment of the present inventions wherein the break-off time of the central stream $62_0$ in FIG. 6 has been shortened relative to the two adjacent streams $62_{-1}$ and $62_{+1}$. The shortening of the central stream has the effect of reducing the secondary electric field linkage to charged drops of neighboring streams, indicated by the removal of the $C_{+11}$ and $C_{-11}$ terms. Depending on the geometry of the charging electrodes, this manipulation of the break-off times may also reduce the electric field linkage to the adjacent charge electrodes $C_{+10}$ and $C_{-10}$ as well if amount of nearby electrode conductor is substantially reduced as is illustrated by comparing the position of breaking drop 81 to the adjacent electrode structures for FIGS. 5 and 6.

Further reduction in adjacent charge electrode field coupling may be realized by altering the break-off phase of the central stream relative to the adjacent streams as well as the energy of the stimulation pulse sequences. That is, if the energy pulse sequence applied to the central stream $62_0$ is represented by sequence 650 in FIG. 5 and the energy pulse sequences applied to adjacent streams $62_{+1}$ and $62_{-1}$ are represented by sequence 642 in FIG. 5, then the drop break-off time for the central jet drop 81 will be both sooner and out of time phase with the breaking off of drops from the adjacent streams. The charging voltage signal may be applied to the adjacent jets at a different portion of the drop time period $\tau_0$, than during the final formation of drop 81, thereby eliminating the data dependent effects of signals on the adjacent electrodes. The use of individual stimulation transducers and a plurality of pre-determined break-off times for the plurality of jets allow for a non-data dependent approach to reducing drop charging from secondary field sources and is an important novel feature of the present inventions.

Figure 8:
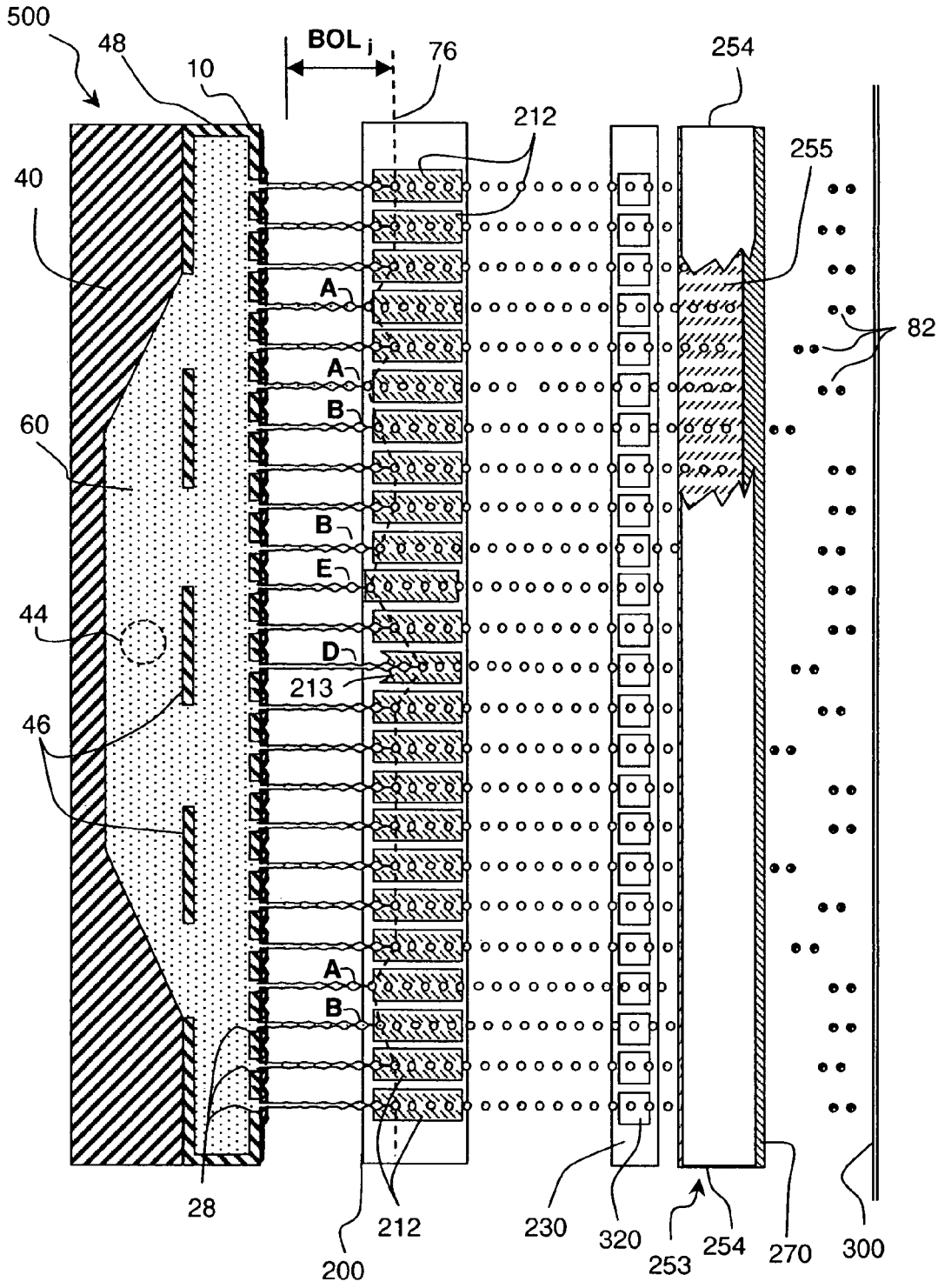
FIG. 8 illustrates the operation of an array of continuous fluid streams at a plurality of break-off times according to the present inventions.

FIG. 8 illustrates in top plan view the operation of a multi-jet drop emission apparatus according to the present inventions. A plurality of break-off times are being applied to the plurality of jets resulting in a plurality of visible break of lengths indicated by dotted line 76. For simplicity of the illustration, only a few different BOL's are drawn. Most liquid streams have a break-off length that extends approximately $1\frac{1}{2}\lambda_0$ over the edge of the charging electrodes 212 nearest the nozzle plane of the drop emitter. However, several jets have shorter break-off lengths indicated by the labels "A", "B" or "E". These streams are receiving higher energy stimulation pulses than the majority of streams.

The break-off locations for these streams labeled "A", "B", and "E" have been retreated to the fringing field region of the respective charging electrodes to provide compensation for charging efficiency differences for these jets over the majority of jets. Charging efficiency differences may arise from a variety of causes, primarily different distances to the corresponding jet, electrode manufacturing tolerances, and accumulated ink and other residues that alter the charging electric field geometry of one stream break-off region relative to another. The amount of drop charge induced for a given applied charge electrode voltage may thus be fine-tuned by controlling, on an individual jet basis the position of the break-off point in the charge electrode field pattern.

One stream in FIG. 8, labeled "D" is illustrated as having a longer break-off length than the majority BOL position. Also sketched for this stream is a charging electrode 213 having a missing portion of the nozzle end of charging electrode 213. In the case the apparatus and methods of the present inventions are operating to lengthen the break-off time by reducing the stimulation pulse energy so as to position the break-off point over an intact portion of charge electrode 213. The use of individual stimulation transducers and a plurality of pre-determined break-off times for the plurality of jets allows the compensation of charging electrode efficiency differences among the plurality of jets and is an important novel feature of the present inventions.

The drop emission system illustrated in FIG. 8 also shows an electric field deflection apparatus 253 in break-away view. A deflection electric field $E_d$ is established between ground plane plate 255 and upper high voltage plate 254. A drop with charge $q_0$ is subjected to a Coulomb force $F_C=q_oE_d$ oriented in an upward direction (towards the viewer). In this example system uncharged drops are captured by gutter lip 270 and charged drops are "lifted" above the gutter by the Coulomb force so that they fly to the receiver surface 300. Pairs of charged drops 82 are shown flying past the gutter towards the receiver 300 and all other drops are being captured by gutter 270.

Figure 9:
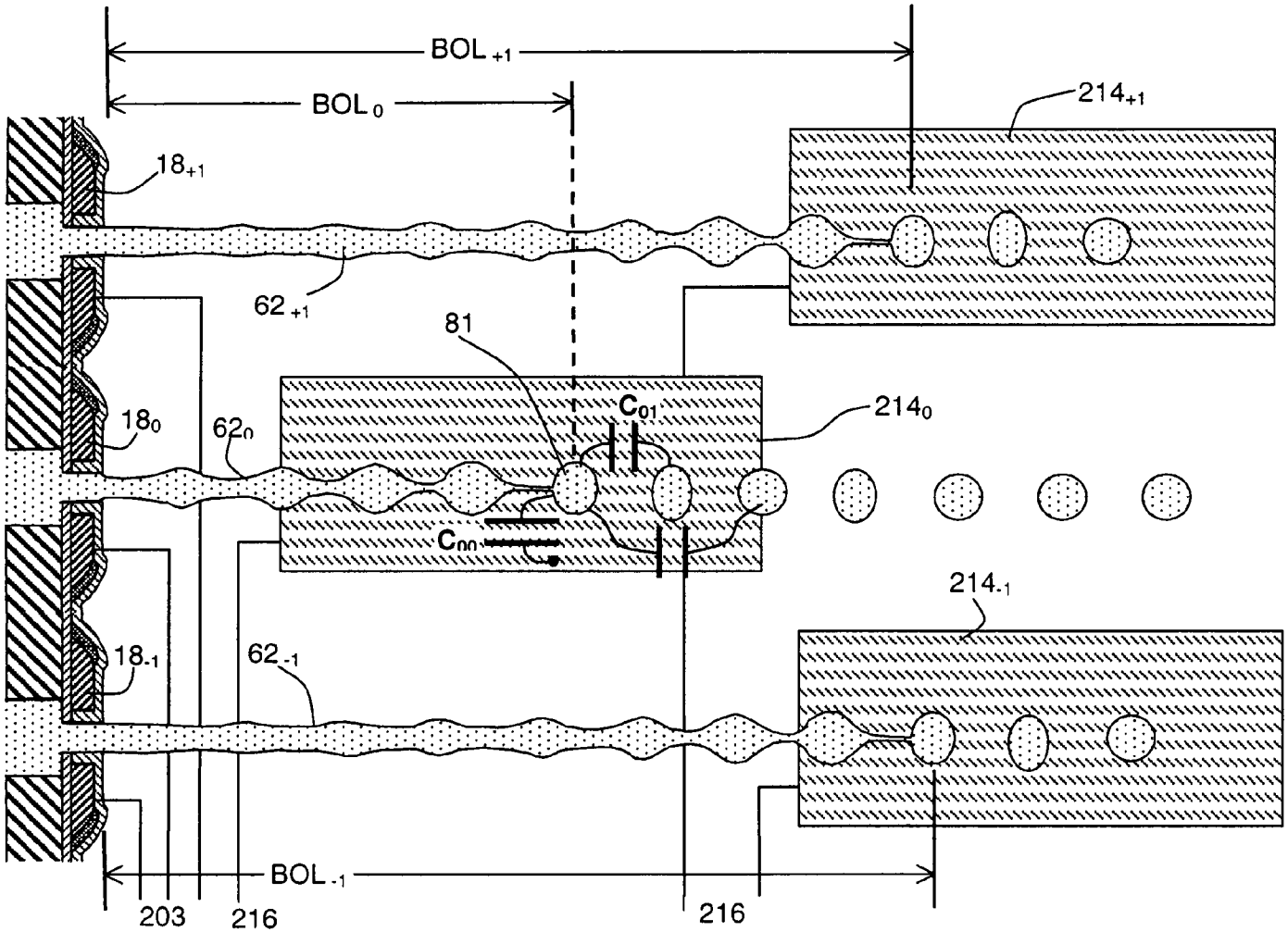
FIG. 9 illustrates the capacitive coupling fields that influence inductive drop charging for a plurality of fluid stream break-off times corresponding to a staggered arrangement of charging electrodes according to the present inventions.
Figure 10:
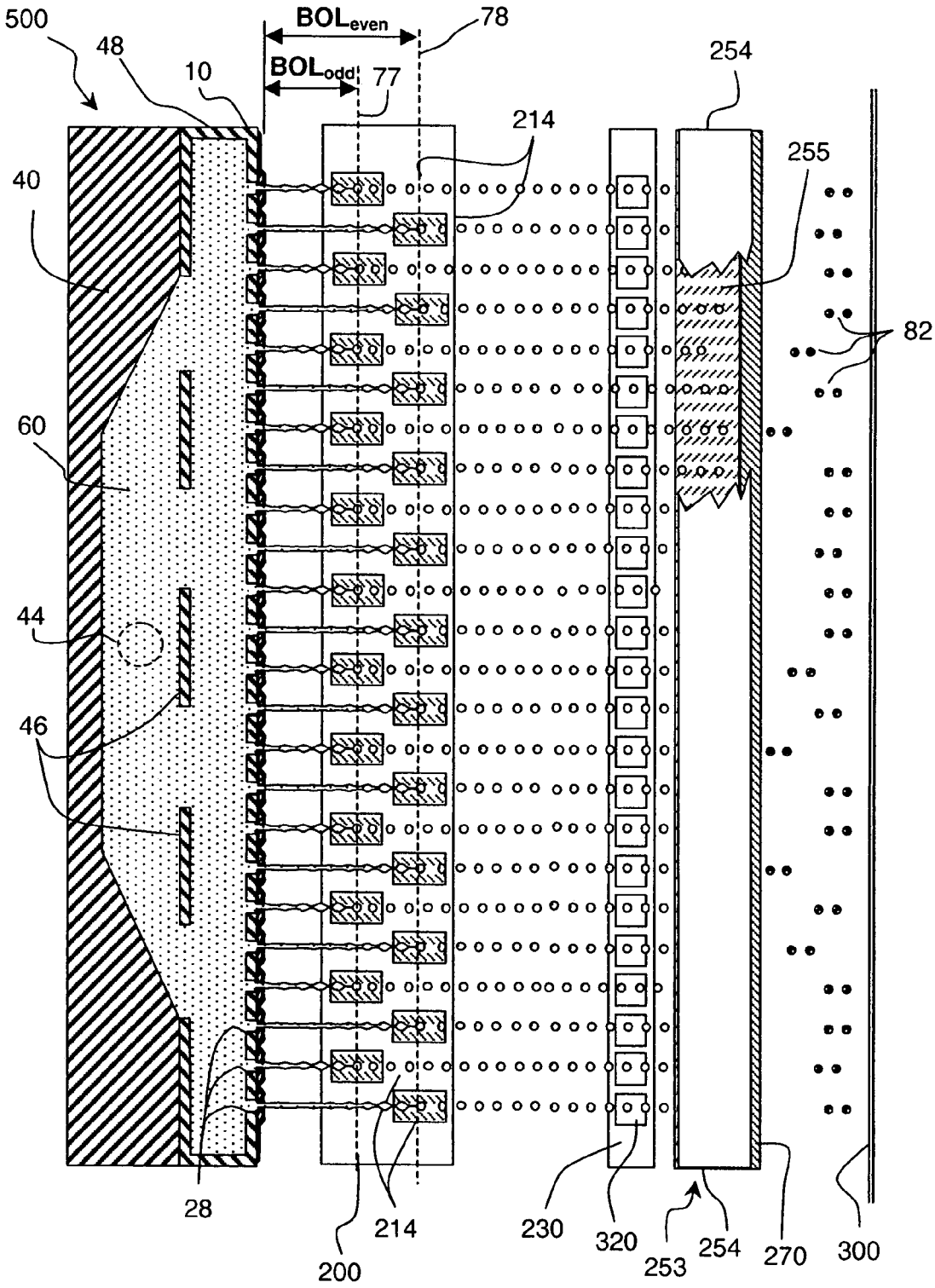
FIG. 10 illustrates the operation of an array of continuous fluid streams at two break-off times in correspondence to a staggered arrangement of drop charging electrodes according to the present inventions.

FIG. 9 illustrates a further embodiment of the present inventions wherein the charging electrode apparatus has been constructed to gain further advantage from the capability of operating using a plurality of break-off times. Individual charging electrodes 214 are off set from one another in the direction of fluid stream emission in a staggered pattern. Then, by also staggering the break-off times to align the break-off point over respective charging electrodes, the secondary field coupling to adjacent jets may be largely eliminated. FIG. 10 illustrates in top plan view the operation of a multi-jet drop emission apparatus using the techniques illustrated in FIG. 9, according to the present inventions. Two break-off times, one for "odd" numbered jets and a second for "even" numbered jets. The odd streams are receiving higher energy stimulation pulses than the even fluid streams, thereby breaking off with a shorter BOL.

The techniques illustrated by FIGS. 7, 8, 9 and 10 may all be combined in a single drop emission apparatus and operating method. That is, the charging electrodes may be physically staggered by a plurality of distances from the nozzle common member, and the break-off times selected to nominally position the break-off point over each staggered electrode and then further adjusted to compensate for charging electrode efficiency differences and modified in phase and position to further reduce secondary charging field effects. The use of individual stimulation transducers and a plurality of pre-determined break-off times for the plurality of jets allows for these several desirable system improvements to be managed by the apparatus and methods of the present inventions.

Figure 11:
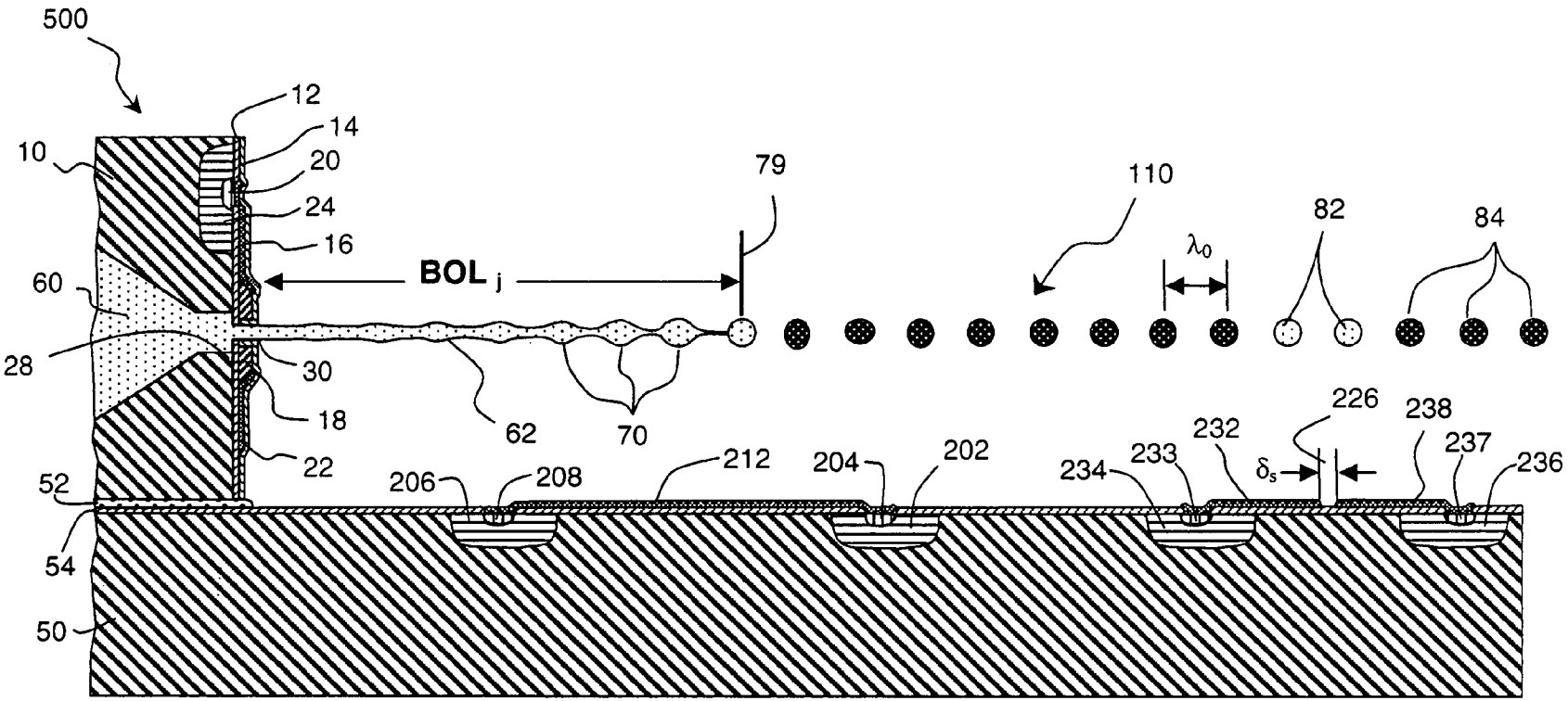
FIG. 11 is a side view illustration of a continuous liquid stream undergoing thermally stimulated break up into drops of predetermined volumes further illustrating integrated drop charging and sensing apparatus according to the present inventions.

FIG. 11 illustrates in side view a preferred embodiment of the present inventions that is constructed of a multi jet drop emitter 500 assembled to a common substrate 50 that is provided with inductive charging and electrostatic drop sensing apparatus. Only a portion of the drop emitter 500 structure is illustrated and FIG. 11 may be understood to depict one jet of a plurality of jets in multi-jet drop emitter 500. Substrate 10 is comprised of a single crystal semiconductor material, typically silicon, and has integrally formed heater resistor elements 18 and MOS power drive circuitry 24. MOS circuitry 24 includes at least a power driver circuit or transistor and is attached to resistor 18 via a buried contact region 20 and interconnection conductor run 16. A common current return conductor 22 is depicted that serves to return current from a plurality of heater resistors 18 that stimulate a plurality of jets in a multi-jet array. Alternately a current return conductor lead could be provided for each heater resistor. Layers 12 and 14 are electrical and chemical passivation layers.

The drop emitter functional elements illustrated herein may be constructed using well known microelectronic fabrication methods. Fabrication techniques especially relevant to the CIJ stimulation heater and MOS circuitry combination utilized in the present inventions are described in U.S. Pat. Nos. 6,450,619; 6,474,794; and 6,491,385 to Anagnostopoulos, et al., assigned to the assignees of the present inventions.

Substrate 50 is comprised of either a single crystal semiconductor material or a microelectronics grade material capable of supporting epitaxy or thin film semiconductor MOS circuit fabrication. An inductive drop charging apparatus in integrated in substrate 50 comprising charging electrode 212, buried MOS circuitry 206, 202 and contacts 208, 204. The integrated MOS circuitry includes at least amplification circuitry with slew rate capability suitable for inductive drop charging within the period of individual drop formation, $\tau_0$. While not illustrated in the side view of FIG. 11, the inductive charging apparatus is configured to have an individual electrode and MOS circuit capability for each jet of multi-jet liquid drop emitter 500 so that the charging of individual drops within individual streams may be accomplished.

Integrated drop sensing apparatus comprises a dual electrode structure depicted as dual electrodes 232 and 238 having a gap $\delta_s$ therebetween along the direction of drop flight. The dual electrode gap $\delta_s$ is designed to be less that a drop wavelength $\lambda_0$ to assure that drop arrival times may be discriminated with accuracies better than a drop period, $\tau_0$. Integrated sensing apparatus MOS circuitry 234, 236 is connected to the dual electrodes via connection contacts 233, 237. The integrated MOS circuitry comprises at least differential amplification circuitry capable of detecting above the noise the small voltage changes induced in electrodes 232, 238 by the passage of charged drops 84. In FIG. 11 a pair of uncharged drops 82 is detected by the absence of a two-drop voltage signal pattern within the stream of charged drops.

The charged drop sensor apparatus is also capable of detecting charge amplitude as well as the passage of a charged drop. Electrostatic charged drop detectors are known in the prior art: for example, see U.S. Pat. No. 3,886,564 to Naylor, et al. and U.S. Pat. No. 6,435,645 to M. Falinski.

Layer 54 is a chemical and electrical passivation layer. Substrate 50 is assembled and bonded to drop emitter 500 via adhesive layer 52 so that the drop charging and sensing apparatus are properly aligned with the plurality of drop streams.

Figure 12:
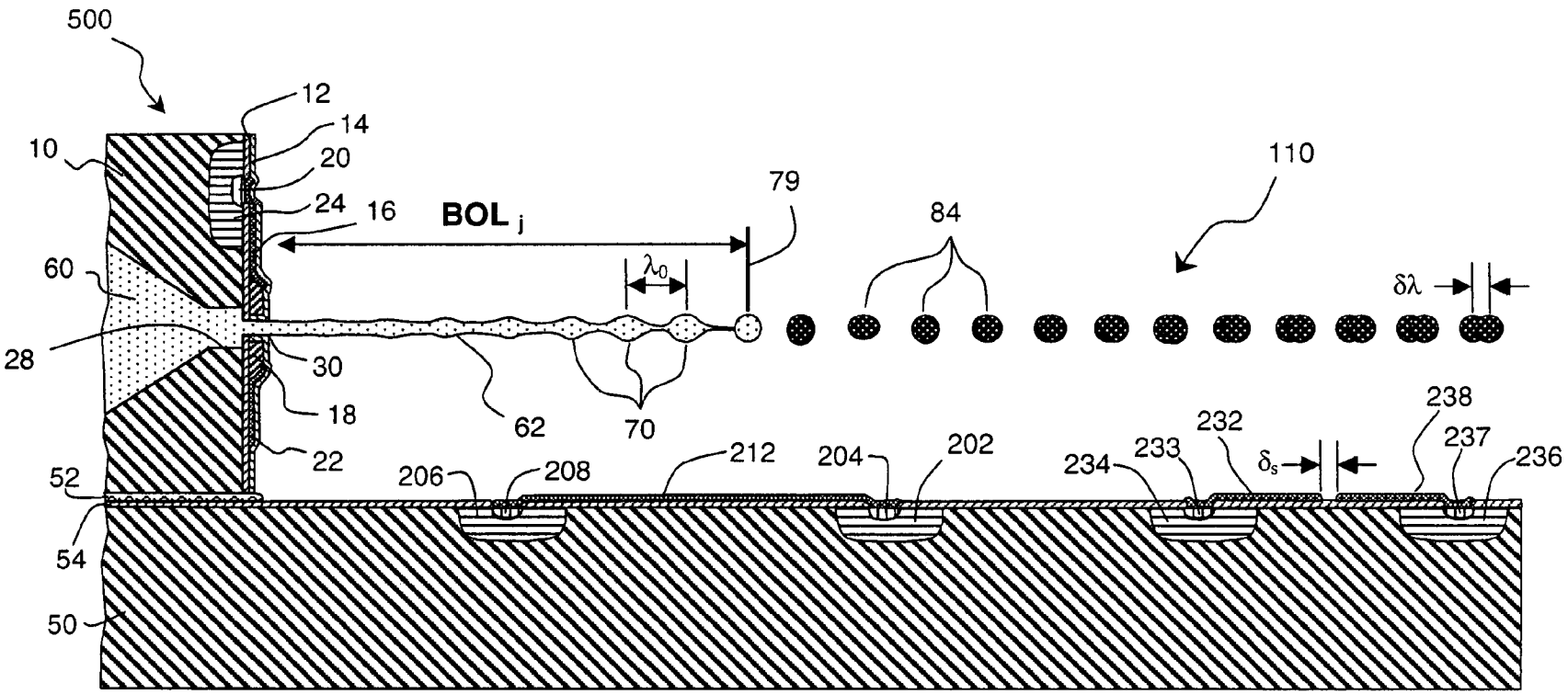
FIG. 12 is a side view illustration of a continuous liquid stream undergoing thermally stimulated break up into drops of predetermined volumes further illustrating a characteristic of the drop stream according to the present inventions.

FIG. 12 illustrates the same drop emitter 500 set-up as is shown in FIG. 11. However, instead of measuring the pattern of two uncharged drops described with respect to FIG. 11, in FIG. 12 all drops 84 are charged and the arrival time or the time between adjacent drop arrivals is sensed in order to measure a characteristic of the stream 110. FIG. 12 depicts the positions of the drops the stream of drops as having some spread or deviation in wavelength, $\delta\lambda$, that becomes more apparent as the stream is examined father from break-off point 78. It is observed with synchronized continuous streams that the break-off time or length becomes noisy about a mean value as the stimulation energy is reduced. When a stream is viewed using stroboscopic illumination pulsed at the synchronization frequency, $f_0$, this noise is apparent in the "fuzziness" of the drop images, termed drop jitter. If the stimulation intensity is increased, the break-off length shortens and the drop jitter reduces. Thus drop jitter is related to the BOL and BOT.

FIG. 12 depicts a break-off time control apparatus and method wherein the deviation in the period of drop arrival times, or the real-time wavelength, is measured as a characteristic of the stream of drops that relates directly to the break-off time of the stream. For example, the frequency content of the signal produced by the dual electrode sensing apparatus as charged drops pass over sensor gap $\delta_s$ may be analyzed for the width, $\delta_f$, of the frequency peak at the stimulation frequency, $f_0$, i.e. the so-called frequency jitter. The break-off time may then be calculated or found in a look-up table of experimentally calibrated results relating frequency jitter, $\delta_f$, to stimulation intensity and thereby, break-off time. Break-off phase (BOP) may also be detected by referencing to a drop emission system clock signal.

One advantage of sensing frequency jitter (wavelength deviation) in order to calculate break-off length or time is that this measure may be performed without singling out a drop or a pattern of drops by either charging or by deflection along two pathways. All drops being generated may be charged identically and deflected to a gutter for collection and recirculation while making the break-off parameter calibration measurement. A common and constant voltage may be applied to all jets for this measurement provided the sensing apparatus has a sensor per jet. This may be useful for the situation wherein a jet has an excessively long break-off length extending to the outer edge of the charging electrode 212, or even somewhat beyond it, causing poor drop charging. The frequency jitter measurement may be made using highly sensitive phase locked loop noise discrimination circuitry locked to the stimulation frequency even if reduced drop charge levels have degraded the signal detected by sensing electrodes 232, 238.

Figure 13:
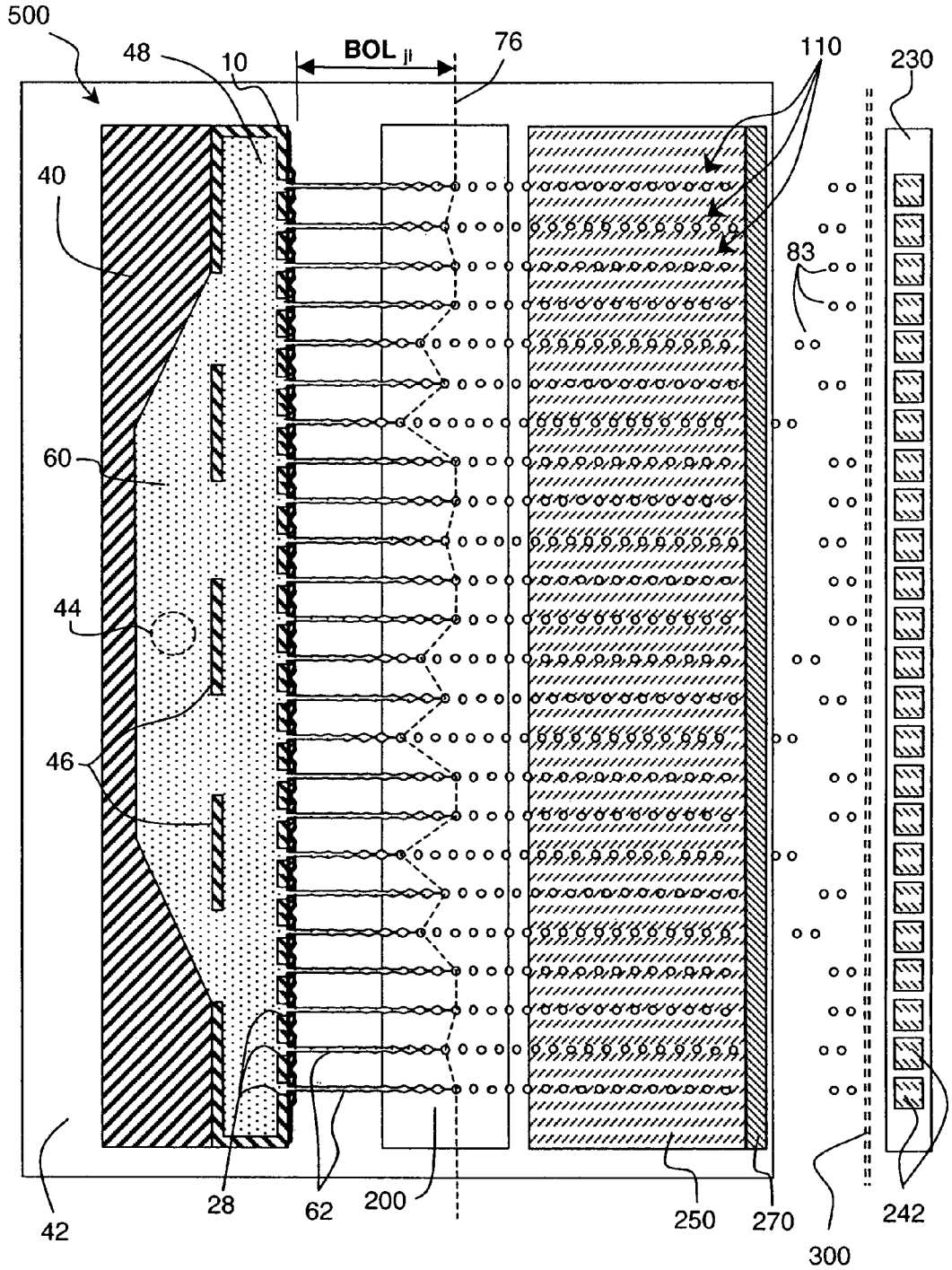
FIG. 13 is a top side view illustration of a liquid drop emitter system having a plurality of liquid streams having a plurality of break-off times and having drop charging, sensing, deflection and gutter drop collection apparatus according to the present inventions.

FIG. 13 illustrates another of the preferred embodiments of the present inventions wherein the drop sensing apparatus 242 is positioned behind the receiver plane location 300 shown in phantom lines. A sensor in this position relieves the contention for space in the region between the liquid drop emitter 500 and gutter 270. As a practical matter it is desirable that the receiver plane 300 be as close to the drop emitter 500 nozzle face as possible given the need for space for break-off lengths, inductive charging apparatus, drop deflection apparatus, drop guttering apparatus, and drop sensing apparatus. Drops emitted from different nozzles within a plurality of nozzles will not have precisely identical initial trajectories, i.e., will not have identical firing directions. The differences among firing directions therefore lead to an accumulation of spatial differences as the drops move farther and farther from the nozzle. Such spatial dispersion is another source of drop misplacement at the receiver location. Minimizing the nozzle-to-receiver plane distance, commonly termed the "throw distance", minimizes the drop placement errors arising from jet-to-jet firing direction non-uniformity.

Also depicted in FIG. 13 is a Coulomb force deflection apparatus 253 comprising a lower ground plane 250 that may also serve as a gutter drop landing surface. This deflection apparatus arrangement creates an electric field by means of an "image" of the charged drop, that, in turn, exerts a Coulomb force. $F_c=(q_0)^2x_d^2$, on drops having charge $q_0$ spaced away a distance $x_d$ from the surface of ground plane 250. A gutter 270 is arranged to capture charged, deflected drops. Uncharged drops 83 are undeflected by the Coulomb force and fly above the lip of gutter 270 to the receiver plane 300.

A pattern of two uncharged drops 83 is used to make a measurement of arrival time from the break-off point for each stream. This measurement may then be used to characterize each stream and then calculate the break-off times, $BOT_j$. Alternatively, other patterns of charged and uncharged drops, including a single uncharged drop, may be used to sense and determine a stream characteristic related to break-off time.

The various component apparatus of the liquid drop emission system are not intended to be shown to relative distance scale in FIG. 13. In practice a Coulomb deflection apparatus such as the ground plane type 250 illustrated, would be much longer relative to typical stream break-off lengths and charging apparatus in order to develop enough off axis movement to be captures at least by the lip of gutter 270.

Sensing apparatus 230 is illustrated having individual sensor sites 242, one per jet of the plurality of jets 110. Because the sensor is located behind the receiver location plane, it may only sense drops that follow a printing trajectory rather than a guttering trajectory. A variety of physical mechanisms could be used to construct sensor sites 242. If uncharged drops are used for printing or depositing the pattern at the receiver location then it is usefully to detect drops optically. If charged drops are used to print, then the sensor sites might also be based on electrostatic effects. Alternatively, sensing apparatus 230 could be positioned so that drops impact sensor sites 242. In this case physical mechanisms responsive to pressure, such as piezoelectric or electrostrictive transducers, are useful.

FIG. 13 may also be used to understand some alternate embodiments of the present inventions in which a characteristic value for each of the plurality of streams is measured "off-line" and stored in a memory. For these embodiments a drop emitter test sensor apparatus is used in a set-up procedure to measure the characteristic values of the plurality of streams of drops of predetermined volumes before the liquid drop emission system is provided to end users or during an off-line calibration procedure in the field. For this procedure, a test drop sensor 230 may be placed in a position as shown in FIG. 13 or at the intended receiver surface plane 300. Alternatively, the drop emitter unit 500 is mounted in a special test apparatus that positions it properly with respect to a test drop sensor 230.

Several types of sensing apparatus and drop stream characteristic values are discussed herein in the context of the "on-line" sensor embodiments that have drop sensing apparatus incorporated into the continuous liquid drop emission apparatus. All of these sensor types and characteristic values may be similarly used and measured by an off-line test set-up using analogous procedures that provide characteristic values for each stream. The stream characteristic values are then stored in a stream memory apparatus for later on-line use by the control apparatus of the continuous liquid drop emitter.

Further it is also within the scope of the present inventions to have a continuous liquid drop emission apparatus that has both stream memory apparatus for storing stream characteristic values that have been measured off-line as well as incorporated drop sensing apparatus to measure additional stream characteristic values or to update stored stream characteristic values.

Figure 14:
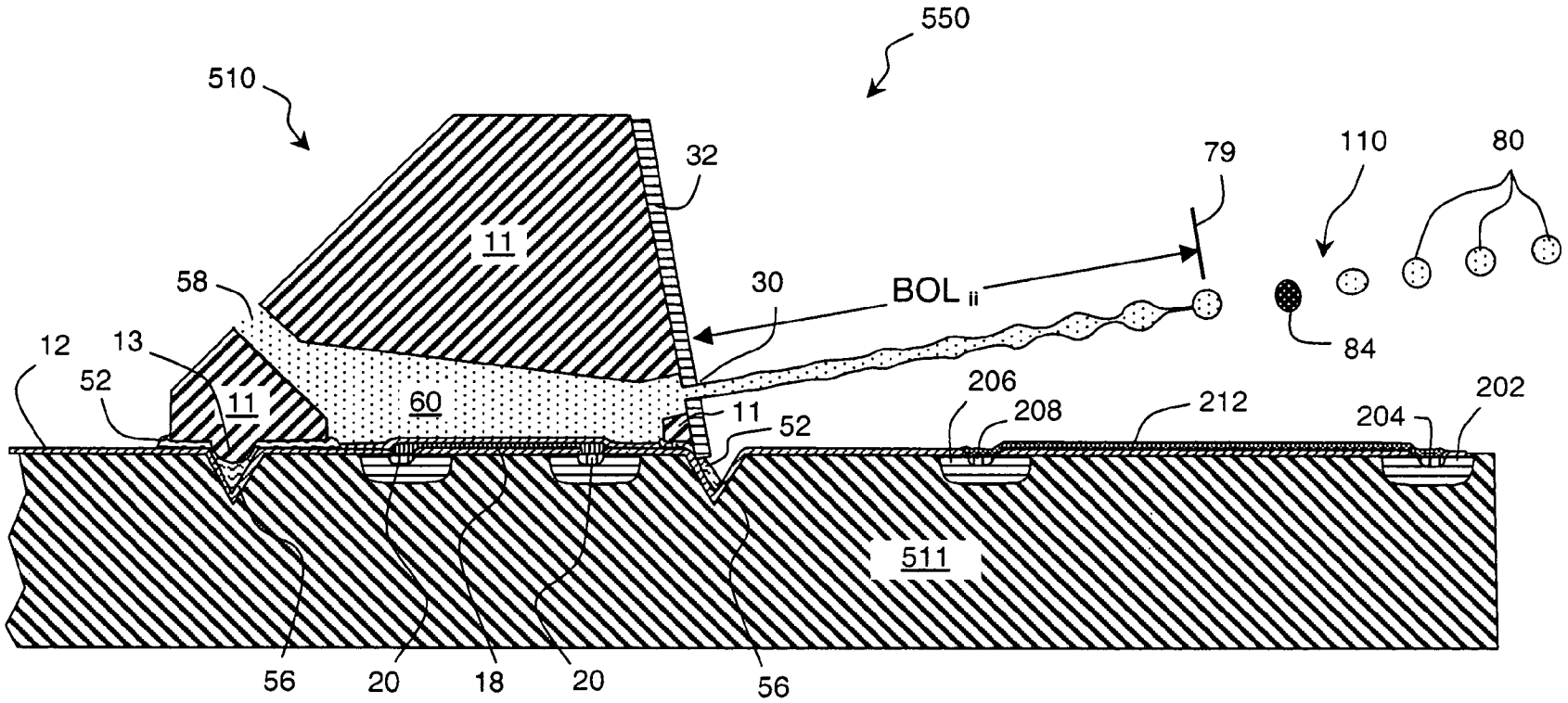
FIG. 14 is a side view illustration of an edgeshooter style liquid drop emitter undergoing thermally stimulated break up into drops of predetermined volumes further illustrating integrated resistive heater and drop charging apparatus according to the present inventions.

FIG. 14 illustrates in side view an alternate embodiment of the present inventions wherein the drop emitter 510 is constructed in similar fashion to a thermal ink jet edgeshooter style printhead. Drop emitter 510 is formed by bonding a semiconductor substrate 511 to a pressurized liquid supply chamber and flow separation member 11. Supply chamber member 11 is fitted with a nozzle plate 32 having a plurality of nozzles 30. Alignment groove 56 is etched into substrate 511 to assist in the location of the components forming the upper and lower portions of the liquid flow path, i.e. substrate 511, chamber member 11 and nozzle plate 32. Chamber member 11 is formed with a chamber mating feature 13 that engages alignment groove 56. A bonding and sealing material 52 completes the space containing high pressure liquid 60 supplied to nozzle 30 via a flow separation region 28 (shown below in FIG. 15) bounded on one side by heater resistor 18.

In contrast to the configuration of the drop emitter 500 illustrated in FIG. 13, drop emitter 510 does not jet the pressurized liquid from an orifice formed in or on substrate 511 but rather from an nozzle 30 in nozzle plate 32 oriented nearly perpendicular to substrate 511. Resistive heater 18 heats pressurized fluid only along one wall of a flow separation passageway 28 prior to the jet formation at nozzle 30. While somewhat more distant from the point of jet formation than for the drop emitter 500 of FIG. 13, the arrangement of beater resistor 18 as illustrated in FIG. 14 is still quite effective in providing thermal stimulation sufficient for jet break-up synchronization.

The edgeshooter drop emitter 510 configuration is useful in that the integration of inductive charging apparatus and resistive heater apparatus may be achieved in a single semiconductor substrate as illustrated. The elements of the resistive heater apparatus and inductive charging apparatus in FIG. 14 have been given like identification label numbers as the corresponding elements illustrated and described in connection with above FIG. 11. The description of these elements is the same for the edgeshooter configuration drop emitter 510 as was explained above with respect to the drop emitter 500.

The direct integration of drop charging and thermal stimulation functions assures that there is excellent alignment of these functions for individual jets. Additional circuitry may be integrated to perform jet stimulation and drop charging addressing for each jet, thereby greatly reducing the need for bulky and expensive electrical interconnections for multi jet drop emitters having hundreds or thousands jets per emitter head.

Figure 15:
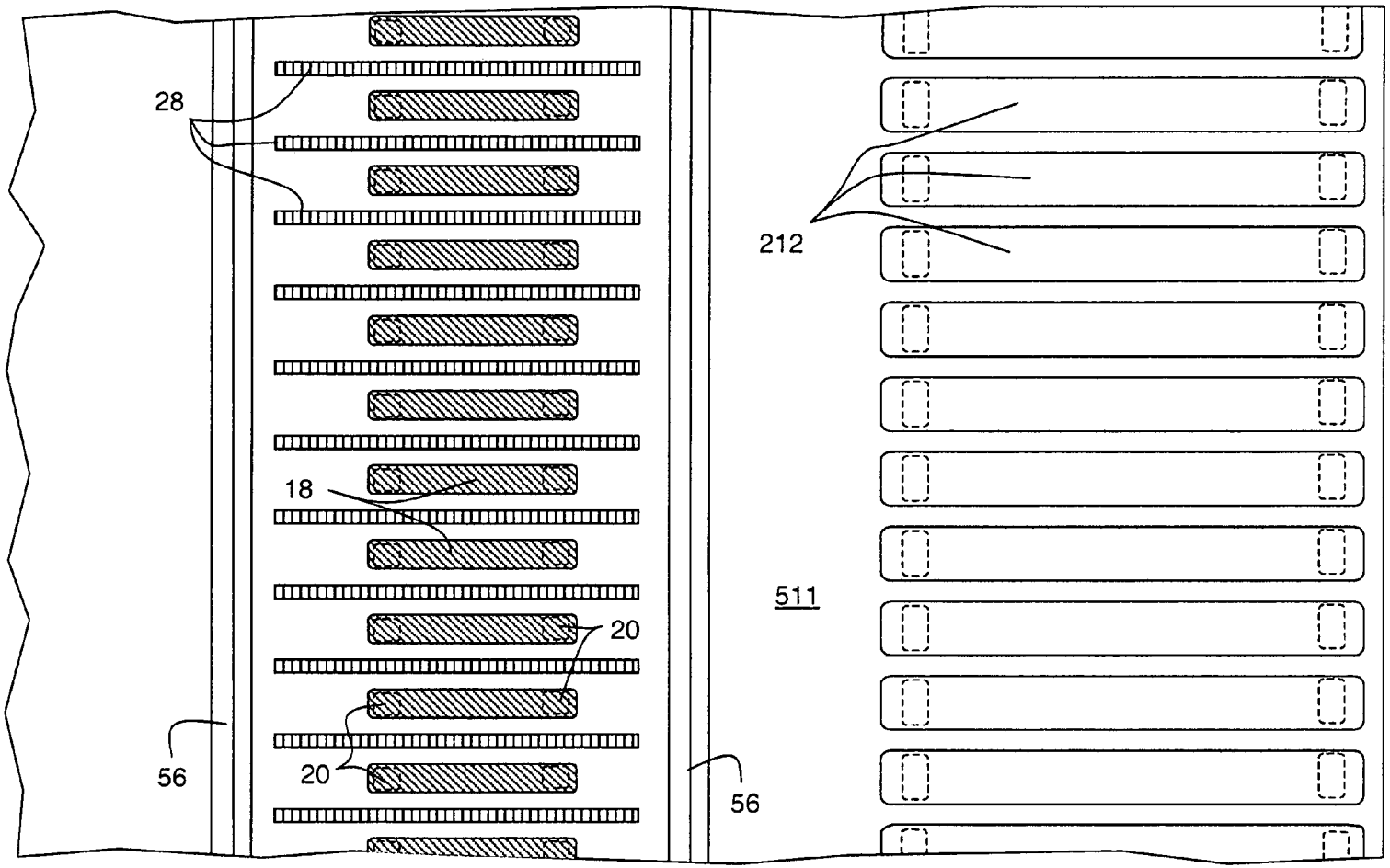
FIG. 15 is a plan view of part of the integrated heater and drop charger per jet array apparatus.

FIG. 15 illustrates in plan view a portion of semiconductor substrate 511 further illuminating the layout of fluid heaters 18, flow separation walls 28 and drop charging electrodes 212. The flow separation walls 28 are illustrated as being formed on substrate 511, for example using a thick photopatternable material such as polyimide, resist, or epoxy. However, the function of separating flow to a plurality of regions over heater resistors may also be provided as features of the flow separation and chamber member 11, in yet another component layer, or via some combination of these components. Drop charging electrodes 212 are aligned with heaters 18 in a one-for-one relationship achieved by precision microelectronic photolithography methods. The linear extent of drop charging electrodes 212 is typically designed to be sufficient to accommodate some range of jet break-off lengths and still effectively couple a charging electric field to its individual jet. However, in some embodiments to be discussed below, shortened drop charging electrodes are used assist in break-off length measurement.

Figure 16A:
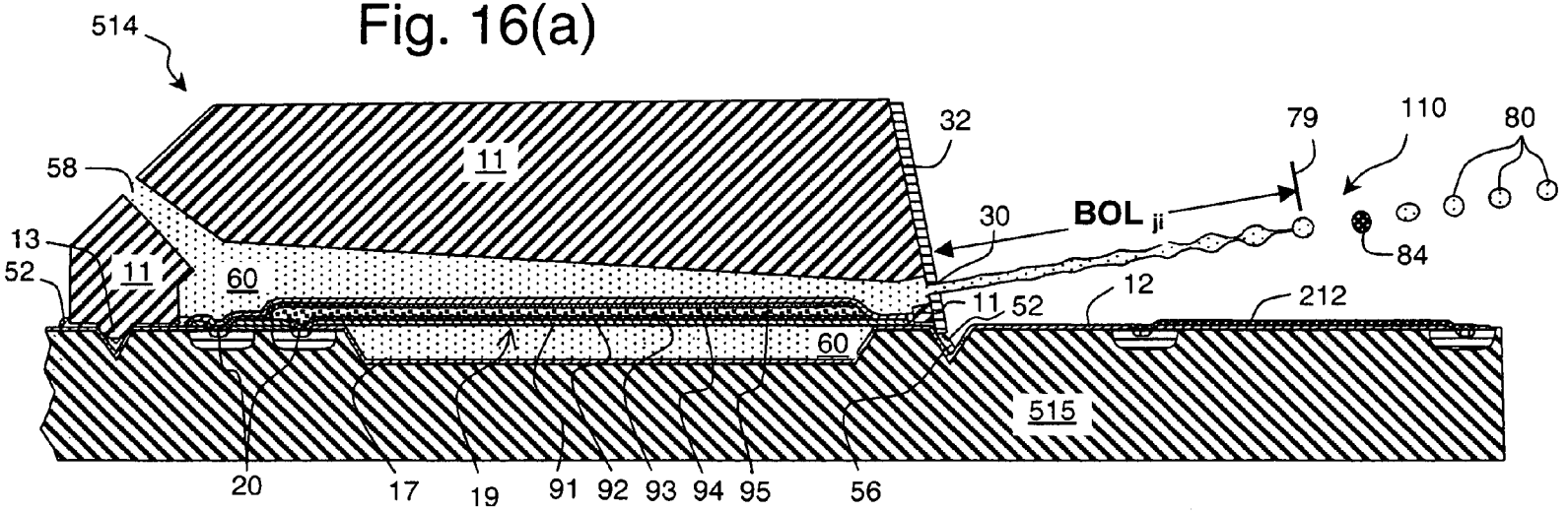
FIGS. 16(*a*) and 16(*b*) are side view illustrations of an edgeshooter style liquid drop emitter having an electromechanical stimulator for each jet.
Figure 16B:
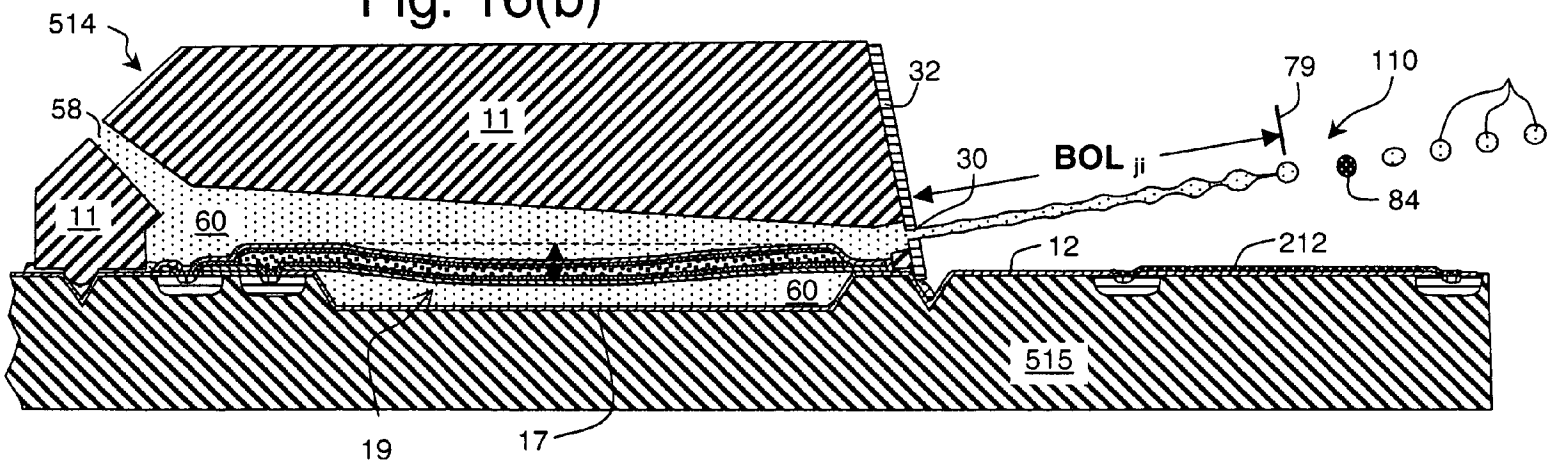
Figure 18A:
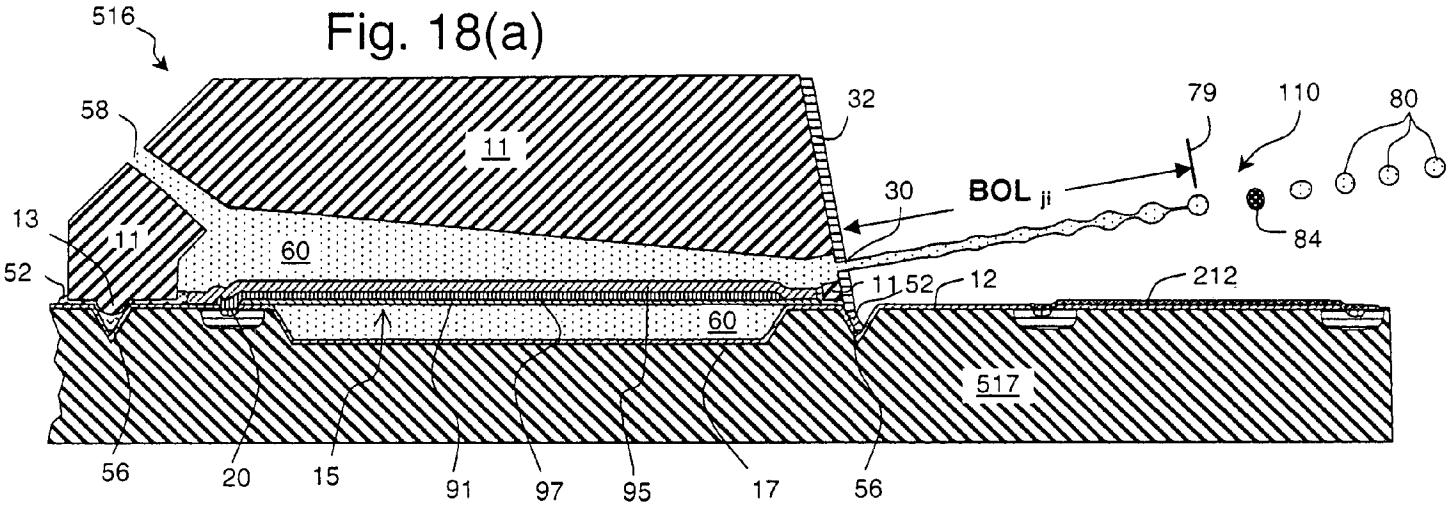
FIGS. 18(*a*) and 18(*b*) are side view illustrations of an edgeshooter style liquid drop emitter having a thermomechanical stimulator for each jet.
Figure 18B:
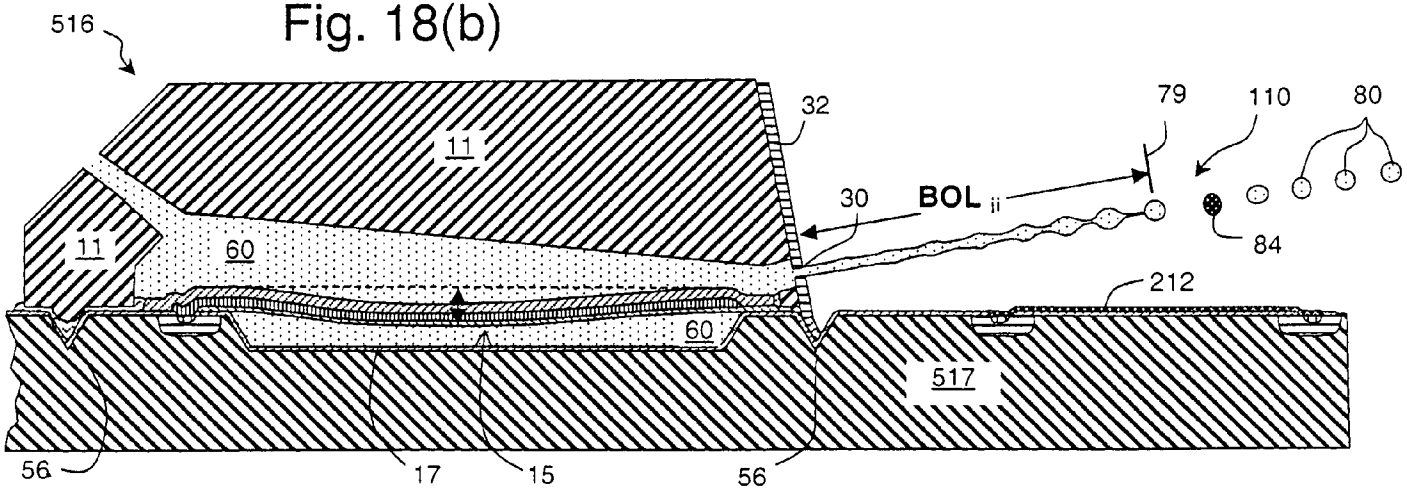

FIGS. 16(*a*) through 19 illustrate alternative embodiments of the present inventions wherein micromechanical transducers are employed to introduce Rayleigh stimulation energy to jets on an individual basis. The micromechanical transducers illustrated operate according to two different physical phenomena; however they all function to transduce electrical energy into mechanical motion. The mechanical motion is facilitated by forming each transducer over a cavity so that a flexing and vibrating motion is possible. FIGS. 16(*a*), 16(*b*) and 17 show jet stimulation apparatus based on electromechanical materials that are piezoelectric, ferroelectric or electrostrictive. FIGS. 18(*a*), 18(*b*) and 19 show jet stimulation apparatus based on thermomechanical materials having high coefficients of thermal expansion.

FIGS. 16(*a*) and 16(*b*) illustrate an edgeshooter configuration drop emitter 514 having most of the same functional elements as drop emitter 512 discussed previously and shown in FIG. 14. However, instead of having a resistive heater 18 per jet for stimulating a jet by fluid heating, drop emitter 512 has a plurality of electromechanical beam transducers 19. Semiconductor substrate 515 is formed using microelectronic methods, including the deposition and patterning of an electroactive (piezoelectric, ferroelectric or electrostrictive) material, for example PZT, PLZT or PMNT. Electromechanical beam 19 is a multilayered structure having an electroactive material 92 sandwiched between conducting layers 92, 94 that are, in turn, protected by passivation layers 91, 95 that protect these layers from electrical and chemical interaction with the working fluid 60 of the drop emitter 514. The passivation layers 91, 95 are formed of dielectric materials having a substantial Young's modulus so that these layers act to restore the beam to a rest shape.

A transducer movement cavity 17 is formed beneath each electromechanical beam 19 in substrate 515 to permit the vibration of the beam. In the illustrated configuration, working fluid 60 is allowed to surround the electromechanical beam so that the beam moves against working fluid both above and below its rest position (FIG. 16(*a*)), as illustrated by the arrow in FIG. 16(*b*). An electric field is applied across the electroactive material 93 via conductors above 94 and beneath 92 it and that are connected to underlying MOS circuitry in substrate 511 via contacts 20. When a voltage pulse is applied across electroactive material layer 93, the length changes, causing electromechanical beam 19 to bow up or down. Dielectric passivation layers 91, 95 surrounding the conductor 92, 94 and electroactive material 93 layers act to restore the beam to a rest position when the electric field is removed. The dimensions and properties of the layers comprising electromechanical beam 19 may be selected to exhibit resonant vibratory behavior at the frequency desired for jet stimulation and drop generation.

Figure 17:
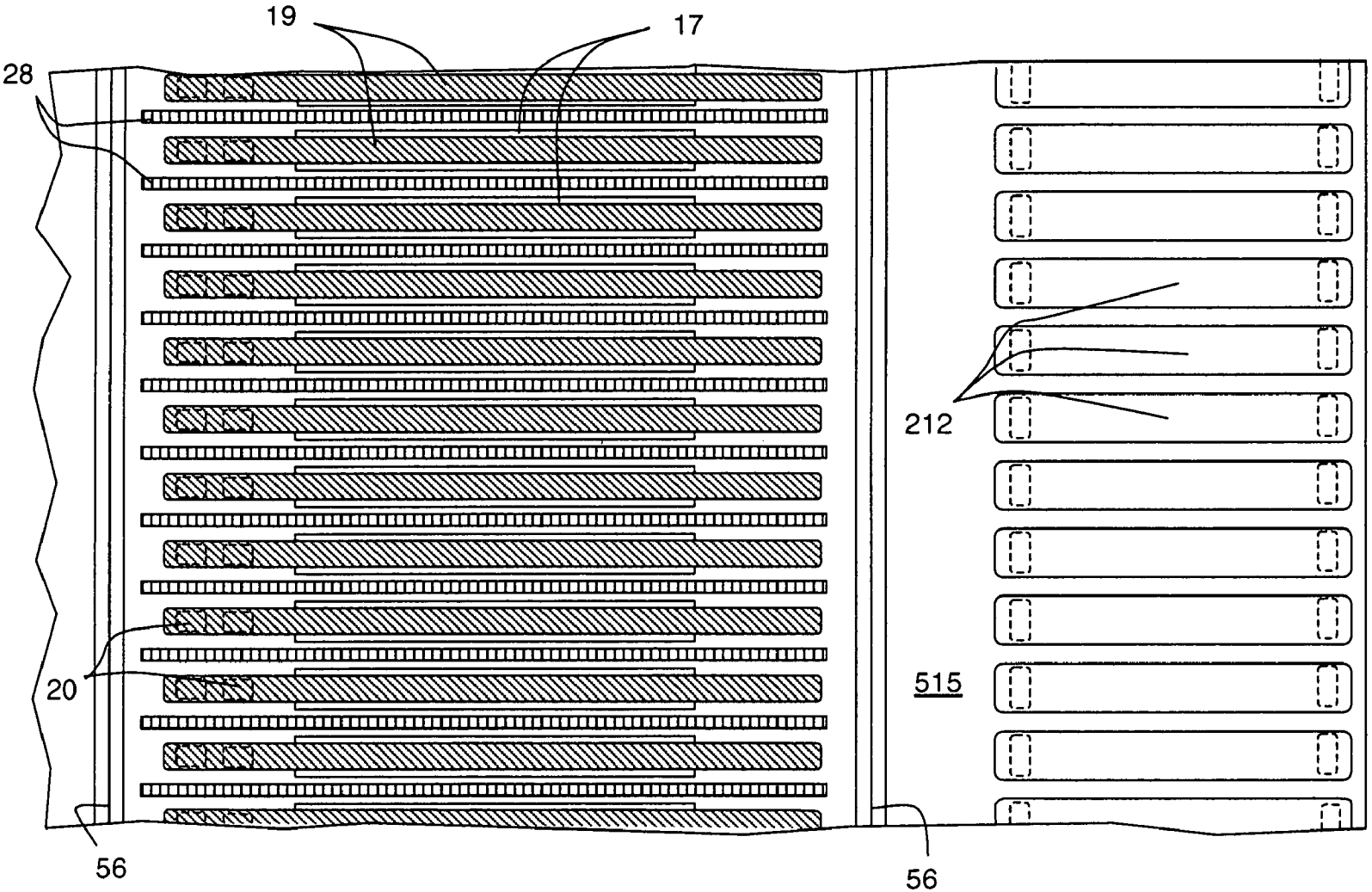
FIG. 17 is a plan view of part of the integrated electromechanical stimulator and drop charger per jet array apparatus.

FIG. 17 illustrates in plan view a portion of semiconductor substrate 515 further illuminating the layout of electromechanical beam transducers 19, flow separation walls 28 and drop charging electrodes 212. The above discussion with respect to FIG. 15, regarding the formation of flow separator walls 28 and positioning of drop charging electrodes 212, applies also to these elements present for drop emitter 514 and semiconductor substrate 515.

Transducer movement cavities 17 are indicated in FIG. 17 by rectangles which are largely obscured by electromechanical beam transducers 19. Each beam transducer 19 is illustrated to have two electrical contacts 20 shown in phantom lines. One electrical contact 20 attaches to an upper conductor layer and the other to a lower conductor layer. The central electroactive material itself is used to electrically isolate the upper conductive layer form the lower in the contact area.

FIGS. 18(*a*) and 18(*b*) illustrate an edgeshooter configuration drop emitter 516 having most of the same functional elements as drop emitter 512 discussed previously and shown in FIG. 14. However, instead of having a resistive heater 18 per jet for stimulating a jet by fluid heating, drop emitter 516 has a plurality of thermomechanical beam transducers 15. Semiconductor substrate 517 is formed using microelectronic methods, including the deposition and patterning of an electroresistive material having a high coefficient of thermal expansion, for example titanium aluminide, as is disclosed by Jarrold et al., U.S. Pat. No. 6,561,627, issued May 13, 2003, assigned to the assignee of the present inventions. Thermomechanical beam 15 is a multilayered structure having an electroresistive material 97 having a high coefficient of thermal expansion sandwiched between passivation layers 91, 95 that protect the electroresistive material layer 97 from electrical and chemical interaction with the working fluid 60 of the drop emitter 516. The passivation layers 91, 95 are formed of dielectric materials having a substantial Young's modulus so that these layers act to restore the beam to a rest shape. In the illustrated embodiment the electroresistive material is formed into a U-shaped resistor through which a current may be passed.

A transducer movement cavity 17 is formed beneath each thermomechanical beam in substrate 517 to permit the vibration of the beam. In the illustrated configuration, working fluid 60 is allowed to surround the thermomechanical beam 15 so that the beam moves against working fluid both above and below its rest position (FIG. 18(*a*)), as illustrated by the arrow in FIG. 18(*b*). An electric field is applied across the electroresistive material via conductors that are connected to underlying MOS circuitry in substrate 511 via contacts 20. When a voltage pulse is applied a current is established, the electroresistive material heats up causing its length to expand and causing the thermomechanical beam 17 to bow up or down. Dielectric passivation layers 91 and 95, surrounding the electroresistive material layer 97, act to restore the beam 15 to a rest position when the electric field is removed and the beam cools. The dimensions and properties of the layers comprising thermomechanical beam 19 may be selected to exhibit resonant vibratory behavior at the frequency desired for jet stimulation and drop generation.

Figure 19:
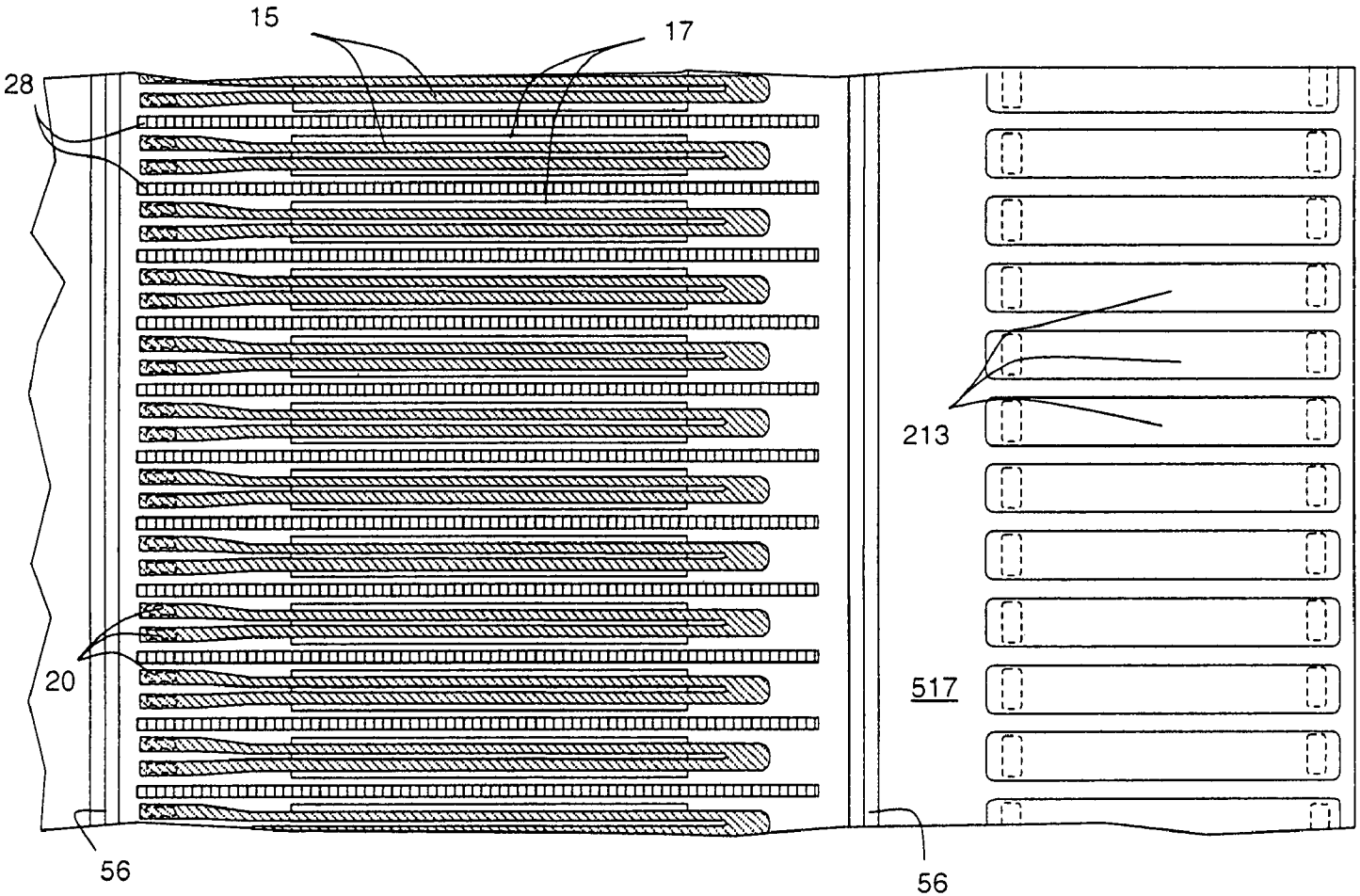
FIG. 19 is a plan view of part of the integrated thermomechanical stimulator and drop charger per jet array apparatus.

FIG. 19 illustrates in plan view a portion of semiconductor substrate 517 further illuminating the layout of thermomechanical beam transducers 15, flow separation walls 28 and drop charging electrodes 212. The above discussion with respect to FIG. 15, regarding the formation of flow separator walls 28 and positioning of drop charging electrodes 212, applies also to these elements present for drop emitter 516 and semiconductor substrate 517.

Transducer movement cavities 17 are indicated in FIG. 19 by rectangles which are largely obscured by U-shaped thermomechanical beam transducers 15. Each beam transducer 15 is illustrated to have two electrical contacts 20. While FIG. 19 illustrates a U-shape for the beam itself, in practice only the electroresistive material, for example titanium aluminide, is patterned in a U-shape by the removal of a central slot of material. Dielectric layers, for example silicon oxide, nitride or carbide, are formed above and beneath the electroresistive material layer and pattered as rectangular beam shapes without central slots. The electroresistive material itself is brought into contact with underlying MOS circuitry via contacts 20 so that voltage (current) pulses may be applied to cause individual thermomechanical beams 15 to vibrate to stimulate individual jets.

Figure 20:
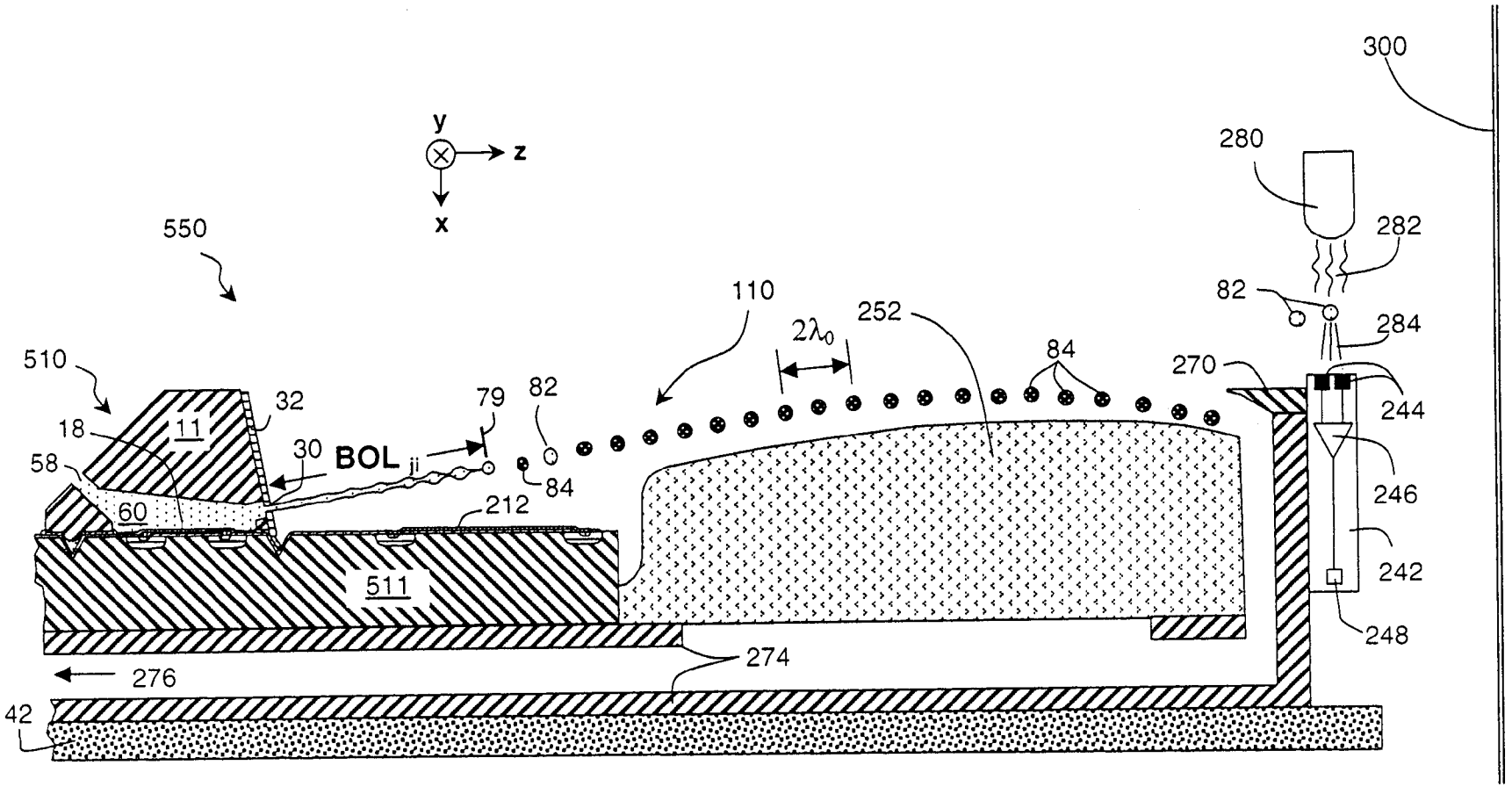
FIG. 20 is a side view illustration of an edgeshooter style liquid drop emitter as shown in FIG. 14 further illustrating drop deflection, guttering and optical sensing apparatus according to the present inventions.

FIG. 20 illustrates, in side view of one jet 110, a more complete liquid drop emission system 550 assembled on system support 42 comprising a drop emitter 510 of the edgeshooter type shown in FIG. 14. Drop emitter 510 with integrated inducting charging apparatus and MOS circuitry is further combined with a ground-plane style drop deflection apparatus 252, drop gutter 270 and optical sensor site 242. Gutter liquid return manifold 274 is connected to a vacuum source (not shown indicated as 276) that withdraws liquid that accumulates in the gutter from drops that are not used to form the desired pattern at receiver plane 300.

Ground plane drop deflection apparatus 252 is a conductive member held at ground potential. Charged drops flying near to the grounded conductor surface induce a charge pattern of opposite sign in the conductor, a so-called "image charge" that attracts the charged drop. That is, a charged drop flying near a conducting surface is attracted to that surface by a Coulomb force that is approximately the force between itself and an oppositely charged drop image located behind the conductor surface an equal distance. Ground plane drop deflector 252 is shaped to enhance the effectiveness of this image force by arranging the conductor surface to be near the drop stream shortly following jet break-off. Charged drops 84 are deflected by their own image force to follow the curved path illustrated to be captured by gutter lip 270 or to land on the surface of deflector 252 and be carried into the vacuum region by their momentum. Ground plane deflector 252 also may be usefully made of sintered metal, such as stainless steel and communicated with the vacuum region of gutter manifold 274 as illustrated.

Uncharged drops are not deflected by the ground plane deflection apparatus 252 and travel along an initial trajectory toward the receiver plane 300 as is illustrated for a two drop pair 82. An optical sensing apparatus is arranged immediately after gutter 270 to sense the arrival or passage of uncharged "print" or calibration test drops. Optical drop sensors are known in the prior art; for example, see U.S. Pat. No. 4,136,345 to Neville, et al. and U.S. Pat. No. 4,255,754 to Crean, et al. Illumination apparatus 280 is positioned above the post gutter flight path and shines light 282 downward toward light sensing elements 244. Drops 82 cast a shadow 284, or a shadow pattern for multiple drop sequences, onto optical sensor site 242. Light sensing elements 244 within optical sensor site 242 are coupled to differential amplifying circuitry 246 and then to sensor output pad 248. Optical sensor site 242 is comprised at least of one or more light sensing elements 244 and amplification circuitry 246 sufficient to signal the passage of a drop. As discussed above for the case of an electrostatic drop sensor, light sensing elements 244 usefully have a physical size in the case of one element, or a physical gap between multiple sensing elements, that is less than a drop stream wavelength, $\lambda_0$.

An illumination and optical drop sensing apparatus like that illustrated in FIG. 20 may also be employed at a location behind the receiver plane 300 as was discussed with respect to the liquid drop emission system illustrated in FIG. 13. An optical drop sensing apparatus arranged as illustrated may be used to measure drop arrival and passage times to thereby determine a characteristic related to the break-off time of the measured stream. Also this arrangement may be used to perform a frequency jitter measurement on uncharged drops in analogous fashion to the measurement of frequency jitter for a charged drop stream discussed above with respect to FIG. 12.

Figure 21:
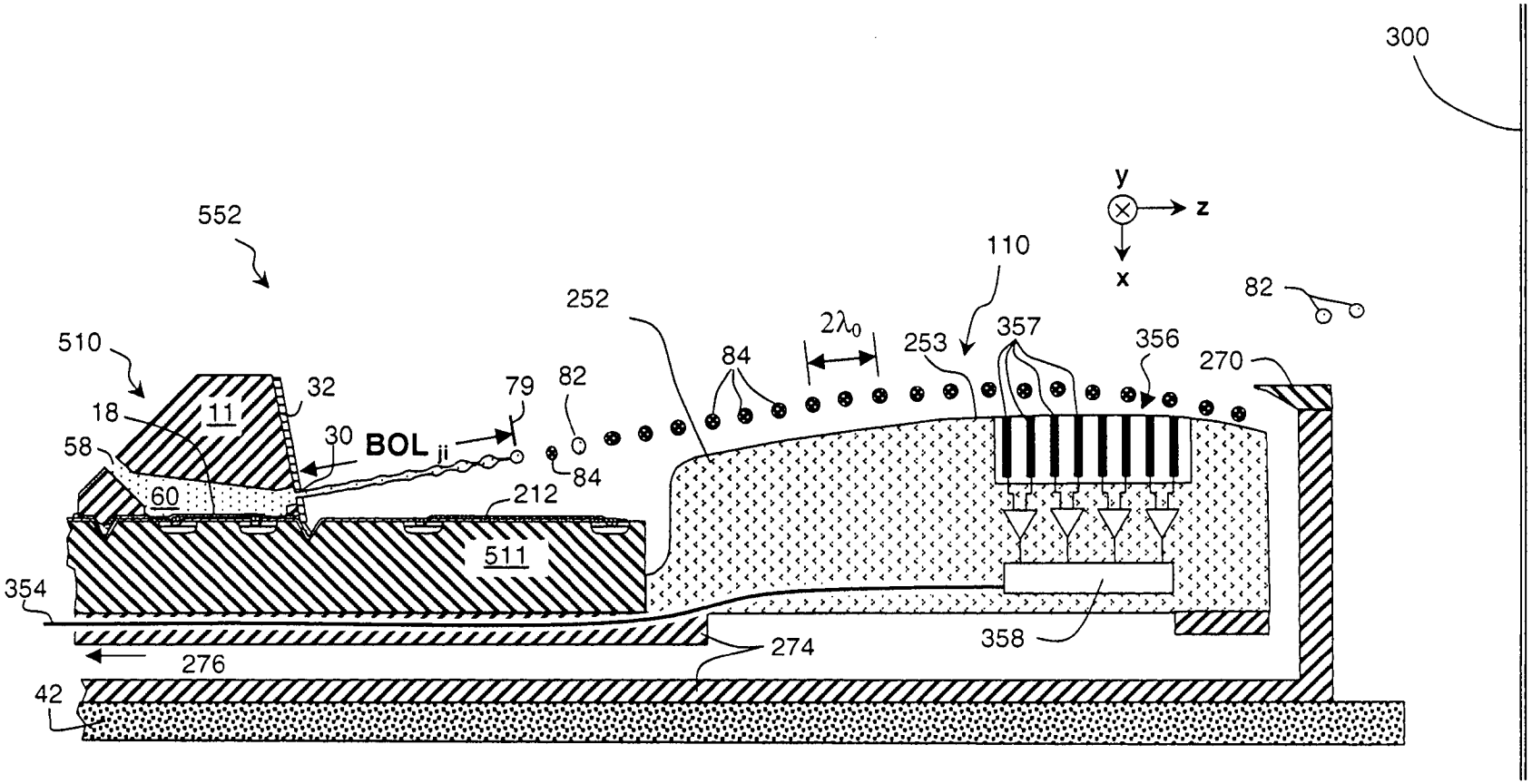
FIG. 21 is a side view illustration of an edgeshooter style liquid drop emitter as shown in FIG. 14 further illustrating drop deflection, guttering and having drop sensing apparatus located on the drop landing surface of the guttering apparatus according to the present inventions.

An alternate embodiment of a drop emission system 552 having a different location for the drop sensing apparatus 356 is illustrated in FIG. 21. With the exception of the drop sensing apparatus, the elements of alternate drop emission system 552 are the same as those of drop emission system 550 shown in FIG. 20 and may be understood from the explanations previously given with respect to FIG. 20. Drop sensing apparatus 356 is located along the surface 353 of deflection ground plane 252 which also serves as a landing surface for drops that are deflected for guttering. Such gutter landing surface drop sensors are disclosed by Piatt, et al. in U.S. Pat. No. 4,631,550, issued Dec. 23, 1986.

Drop sensing apparatus 358 is comprised of a plurality of sensor electrodes 357 that are connected to amplifier and interface electronics 358. When charged drops land in proximity to the sensor electrodes a voltage signal may be detected. Alternately, sensor electrodes 357 may be held at different voltages and the presence of a conducting working fluid is detected by the change in a base resistance developed along paths between sensor electrodes. Drop sensor apparatus 356 is a schematic representation of an individual sensor, however it is contemplated that a sensor serving an array of jets may have a set of sensor electrode and signal electronics for every jet, or for a group of jets, or even a single set that spans the full array width and serves all jets of the array. Drop sensor apparatus sensor signal lead 354 is shown schematically routed beneath drop emitter semiconductor substrate 511. It will be appreciated by those skilled in the ink jet art that many other configurations of the sensor elements are possible, including routing the signal lead to circuitry within semiconductor substrate 511.

Figure 22:
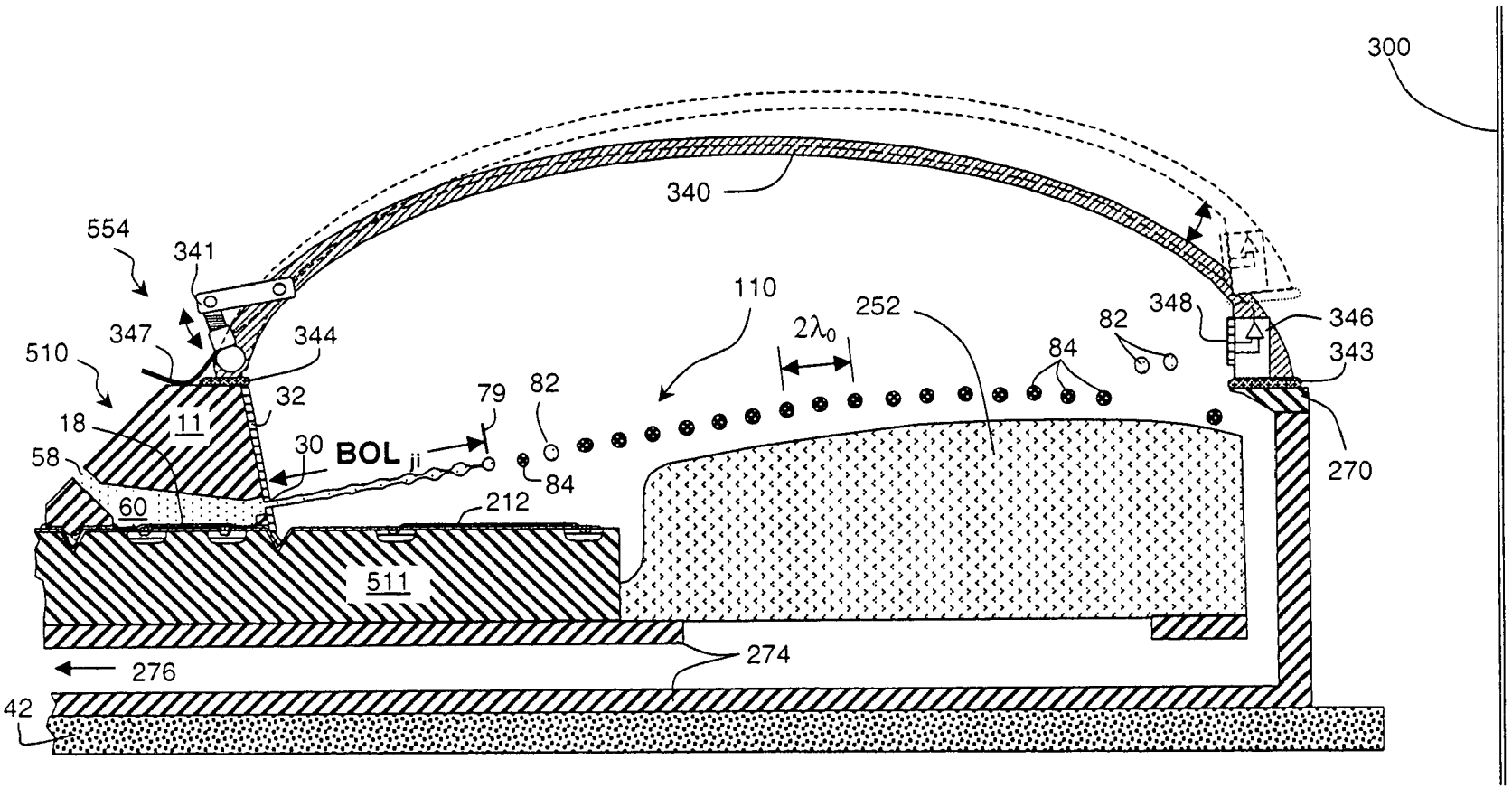
FIG. 22 is a side view illustration of an edgeshooter style liquid drop emitter as shown in FIG. 14 further illustrating drop deflection, guttering and having an eyelid sealing mechanism with drop sensing apparatus located on the eyelid apparatus according to the present inventions.

Another alternate embodiment of a drop emission system 554 having still another location for the drop sensing apparatus is illustrated in FIG. 22. Drop emission system 554 is fitted with a shroud 340, termed an "eyelid", which is configured to hermetically seal the drop flight path region between nozzles 30 and drop gutter catcher 270. During certain non-printing, printhead maintenance, power-off, start-up and shut-down conditions of the system, eyelid 340 is positioned by means of mechanism 341 to form a fluid-tight seal. A seal formed by eyelid 340 in its "closed" position is illustrated schematically in FIG. 22, by means of seal material 343 forced against gutter catcher 270 and seal member 344 forced against the drop generator chamber element 11. During printing or ready-standby states, eyelid 340 is raised by mechanism 341 as indicated by the phantom outline and arrow in FIG. 22, permitting drops to travel to the receiving substrate 300.

Typically the eyelid sealing apparatus is configured to catch undeflected drops and a drop guttering apparatus is configured to catch deflected drops, as illustrated in FIG. 22. This is the case when undeflected drops are used for image printing or other liquid pattern deposition on a receiver surface. However the opposite arrangement wherein deflected drops are used for printing is also feasible and in this case an eyelid sealing apparatus is configured to catch deflected drops and a corresponding drop guttering apparatus catches undeflected drops. Eyelid apparatus and functions are disclosed by McCann et al. in U.S. Pat. No. 5,394,177, issued Feb. 28, 1995 and by Simon, et al. in U.S. Pat. No. 5,455,611, issued Oct. 3, 1995.

With the exception of the eyelid mechanism and drop sensing apparatus 346, the elements of alternate drop emission system 554 are the same as those of drop emission system 550 shown in FIG. 20 and may be understood from the explanations previously given with respect to FIG. 20. Drop sensing apparatus 346 is located at an inner surface of the eyelid 340 above the lip of gutter 270 when the eyelid is in a closed or nearly closed position. Eyelid drop sensor 346 is comprised of sensor element 348 which is further comprised of means of sensing the impact of a drop by any of the transducer mechanisms previously discussed above with respect to sensor sites 242 in FIG. 13. Sensor elements 348 may be configured to respond to the arrival of conducting fluid by altering a resistance or capacitive circuit value, to a charged drop, or to the pressure of a drop impact via well know pressure transducer mechanisms.

Sensor elements 348 are connected to amplifier electronics. When drops land in proximity to the sensor element a voltage signal may be detected. Eyelid drop sensor apparatus 346 is a schematic representation of an individual sensor, however, it is contemplated that an eyelid drop sensor serving an array of jets may have a set of sensor electrodes and signal electronics for every jet, or for a group of jets, or even a single set that spans the full printhead width and serves all jets of the printhead. Eyelid drop sensor apparatus signal lead 347 is shown schematically (in phantom line) routed through the eyelid shroud member 340 emerging at the top of drop generator chamber element 11. It will be appreciated by those skilled in the ink jet art that many other configurations of eyelid position, shape, sealing members, movement mechanism, sensor elements and electrical leads are workable.

Figure 23:
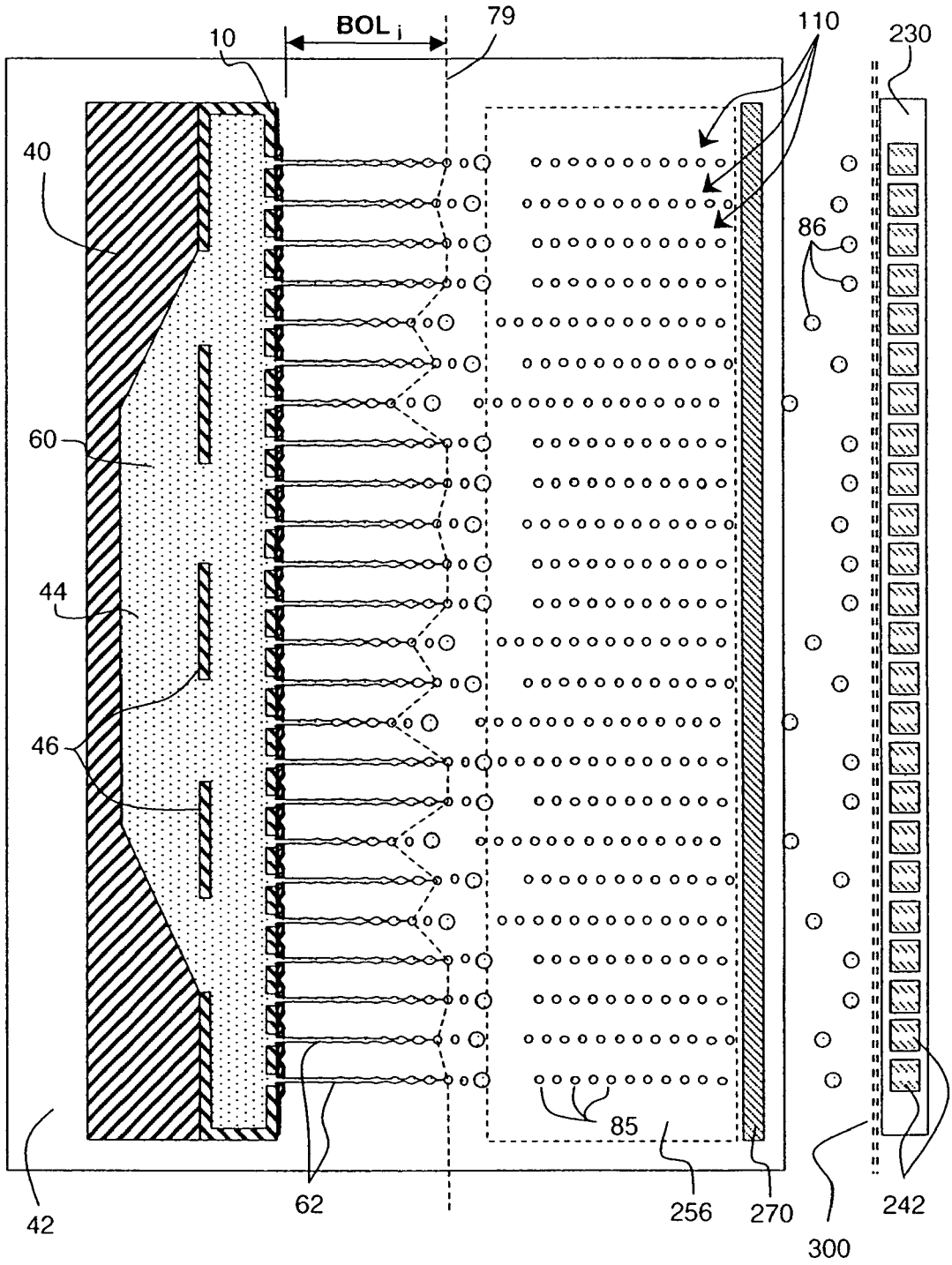
FIG. 23 is a top side view illustration of a liquid drop emitter system having a plurality of liquid streams and having individual drop sensing apparatus responsive to uncharged drops for each jet located after a non-electrostatic drop deflection apparatus according to the present inventions.

FIG. 23 illustrates a break-off control apparatus and method according to the present inventions wherein some drops 86 of volume $4V_0$ are being generated from each of the plurality of fluid streams 110. No inductive charging is being applied to the drops in this illustrated embodiment. An aerodynamic drop deflection zone 256 is schematically indicated along the flight paths after stream break-up at $BOL_j$ 79 and before gutter 270. Aerodynamic drop deflection apparatus are known in the prior art; see, for example, U.S. Pat. No. 6,508,542 to Sharma, et al. and U.S. Pat. No. 6,517,197 to Hawkins, et al. assigned to the assignee of the present inventions.

Aerodynamic deflection consists of establishing a cross air flow perpendicular to the drop flight paths (away from the viewer of FIG. 23) having sufficient velocity to drag drops downward towards gutter 270. The velocity of the cross airflow and the length of the aerodynamic deflection zone may be adjusted so that unit volume drops 85 are deflected more than integer multiple volume drops (86, 87, 88). The gutter apparatus 270 may then be arranged to collect either the unit volume drops 85 or integer multiple volume drops 86. The guttering apparatus 270 has been arranged to collect unit volume drops in the configuration illustrated in FIG. 23.

Integer multiple volume drops 86 are used to detect a characteristic of each fluid stream 110 by measuring the time between break-off at the break-off point 78 and arrival at sensor 230 located behind receiver plane location 300. An optical sensor of the type discussed above with respect to FIG. 20 is illustrated in FIG. 23.

Sensing apparatus that respond to drop impact may also be used to detect drop arrival times according to the present inventions. Drop impact sensors are known in the prior art based on a variety of physical transducer phenomena including piezoelectric and electrostrictive materials, moveable plate capacitors, and deflection or distortion of a member having a strain gauge. Drop impact sensors are disclosed, for example, in U.S. Pat. No. 4,067,019 to Fleischer, et al.; U.S. Pat. No. 4,323,905 to Reitberger, et al.; and U.S. Pat. No. 6,561,614 to Therien, et al.

Figure 24:
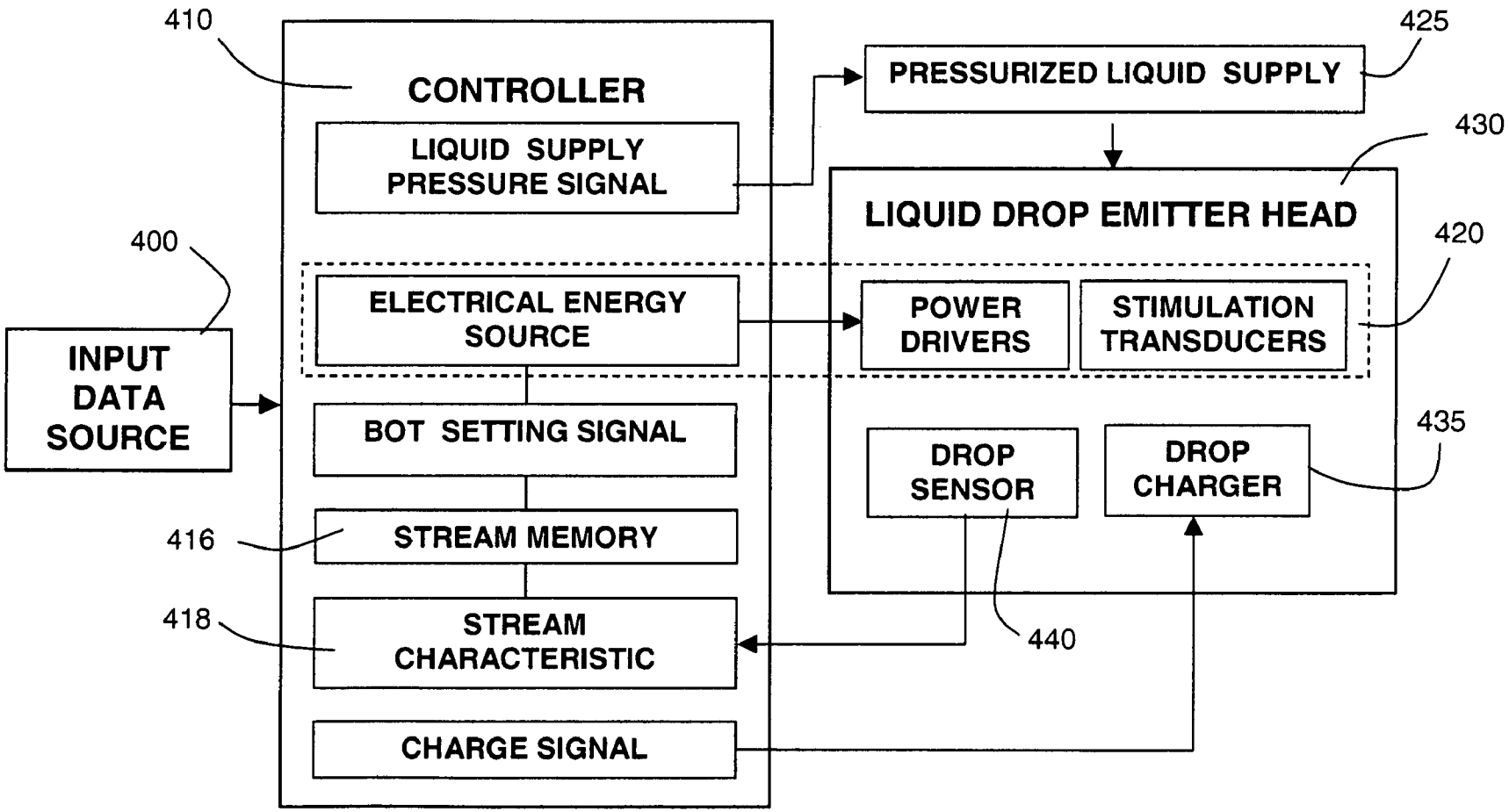
FIG. 24 illustrates a configuration of elements of a jet break-off time calculation and control apparatus according to the present inventions.

FIG. 24 illustrates in schematic form some of the electronic elements of a break-off control apparatus according to the present inventions. Input data source 400 represents the means of input of both liquid pattern information, such as an image, and system or user instructions, for example, to initiate a calibration program including break-off length measurements and break-off length adjustments. Input data source is for example a computer having various system and user interfaces.

Controller 410 represents computer apparatus capable of managing the liquid drop emission system and the break-off length control procedures according to the present inventions. Specific functions that controller 410 may perform include determining the timing and sequencing of electrical pulses to be applied for stream break-up synchronization, the energy levels to be applied for each stream of a plurality of streams to manage the break-off time of each stream, drop charging signals if utilized and receiving signals from sensing apparatus 440. Depending on the specific sensing hardware, drop patterns and methods employed, controller 410 may receive a signal from sensing apparatus 440 that characterizes a measured stream, or, instead, may receive lower level (raw) data, such as pre-amplified and digitized sensor site output.

Controller 410 includes stream memory 416 and a capability 418 to calculate the stream characteristic from raw sensor data, if necessary. Stream memory 416 stores characteristic values for the plurality of streams of predetermined volume in a format usable by the controller for creating the break-off time setting signal.

Controller 410 determines a break-off time setting signal based on a stream characteristic value determined at least, in part, from some sensed performance parameter associated with each stream. The break-off time setting signal then is provided to the jet stimulation apparatus to cause the operation of each jet at an optimum break-off time with respect to the sensed and calculated stream characteristic value. The drop emission system will therefore be operated with a plurality of predetermined break-off times, $BOT_j$, unless all streams are determined to have the same characteristic value that is being sensed and calculated.

Examples of characteristic values that may be sensed and calculated include induced drop charge amounts versus test pressure and break-off time test sequences, inter-drop charging amounts, charging caused by charging patterns applied to adjacent streams, time arrival of drops at a sensor site, proximity of a deflected or undeflected drop to a sensor site, landing position of a drop or drop pattern on a gutter landing surface, and so on. Essentially the characteristics values sensed and calculated according to the present inventions are measures of the amount of deviation from design target values of various parameters. Break-off times are then tailored and energy pulse sequences applied to reduce or eliminate deviations from performance targets whenever these may be affected by a change in the break-off time, length or phase.

Jet stimulation apparatus 420 applies pulses of energy to stimulation transducers associated with each stream of pressurized liquid sufficient to cause Rayleigh synchronization and break-up into a stream of drops of predetermined volumes, $V_0$ and, for some embodiments, $mV_0$. Stimulation energy may be provided in the form of thermal or mechanical energy as discussed previously. Jet stimulation apparatus 420 is comprised at least of circuitry that configures the desired electrical pulse sequences for each jet and power driver circuitry that is capable of outputting sufficient voltage and current to the transducers to produce the desired amount of thermal energy transferred to each continuous stream of pressurized fluid.

Liquid drop emitter 430 is comprised at least of stimulation transducers (resistive heaters, electromechanical or thermomechanical elements) in close proximity to the nozzles of a multi-jet continuous fluid emitter and charging apparatus for some embodiments.

Controller 410 also provides control signals to a pressurized liquid supply apparatus 425 that varies the pressure of the liquid supplied to the plurality of nozzles during some pressure test sequences. Test variation of the liquid supply pressure coupled with the measurement of other stream characteristics allows inferences to be made about the viscosity of the fluid being emitted. The viscosity of the fluid may vary in composition intentionally, via temperature changes or changes in composition due to the evaporation of volatile components. Some methods of the present inventions vary the fluid supply pressure while measuring drop charging and break-off characteristics in order to separate causal factors of jet performance among those arising from ink properties or from drop generator hardware characteristics.

The arrangement and partitioning of hardware and functions illustrated in FIG. 24 is not intended to convey all of many possible configurations of the present inventions. FIG. 24 illustrates an alternative configuration in which the drop sensor is integrated into a liquid drop emitter head 430 and all signal sourcing is determined and generated within controller 410.

Figure 25:
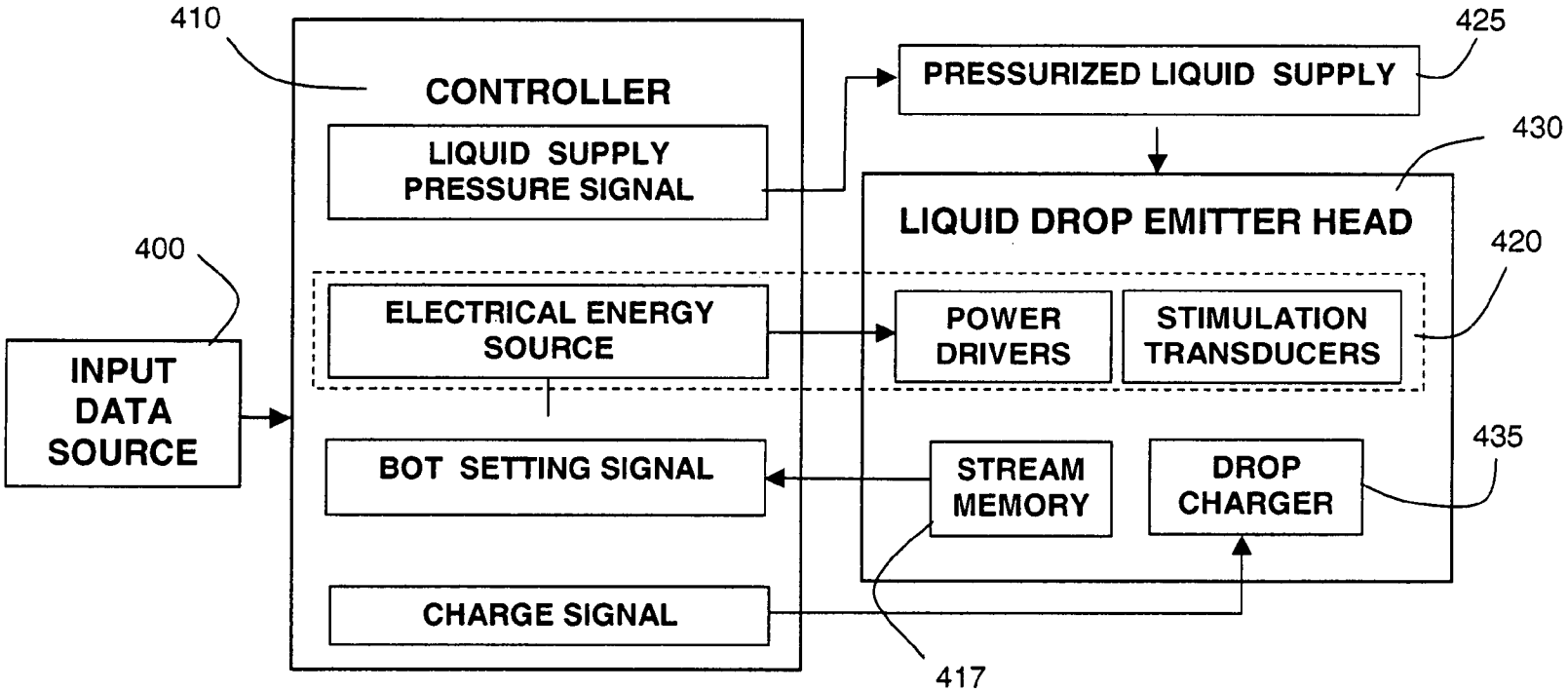
FIG. 25 illustrates a configuration of elements of a jet break-off time calculation and control apparatus using a stream memory according to the present inventions.

FIG. 25 illustrates a liquid drop emitter according to some embodiments of the present inventions for which a characteristic value for each stream is stored in a stream memory following an off-line measurement or calibration procedure. For these embodiments the liquid drop emission apparatus may not include a drop sensing apparatus that is used for break-off time control. Instead the controller retrieves characteristic values for each stream from a stream memory apparatus.

The stream memory apparatus is illustrated as being attached to liquid drop emitter head 430 in FIG. 25. Alternatively, stream memory may reside in the controller as is illustrated in FIG. 24 and perform the same function as it would if located with the drop emitter head. If the stream characteristic values are measured in a factory setting, it may be advantageous to store them with the drop emitter head so that original or replacement printheads may be incorporated interchangeably into different liquid drop emitter systems. Also, if stream characteristic values are updated in the field using calibration test set-ups, it may be advantageous to store the measured values with the emitter head for later analysis during a post-usage refurbishing operation or a quality assurance analysis.

Figure 26:
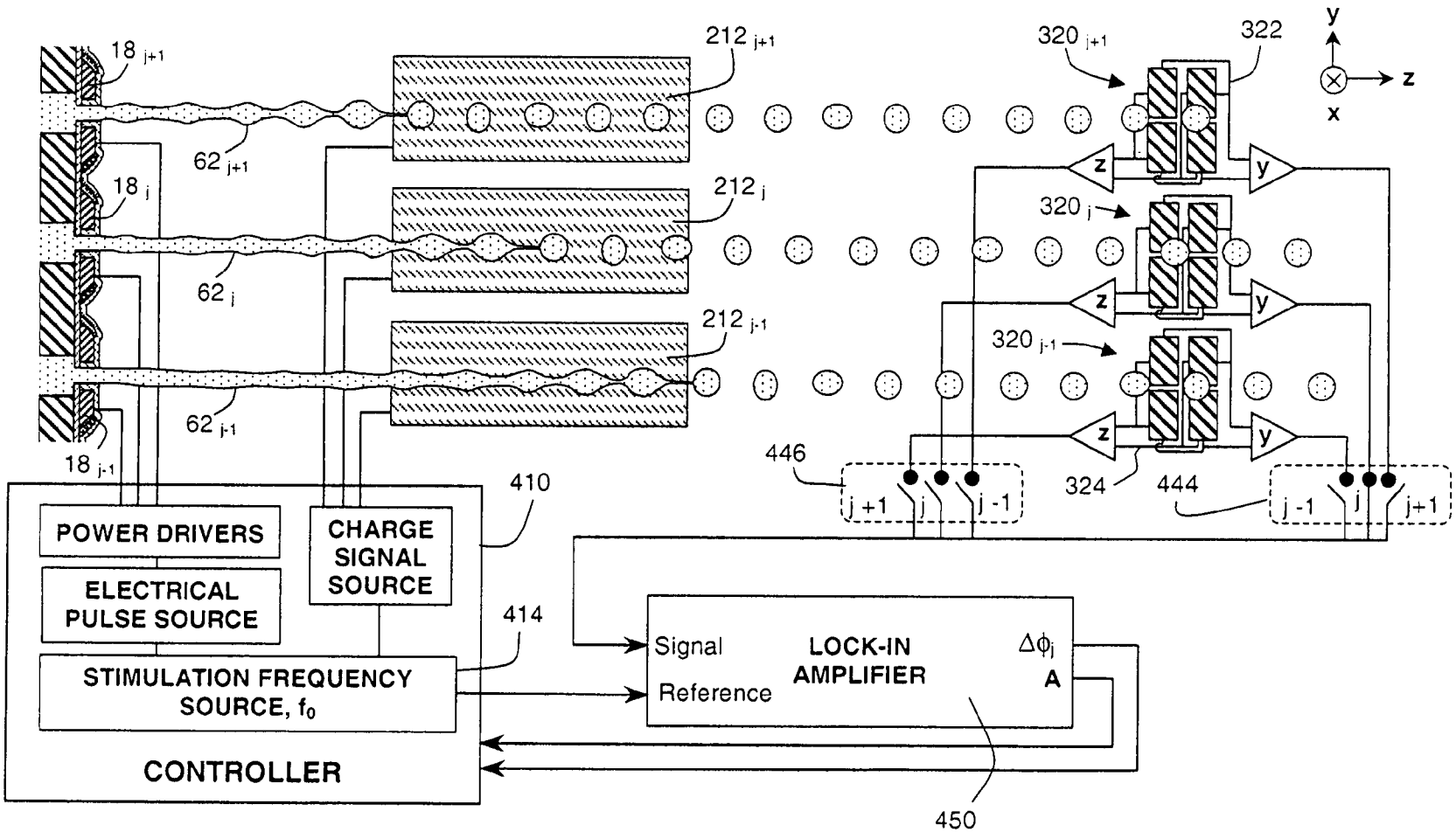
FIG. 26 is a top side view illustration of a liquid drop emitter system having a plurality of liquid streams and having a phase sensitive amplifier circuit comparing two drop streams.

It may be appreciated that the apparatus and methods of drop detection disclosed above, such as measurement of time of flight of drop pairs, charge amplitudes induced on one drop by various drop charge patterns applied to surrounding drops, variations in charge electrode efficiency and so may produce very small signals in charge detectors. It is advantageously found that an apparatus and method of detection that utilizes phase-sensitive signal processing techniques may be employed for such small signals. One preferred embodiment, illustrated in FIG. 26, uses a lock-in amplifier 450 to process signals from individual stream charged drop stream detectors 320*j*. FIG. 26 illustrates an expanded view portion showing the emission from nozzles of only three drop streams $\mathbf{62}_j$ of the plurality of the streams as drawn, for example, in FIG. 8. Heater resistors $\mathbf{18}_j$, charge electrodes $\mathbf{212}_j$, and charge sensor elements $\mathbf{320}_j$ are also included in the expanded view portion.

According to this present embodiment all drops of a stream $\mathbf{62}_j$ are charged in various test sequences at electrode $\mathbf{212}_j$ and a voltage response signal is generated for stream $\mathbf{62}_j$ by individual stream drop charge detector $\mathbf{320}_j$ as the drops pass over the detector. Drop charge detector elements $\mathbf{320}_j$ are further comprised of multiple electrodes arranged to detect the passage of drops with sensitivity to the charged flight path over the sensor site in both y- and z-directions. A first switch array 444 is provided so that the voltage signal from each individual y-direction drop charge detector $\mathbf{320}_j$, may be connected to lock-in amplifier 450 at an input terminal denoted "Signal". A second switch array 446 is provided so that the voltage signal from each individual z-direction drop charge detector $\mathbf{320}_j$, may be connected to lock-in amplifier 450 at the Signal input terminal, as well. In FIG. 26, the $j^{th}$ switch of second switch array 446 is closed while the $j-1^{th}$ and $j+1^{th}$ switches for the z-direction drop charge detectors ($\mathbf{320}_{j-1}$, $\mathbf{320}_{j+1}$) on either side are open, setting the system up to measure a characteristic of stream $\mathbf{62}_j$. Also all of switches 444 are open so that the depicted set-up is configured to sense charged drops from the $j^{th}$ stream, especially with respect to arrival events in the z-direction. A second input to lock-in amplifier 450, denoted "Reference", is provided with a voltage signal, by controller 410 that exactly tracks the stimulation frequency ($f_0$) signal used to control the electrical pulses applied to heater resistor $\mathbf{18}_j$ and, perhaps, a reference related to the charging test sequences being applied to both the $j^{th}$ jet drops and the $j\pm1^{th}$ jet drops.

The circuitry of lock-in amplifier 450 compares the signals at its two input terminals, i.e. the voltage from charged drop sensor $\mathbf{320}_j$ and the reference signal from controller 410. Lock-in amplifier 450 measures both the amplitude and the phase difference of the signal from sensing element $\mathbf{320}_j$ relative to the signal from a reference frequency source 414 and produces an amplitude output, A, and a phase difference output, $\Delta\phi$, as is well known in the art of signal processing.

Lock-in amplifier 450 is illustrated as a separate circuit unit in FIG. 26; however there are many implementations of phase sensitive amplification and detection that may be employed. Integration of the lock-in amplifier function within controller 410 or with circuitry associated with the charged drop sensor array 230 are also contemplated as embodiments of the present inventions. A digital comparator design that determines a digital representation of the time phase difference between digitized stimulation frequency and a drop stream detector signals may also be used to perform the functions of lock-in amplifier 450. Finally, while only a single lock-in amplifier 450 is illustrated, a plurality of lock-in amplifiers or other phase sensitive signal detection circuits may be employed so that measurements may be made for a plurality of drop steams simultaneously.

The phase difference $\Delta\phi_j$ measured by lock-in amplifier 450 between the signal from drop charge detector $\mathbf{320}_j$ and the reference stimulation frequency uniquely characterizes the break-off length $BOL_j$ of stream $\mathbf{62}_j$. Phase difference $\Delta\phi_j$ may be set to a specific value for each jet, by adjusting the break-off time of each jet. This adjustment may be accomplished, for example, by varying a parameter controlling the break-off time, such as the thermal stimulation energy, for each jet until the phase differences measured by the lock-in amplifier are at a target, predetermined value, for each jet, $\Delta\phi_{j1}$.

Alternatively, phase differences between an arbitrarily selected reference jet and other jets may be measured by inputting the signals from the corresponding pair of nozzle-specific sensing electrodes to a phase sensitive lock-in amplifier. This technique may be useful in sensing for charging crosstalk between pairs of jets. Further, a signal may be tested against a time delayed "copy" of itself producing an autocorrelation measurement that may be useful in assessing charging effects from drop to drop within a single stream.

Figure 27:
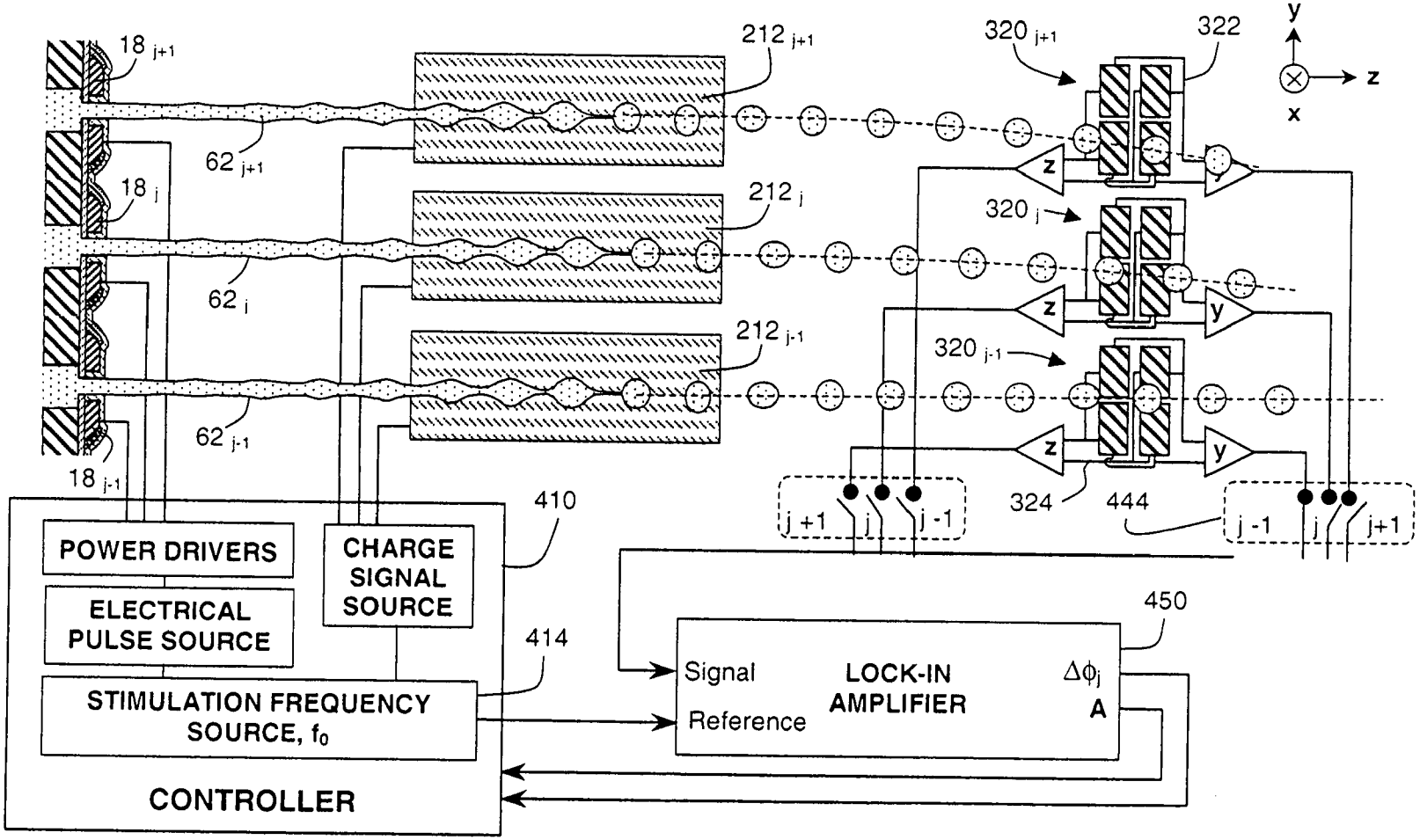
FIG. 27 is a top side view illustration of a liquid drop emitter system having a plurality of liquid streams that are aerodynamically deflecting in the plane of the jet array and having a phase sensitive amplifier circuit comparing two drop streams.

The apparatus of FIG. 26 is reproduced again in FIG. 27, however the drops streams are illustrated has following an arcing flight path in the −y direction for streams $\mathbf{62}_{j+1}$ and $\mathbf{62}_j$. This is the flight path that may result for end jets of a wide array of continuous streams. End jets are pulled inward by the air flow created by the many central jets as compared to the still air that exists to the sides of an array of streams. For the set-up of FIG. 27 the y-axis sensor for jet $\mathbf{62}_{j+1}$ is switched to the lock-in amplifier in order to detect the y-axis deviation of this jet. Modification of the break-off time, specifically, causing a shorter BOT and longer drop dwell time in the deflection field, may be used to assist gutter drops from end jets in landing on a gutter surface without splashing against inward jets, generating undesirable mist and spatter.

Figure 28:
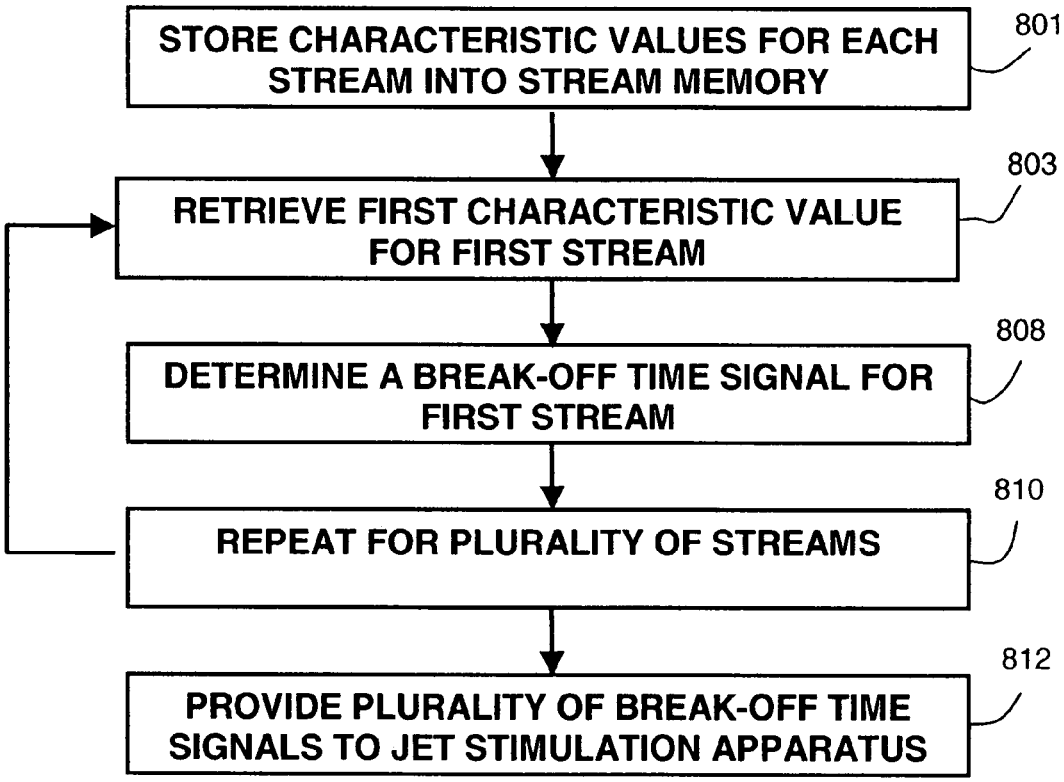
FIG. 28 illustrates a method of operating a liquid drop emission system using stored characteristic values for the plurality of drop streams and a plurality of break-off times according to the present inventions.

Throughout the above discussions methods of operating drop emission apparatus described and illustrated have been disclosed and implied. FIG. 28 schematically illustrates one method of operating a liquid drop emission system according to the present inventions. The method illustrated begins with step 801, storing characteristic values for each of the plurality of streams of drops of predetermined volumes. The characteristic values are obtained in a test procedure in an offline setting using a calibration apparatus having drop sensing capabilities. The characteristic values may be, but are not limited to, those described herein. A first stream characteristic value is retrieved in step 803 and a break-off time signal determined for the first stream in step 808. The method steps 803 and 808 are repeated for each of the plurality of drop streams in step 810. Based on the BOT setting signals for each stream, new operating energy pulse sequences are applied to the plurality of continuous liquid streams (812) thereby causing the plurality of streams to break-up into drops of predetermined volumes and at a plurality of operating break-off times.

However if all of the characteristic values of the plurality of streams are found to be identical, then all streams will be operated with the same BOT parameters. This ideal situation is highly unlikely to occur in a practical multi-jet array drop emission system. Indeed, if it could be guaranteed that all streams in a multi-jet liquid drop emission system would perform in an identical and predictable fashion with respect to drop formation, charging and deflection processes, then the present inventions would not be needed. Consequently, the present inventions are useful for liquid drop emitters having measurable performance differences among jets of a multi-jet array.

Step 804, detecting break-off times, charging or drop flight path behavior, may be understood to include the detection of patterns of drops, single drops or even the absence of drops from an otherwise continuous sequence of drops. In general, step 804 is implemented by sensing a drop after break-off from the continuous stream when it passes by a point along its flight path detectable by optical or electrostatic sensor apparatus or when it strikes a detector and is sensed by a variety of transducer apparatus that are sensitive to the impact of the drop mass.

It may be understood that the BOT setting signal may have many forms. It is intended that the BOT setting signal provide the information needed, in form and magnitude, to enable the adjustment of the sequence of electrical and energy pulses to achieve both the synchronized break-up of each jet into a stream of drops of predetermined volume and a predetermined break-off time including a predetermined tolerance. For example, the BOT setting signal might be a look-up table address, an energy stimulation pulse width or voltage, or parameters of a BOT offset pulse that is added to a primary stimulation energy pulse.

The electrical operating pulse sequence determined in step 812 contains the parameters necessary to cause drop break-up to occur at the plurality of chosen break-off times for each jet, $BOL_j$. The pulse sequences for each of the jets of a plurality of jets will be different in terms of the amount of applied energy per drop period but will all have a common fundamental repetition frequency, $f_0$. It is contemplated within the scope of the present inventions that the operating pulse sequences that are applied to individual jets may be selected from a finite set of options. That is, it is contemplated that acceptable break-off time adjustments for all jets, that achieve the acceptable operating BOT values within an acceptable tolerance range, may be realized by having, for example, only 8 choices of operating pulse energy that are selectable for the plurality of jets.

It is also contemplated, as discussed above, that the break-off stimulation energy may be applied in the form of an analog waveform composed of one or more sine waves and adjusted in amplitude or phase on a stream-by-stream basis. The alternative use of energy waveforms instead of pulse sequences is applicable to all of the methods of operation of the present inventions disclosed herein.

Figure 29:
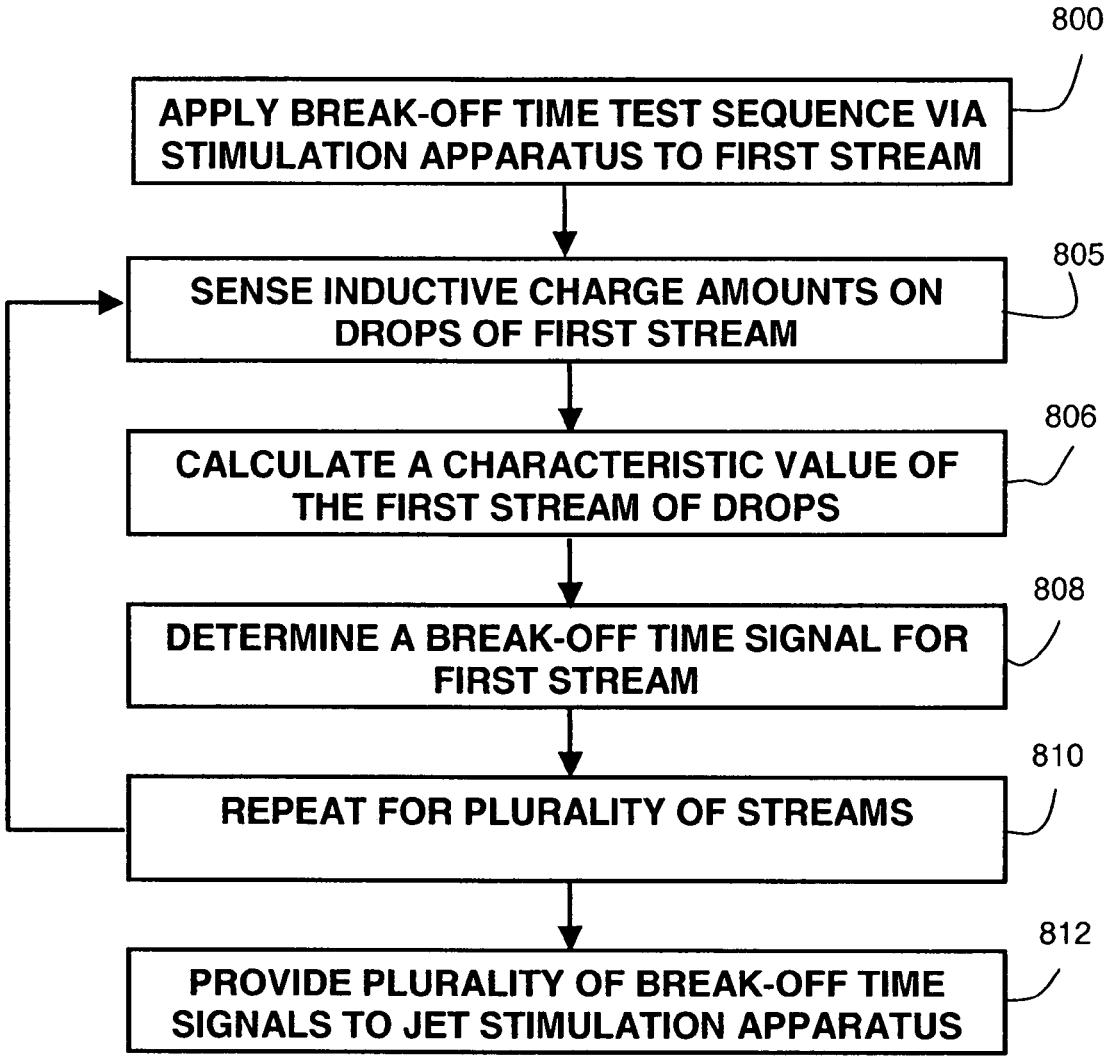
FIG. 29 illustrates a method of operating a liquid drop emission system using drop sensing and a plurality of break-off times according to the present inventions.

FIG. 29 schematically illustrates another method of operating a liquid drop emission system according to the present inventions. The method illustrated begins with step 800, applying a break-off time test sequence via the jet stimulation apparatus. The application of the test sequence may be initiated by the drop emission system controller 410 (see FIG. 24) or, potentially, explicitly by user or higher-level system data input 400. Controller 410 and the jet stimulation apparatus 420 act to apply energy pulses to a first stream of a liquid drop emitter (800). Sensing apparatus responds to the break-off test sequence by making some form of a drop measurement, for example, arrival time, impact or inter-drop jitter (805). The sensor detection data is then used to calculate some characteristic value of the first drop stream that directly relates to the break-off time, charging or drop flight path behavior of the first stream (806). A break-off time setting signal is determined based on the calculated drop stream characteristic value (808). The method steps 800 through 808 are repeated for each of the plurality of drop streams. Based on the BOT setting signals for each stream, new operating energy pulse sequences are selected (810) and applied to the plurality of continuous liquid streams (812) thereby causing the plurality of streams to break-up into drops of predetermined volumes and at a plurality of operating break-off times.

However if all of the characteristic values of the plurality of streams are found to be identical, then all streams will be operated with the same BOT parameters.

Step 804, detecting drop behavior or characteristics, may be understood to include the detection of patterns of drops, single drops or even the absence of drops from an otherwise continuous sequence of drops. In general, step 804 is implemented by sensing a drop after break-off from the continuous stream when it passes by a point along its flight path detectable by optical or electrostatic sensor apparatus or when it strikes a detector and is sensed by a variety of transducer apparatus that are sensitive to the impact of the drop mass.

Step 806, calculating a stream characteristic value, may be understood to mean the process of converting raw analog signal data obtained by a physical sensor transducer into a value or set of values that is related to the break-off, charging, drop formation or flight path characteristics of the measured drop stream. This value may be a time period that is larger for short break-off lengths and smaller for long break-off lengths or a charge amplitude value varies with break-off time or drop pattern. However the stream characteristic value may also be a value such as the magnitude of frequency jitter $\delta f$ about the primary frequency of stimulation, $f_0$. Further, the stream characteristic may be a choice of a specific BOT table value arrived at by using a test sequence that includes a range of predetermined stimulation pulse energies; sensing, therefore, drops produced at multiple break-off times; and then characterizing the stream by the choice of the pulse energy that causes the sensor measurement to most closely meet a predetermined target value.

Figure 30:
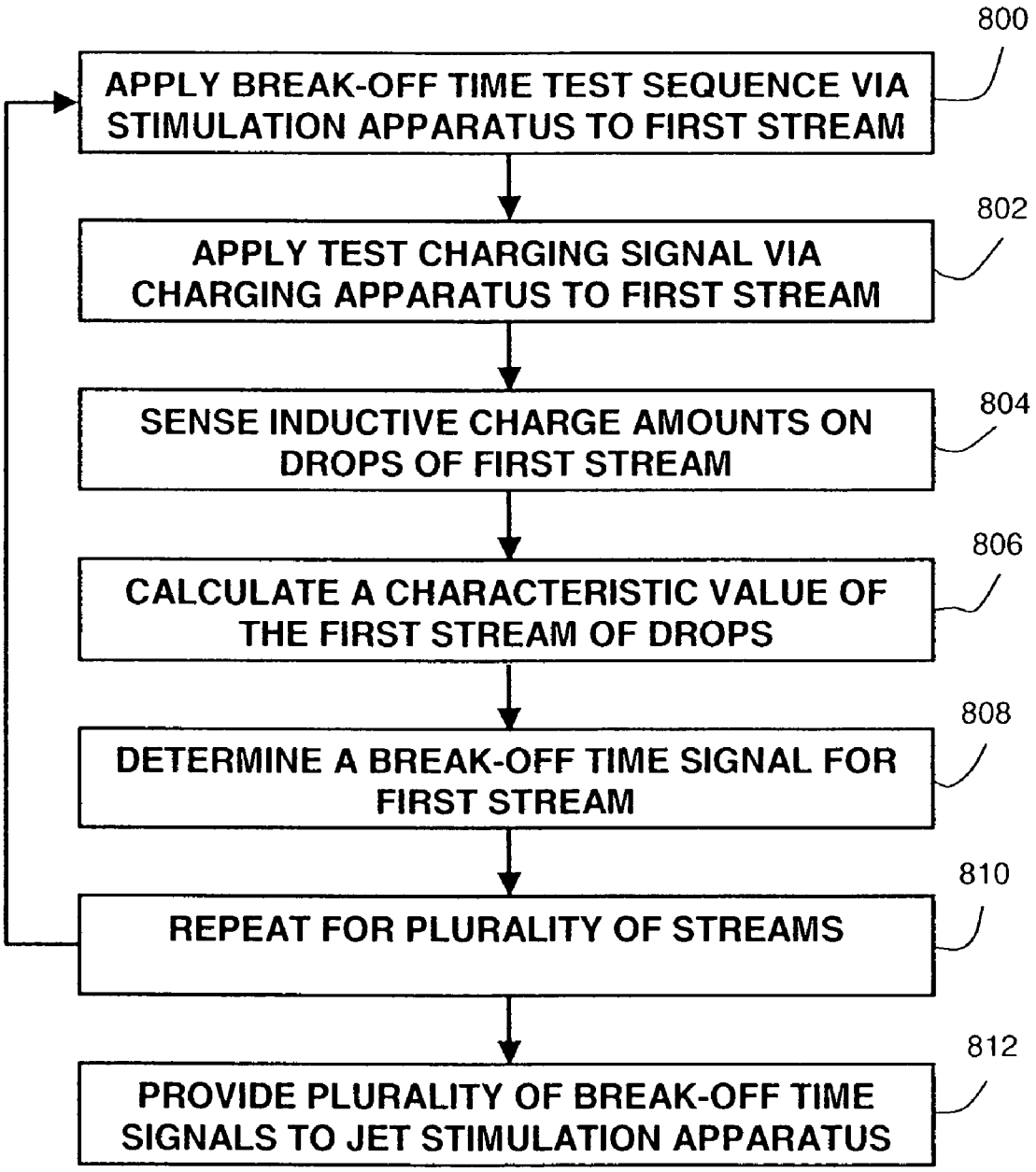
FIG. 30 illustrates a method of operating a liquid drop emission system using drop charge sensing and a plurality of break-off times according to the present inventions.

FIG. 30 schematically illustrates another method of operating a liquid drop emission system according to the present inventions. The method illustrated begins with step 800, applying a break-off time test sequence via the jet stimulation apparatus. The application of the test sequence may be initiated by the drop emission system controller 410 (see FIG. 24) or, potentially, explicitly by user or higher-level system data input 400. Controller 410 and the jet stimulation apparatus 420 act to apply energy pulses to a first stream of a liquid drop emitter (800). A drop charging signal is applied (802) to one or more streams, providing a pattern of charged drops that is designed to elicit characteristics of the drop charging and drop formation processes. Sensing apparatus responds to the break-off test sequence and test charging signal induced drop charge pattern by making some form of a drop arrival time measurement, charge amount detection or both (804). The sensor detection data is then used to calculate some characteristic value of the first drop stream that directly relates to the break-off time, charging or drop flight path behavior of the first stream (806). A break-off time setting signal is determined based on the calculated drop stream characteristic value (808). The method steps 800 through 808 are repeated for each of the plurality of drop streams. Based on the BOT setting signals for each stream, new operating energy pulse sequences are selected (810) and applied to the plurality of continuous liquid streams (812) thereby causing the plurality of streams to break-up into drops of predetermined volumes and at a plurality of operating break-off times.

Step 804, detecting break-off times, charging or drop flight path behavior, may be understood to include the detection of patterns of drops, single drops or even the absence of drops from an otherwise continuous sequence of drops. In general, step 804 is implemented by sensing a drop after break-off from the continuous stream when it passes by a point along its flight path detectable by optical or electrostatic sensor apparatus or when it strikes a detector and is sensed by a variety of transducer apparatus that are sensitive to the impact of the drop mass.

Step 806, calculating a stream characteristic value, may be understood to mean the process of converting raw analog signal data obtained by a physical sensor transducer into a value or set of values that is related to the break-off, charging, drop formation or flight path characteristics of the measured drop stream. This value may be a time period that is larger for short break-off lengths and smaller for long break-off lengths or a charge amplitude value varies with break-off time or drop pattern. However the stream characteristic value may also be a value such as the magnitude of frequency jitter $\delta f$ about the primary frequency of stimulation, $f_0$. Further, the stream characteristic may be a choice of a specific BOT table value arrived at by using a test sequence that includes a range of predetermined stimulation pulse energies; sensing, therefore, drops produced at multiple break-off times; and then characterizing the stream by the choice of the pulse energy that causes the sensor measurement to most closely meet a predetermined target value.

Figure 31:
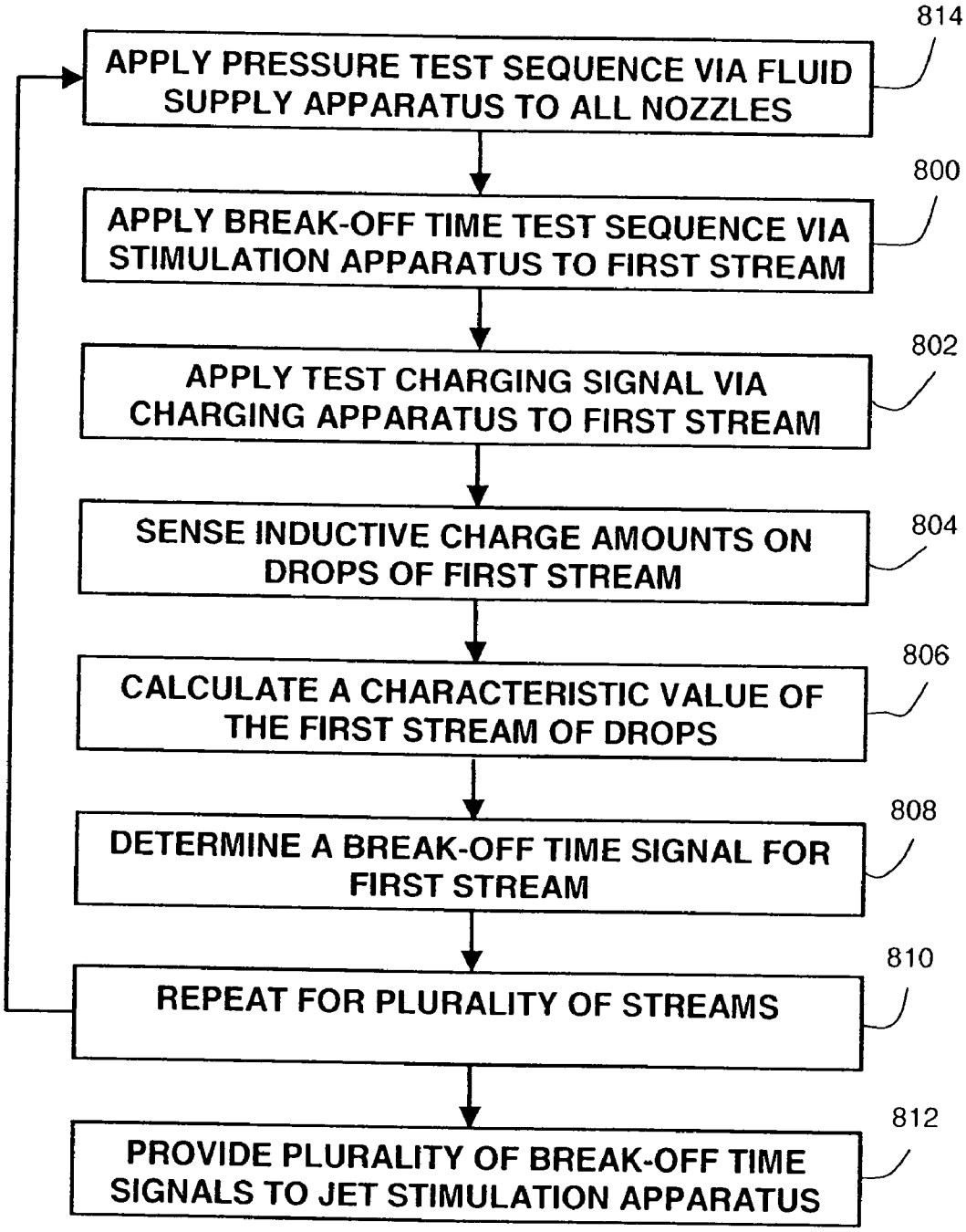
FIG. 31 illustrates another method of operating a liquid drop emission system using a liquid supply pressure sequence, drop charge sensing and a plurality of break-off times according to the present inventions.

FIG. 31 schematically illustrates another method of operating a liquid drop emission system according to the present inventions. The method illustrated by FIG. 31 is similar to the FIG. 30 method above discussed except that an additional step 814, applying a pressure test sequence (814), is added. This additional step is introduced in order to test for ink property changes and distinguish them from hardware adjustments such as charge electrode efficiencies, stimulation transducer changes, or anomalies in the drop deflection apparatus. Varying the supply pressure changes the stream velocity and hence the break-off time and length independently of the stimulation energy. The operating method illustrated by FIG. 31 carries out the method of FIG. 30 at set of different fluid supply pressures. Drop detection data may then be analyzed and compared to stored calibration data to detect that fluid properties have changed, especially fluid viscosity. BOT setting signals are then determined according to sensor detection information derived from tests that vary fluid pressure, break-off time and drop charging in an interleaved fashion. All of the other steps of the method illustrated by FIG. 31 have the same purpose as those having the same number identification associated with above FIG. 30 and may be understood from the above discussion.

Figure 32:
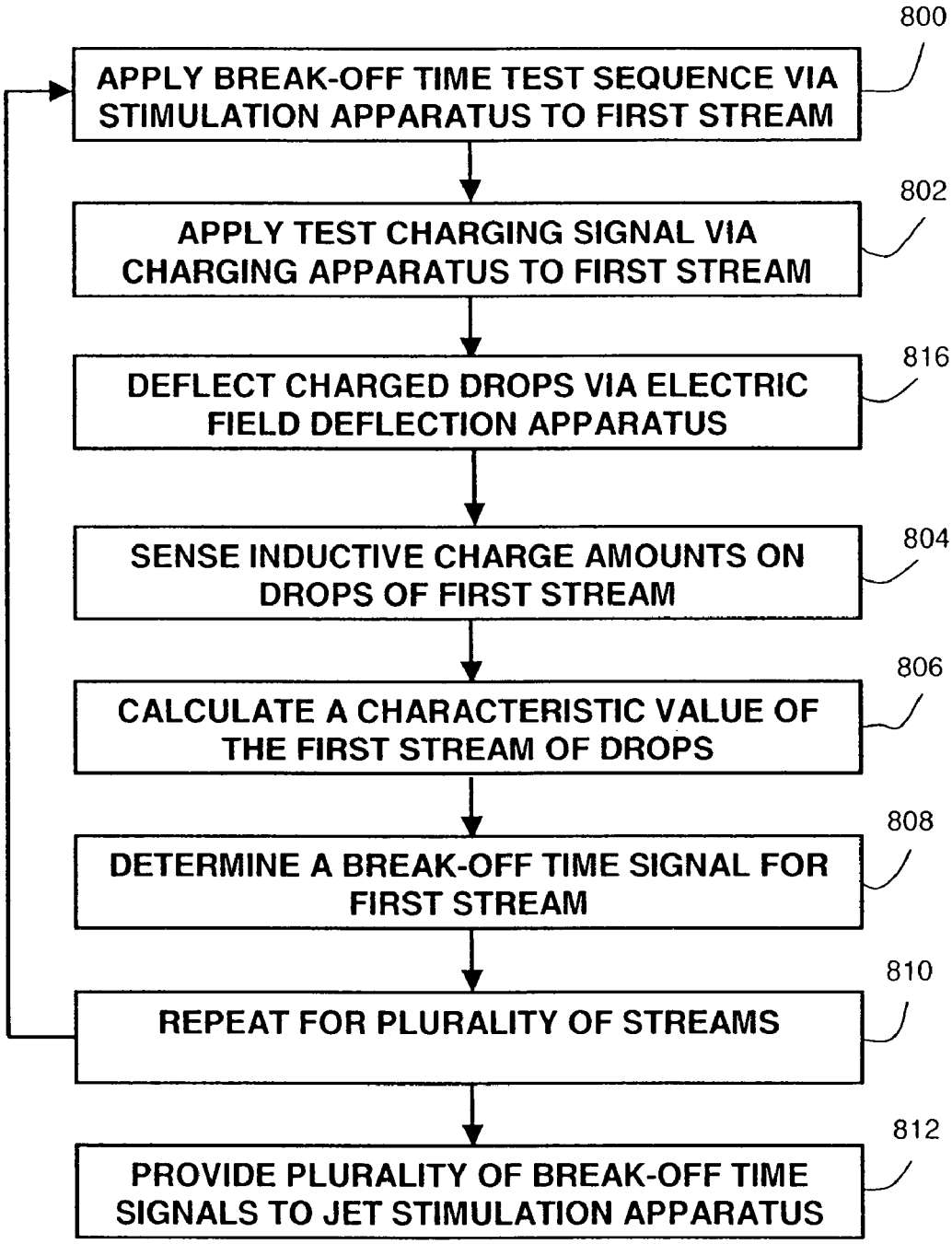
FIG. 32 illustrates a method of operating a liquid drop emission system using charged drop deflection, drop charge sensing and a plurality of break-off times according to the present inventions.

FIG. 32 schematically illustrates another method of operating a liquid drop emission system according to the present inventions. The method illustrated by FIG. 32 is similar to the FIG. 30 method above discussed except that an additional step 816, deflecting charged drops via electric field deflection apparatus (816), is added. This method operates in analogous fashion to the method of FIG. 30 except that charged drops are deflected along a path transverse to their initial flight path and the sensor data is collected along the deflected paths. This method is used with a drop emission apparatus such as that illustrated by FIG. 21. Sensing the drops along a deflected path allows the sensor information to include subtle charge and drop interaction effects that may not have developed to a significant amount spatially if the sensor were placed immediately following drop charging, for example, as illustrated by the apparatus of FIG. 11. All of the other steps of the method illustrated by FIG. 32 have the same purpose as those having the same number identification associated with above FIG. 30 and may be understood from the above discussion.

Figure 33:
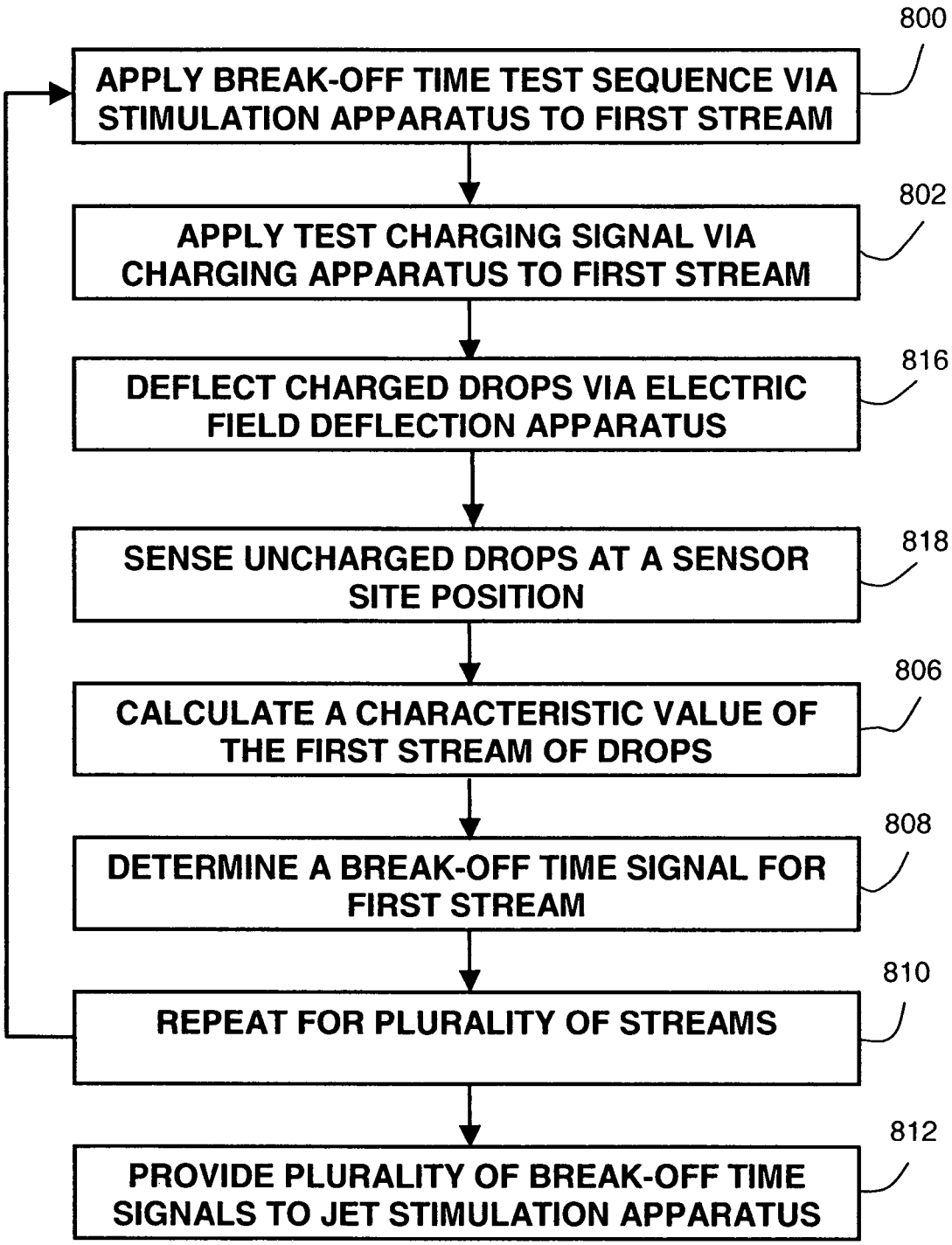
FIG. 33 illustrates a method of operating a liquid drop emission system using charged drop deflection, uncharged drop sensing and a plurality of break-off times according to the present inventions.

FIG. 33 schematically illustrates another method of operating a liquid drop emission system according to the present inventions. The method illustrated by FIG. 33 is similar to the FIG. 30 method above discussed except that step 804 is replaced by a step 818 whereby uncharged drops are sensed instead of charged drops. This method would be used with a drop emission system such as that illustrated in FIG. 13 having a sensing apparatus that detects drops by optical, impact or means other than by sensing induced charge. Sensing the uncharged drops along the initial flight path also allows the sensor information to include some of the subtle drop interaction effects that alter the print drop trajectories due to aerodynamic effects arising from gutter drops and nearby print drops. All of the other steps of the method illustrated by FIG. 33 have the same purpose as those having the same number identification associated with above FIGS. 30 and 32 and may be understood from the above discussions.

The inventions have been described in detail with particular reference to certain preferred embodiments thereof, but it will be understood that variations and modifications can be effected within the spirit and scope of the inventions.

The invention claimed is:

1. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer energy to the liquid in corresponding flow communication with the plurality of nozzles sufficient to cause the break-off of the plurality of continuous streams of liquid at a plurality of predetermined break-off times into a plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and sensing apparatus adapted to measure the characteristic value for each of the plurality of streams of drops of predetermined volumes, wherein pairs of drops in a stream of drops of predetermined volumes have an inter-drop time period characterized by an average value and a statistical deviation from the average value, and the characteristic value the stream of drops of predetermined volumes that is measured includes the statistical deviation in the inter-drop time period determined by differences in the measured times of flight for the pairs of drops.

2. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer energy to the liquid in corresponding flow communication with the plurality of nozzles sufficient to cause the break-off of the plurality of continuous streams of liquid at a plurality of predetermined break-off times into a plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and sensing apparatus adapted to measure the characteristic value for each of the plurality of streams of drops of predetermined volumes, wherein the predetermined volumes of drops include drops of a unit volume, $V_0$, and drops having volumes that are integer multiples of the unit volume, $mV_0$, wherein m is an integer and the sensing apparatus comprises drop detector apparatus capable of discriminating between drops of volume $V_0$ and $mV_0$, and wherein the characteristic value of the stream of drops of predetermined volumes that is measured includes a time of flight of a drop of predetermined volume $mV_0$, wherein $m \geqq 3$.

3. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer energy to the liquid in corresponding flow communication with the plurality of nozzles sufficient to cause the break-off of the plurality of continuous streams of liquid at a plurality of predetermined break-off times into a plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and stream memory apparatus adapted to store a characteristic value for each of the plurality of streams of drops of predetermined volumes, wherein the liquid drop emitter and the stream memory apparatus are attached to each other and are detachable from the continuous liquid drop emission apparatus.

4. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer energy to the liquid in corresponding flow communication with the plurality of nozzles sufficient to cause the break-off of the plurality of continuous streams of liquid at a plurality of predetermined break-off times into a plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and stream memory apparatus adapted to store a characteristic value for each of the plurality of streams of drops of predetermined volumes, wherein the stream memory apparatus is detachable from the continuous liquid drop emission apparatus.

5. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer pulses of energy to the liquid in corresponding flow communication with the plurality of nozzles sufficient to cause the break-off of the plurality of continuous streams of liquid at a plurality of predetermined break-off times into a plurality of streams of drops of predetermined volumes;

charging apparatus adapted to inductively charge at least one drop of each of the plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and stream memory apparatus adapted to store a characteristic value for each of the plurality of streams of drops of predetermined volumes, wherein the liquid drop emitter and the stream memory apparatus are attached to each other and are detachable from the continuous liquid drop emission apparatus.

6. A continuous liquid drop emission apparatus comprising:

a liquid drop emitter containing a positively pressurized liquid in flow communication with a plurality of nozzles formed in a common nozzle member for emitting a plurality of continuous steams of liquid;

a jet stimulation apparatus comprising a plurality of transducers corresponding to the plurality of nozzles and adapted to transfer pulses of energy to the liquid in corresponding flow communication with the plurality of nozzles sufficient to cause the break-off of the plurality of continuous streams of liquid at a plurality of predetermined break-off times into a plurality of streams of drops of predetermined volumes;

charging apparatus adapted to inductively charge at least one drop of each of the plurality of steams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and stream memory apparatus adapted to store a characteristic value for each of the plurality of streams of drops of predetermined volumes, wherein the stream memory apparatus is detachable from the continuous liquid drop emission apparatus.

7. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer pulses of energy to the liquid in corresponding flow communication with the plurality of nozzles sufficient to cause the break-off of the plurality of continuous streams of liquid at a plurality of predetermined break-off times into a plurality of streams of drops of predetermined volumes;

charging apparatus adapted to inductively charge at least one drop of each of the plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and sensing apparatus adapted to measure the characteristic value of each of the plurality of streams of drops of predetermined values, wherein at least one drop of the plurality of streams of drops of predetermined volumes is an inductively charged drop having an electrical charge and a predetermined flight trajectory; and the sensing apparatus comprises an electrical charge sensor that is responsive to the electrical charge on the inductively charged drop, and wherein pairs of inductively charged drops in a stream of drops of predetermined volumes have an inter-drop time period characterized by an average value and a statistical deviation from the average value, and the characteristic value of the stream of drops of predetermined volumes that is measured includes the statistical deviation in the inter-drop time period determined by differences in the measured times of flight for the pairs of inductively charged drops.

8. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer pulses of energy to the liquid in corresponding flow communication with the plurality of nozzles sufficient to cause the break-off of the plurality of continuous streams of liquid at a plurality of predetermined break-off times into a plurality of streams of drops of predetermined volumes;

charging apparatus adapted to inductively charge at least one drop of each of the plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and sensing apparatus adapted to measure the characteristic value of each of the plurality of streams of drops of predetermined values, and wherein following break-off the drops of predetermined volumes have initial flight trajectories, and electric field deflection apparatus generates a Coulomb force on an inductively charged drop in a direction transverse to an initial drop flight trajectory to cause the inductively charged drop to follow a deflected flight trajectory, wherein gutter apparatus catches the inductively charged drop on a landing surface, and the sensing apparatus is at least in part located in close proximity to the landing surface, and wherein the sensing apparatus senses the arrival of inductively charged drops at a plurality of landing positions along the landing surface and the characteristic value of a stream of drops of predetermined volumes that is measured includes a landing position of at least one drop of the stream of drops of predetermined volume.

9. A continuous liquid drop emission apparatus comprising:

a liquid drop emitter containing a positively pressurized liquid in flow communication with a plurality of nozzles formed in a common nozzle member for emitting a plurality of continuous streams of liquid;

a jet stimulation apparatus comprising a plurality of transducers corresponding to the plurality of nozzles and adapted to transfer pulses of energy to the liquid in corresponding flow communication with the plurality of nozzles sufficient to cause the break-off of the plurality of continuous streams of liquid at a plurality of predetermined break-off times into a plurality of streams of drops of predetermined volumes;

charging apparatus adapted to inductively charge at least one drop of each of the plurality of streams of drops of predetermined volumes;

control apparatus adapted to provide a plurality of break-off time setting signals to the jet stimulation apparatus to cause the plurality of predetermined break-off times, said break-off time setting signals determined, at least, by a characteristic value of each of the plurality of streams of drops of predetermined volumes; and sensing apparatus adapted to measure the characteristic value of each of the plurality of streams of drops of predetermined values, and wherein following break-off the drops of predetermined volumes have initial flight trajectories, and electric field deflection apparatus generates a Coulomb force on an inductively charged drop in a direction transverse to an initial drop flight trajectory to cause the inductively charged drop to follow a deflected flight trajectory, and wherein gutter apparatus catches deflected drops, eyelid sealing apparatus catches undeflected drops, and the sensing apparatus is at least in part located on the eyelid sealing apparatus.

* * * * *